US006065302A

United States Patent [19]

Sada et al.

[11] Patent Number: 6,065,302

[45] Date of Patent: May 23, 2000

[54] HEAT TRANSPORT SYSTEM

[75] Inventors: Shinri Sada; Yasushi Hori; Tetsushi Maeda, all of Osaka, Japan

[73] Assignee: Daikin Industries, Ltd., Osaka, Japan

[21] Appl. No.: 09/051,796

[22] PCT Filed: Oct. 24, 1996

[86] PCT No.: PCT/JP96/03129

§ 371 Date: Apr. 22, 1998

§ 102(e) Date: Apr. 22, 1998

[87] PCT Pub. No.: WO97/15799

PCT Pub. Date: May 1, 1997

[30] Foreign Application Priority Data

Oct. 24, 1995 [JP] Japan ..... 7-275265
Jul. 4, 1996 [JP] Japan ..... 8-174751

[51] Int. Cl.[7] ..... F25B 25/00; F04B 19/24

[52] U.S. Cl. ..... 62/324.4; 62/333; 165/104.24; 417/208

[58] Field of Search ..... 62/174, 333, 324.4; 165/104.24; 417/208

[56] References Cited

U.S. PATENT DOCUMENTS

| | | | |
|---|---|---|---|
| 2,779,171 | 1/1957 | Lindenblad | 62/333 X |
| 3,285,001 | 11/1966 | Turnblade | 417/208 X |
| 4,576,009 | 3/1986 | Ogushi et al. | 62/159 X |

FOREIGN PATENT DOCUMENTS

| | | |
|---|---|---|
| 59-163769 | 11/1984 | Japan . |
| 60-29591 | 2/1985 | Japan . |
| 60-171389 | 9/1985 | Japan . |
| 61-43680 | 3/1986 | Japan . |
| 61-70387 | 4/1986 | Japan . |
| 61-70388 | 4/1986 | Japan . |
| 62-85451 | 4/1987 | Japan . |
| 62-238951 | 10/1987 | Japan . |
| 63-58062 | 3/1988 | Japan . |
| 63-180022 | 7/1988 | Japan . |

*Primary Examiner*—William Wayner
*Attorney, Agent, or Firm*—Nixon Peabody LLP; Eric J. Robinson; Donald R. Studebaker

[57] ABSTRACT

A heat exchanger (1) on the secondary heat source, which exchanges heat with a heat exchanger (12) on the primary heat source in a primary cooling circuit (A), is connected with an indoor heat exchanger (3) through a gas pipe (6) and a liquid pipe (7). A tank (T) storing a liquid cooling medium is connected at its lower end to the liquid pipe (7) and its upper end to a pressure adjustment mechanism (18). Check valves (CV1 and CV2) are disposed on both sides of the connecting point of the tank (T) with respect to the liquid pipe (7). The internal pressure of the tank (T) is changed over alternately between a high pressure state and a low pressure state by the pressure adjustment mechanism (18) so that the liquid cooling medium is supplied to the indoor heat exchanger (3) at the time of the high pressure operation, and the liquid cooling medium is recovered from the heat exchanger (1) on the secondary side to the tank (T) and is circulated by a secondary cooling circuit (B) at the time of the low pressure operation.

28 Claims, 36 Drawing Sheets

HEAT TRANSPORT SYSTEM

TECHNICAL FIELD

The present invention relates to a heat transport system, which can be used as refrigerant circuitry for an air conditioning system, for example. More particularly, the present invention relates to a heat transport system for transporting at by circulating a heat transport medium without requiring driving source such as a pump.

BACKGROUND ART

As refrigerant circuitry for an air conditioning system, two-system refrigerant circuitry, such as that disclosed in Japanese Laid-Open Publication No. 62-238951, has conventionally been known. Refrigerant circuitry of this type includes: a primary refrigerant circuit in which a compressor, a heat exchanger on a first heat source side, a pressure reducing mechanism and a heat exchanger on a first application side are sequentially connected to each other through a refrigerant pipe; and a secondary refrigerant circuit in which a pump, a heat exchanger on a second heat source side and a heat exchanger on a second application side are connected to each other through a refrigerant pipe.

And, heat is exchanged between the heat exchanger on the first application side of the primary refrigerant circuit and the heat exchanger on the second heat source side of the secondary refrigerant circuit, and the heat exchanger on the second application side is disposed within a room to be air-conditioned.

In this refrigerant circuitry, during the room cooling running, a refrigerant is evaporated in the heat exchanger on the first application side and is condensed in the heat exchanger on the second heat source side. In the heat exchanger on the second application side, the condensed refrigerant exchanges heat with the indoor air and is evaporated, thereby cooling the indoor air.

On the other hand, during the room heating running, a refrigerant is condensed in the heat exchanger on the first application side and is evaporated in the heat exchanger on the second heat source side. In the heat exchanger on the second application side, the evaporated refrigerant exchanges heat with the indoor air and is condensed, thereby heating the indoor air.

In this way, the piping length of the primary refrigerant circuit is intentionally shortened, thereby trying to improve the refrigerating capacity.

However, in such an arrangement, a pump is required as a discrete driving source for circulating the refrigerant in the secondary refrigerant circuit. As a result, the power consumption and the like are increased. In addition, since such a driving source is required, the number of parts having such factors as to cause some failure is increased and thus the reliability of the entire system is adversely deteriorated.

As refrigerant circuitry for overcoming these problems, there exists a heat transport system of a so-called "non-powered" heat transport type, in which no driving source is provided for a secondary refrigerant circuit. The heat transport systems of such a type include a system disclosed in Japanese Laid-Open Publication No. 63-180022. In the heat transport system, the secondary refrigerant circuit is constructed such that a heater, a condenser and a sealed container are sequentially connected to each other through a refrigerant pipe and that the sealed container is disposed at a position higher than that of the heater. Moreover, the heater and the sealed container are connected to each other through an equalizer pipe including an opening/closing valve.

In such an arrangement, during the room heating running, the opening/closing valve is first closed. The gaseous refrigerant heated by the heater is condensed in the condenser so as to be liquefied. Then, the liquid refrigerant is recovered into the sealed container. Thereafter, the opening/closing valve is opened, the pressure in the heater is equalized by the equalizer pipe with the pressure in the sealed container, and then the liquid refrigerant is recovered from the sealed container, disposed at a position higher than that of the heater, to the heater.

By repeating this operation, the circulation of the refrigerant is enabled without providing any driving source such as a pump for the secondary refrigerant circuit.

(Problems to be solved)

However, in such a heat transport system, if the gaseous refrigerant flows from the condenser into the sealed container, then the pressure in the sealed container rises. As a result, there is some possibility that the operation of circulating the refrigerant cannot be performed satisfactorily. Thus, the condenser is required to excessively cool the refrigerant so that the gaseous refrigerant does not flow out from the condenser.

Moreover, the heat transport system ameliorates the inner structure of the sealed container so as to suppress a rise in pressure within the sealed container. However, the system cannot be regarded as attaining sufficient reliability.

Furthermore, if the liquid refrigerant is to be introduced into the sealed container with certainty in this manner, then the condenser is required to be disposed at a position higher than that of the sealed container. Thus, since undue restriction is imposed on the positions where the respective units are disposed, it has been difficult to apply such a system to a large-scale system or a system having a long pipe.

In view of this point, the present invention has been made in order to accomplish an objective of alleviating the restriction on the positions where units are disposed and attaining high reliability and universality for a heat transport system of a non-powered heat transport type requiring no driving source.

DISCLOSURE OF THE INVENTION

In order to accomplish the above-described objective, according to the present invention, a refrigerant in a refrigerant circuit on an application side is pressurized, and is circulated in the refrigerant circuit on the application side by utilizing this pressure. In addition, the direction in which the refrigerant circulates is controlled such that heat exchange means on the application side can perform a predetermined operation.

Specifically, as shown in FIG. 1, the first solution provided by the present invention includes a refrigerant circuit (B) constituted such that heat exchange means (1) on a heat source side is connected to heat exchange means (3) on an application side through a gas pipe (6) and a liquid pipe (7) so as to circulate a refrigerant therein, the heat exchange means (1) on the heat source side exchanging heat with heat source means (A).

And tank means (T) for communicating with the liquid pipe (7) and reserving a liquid refrigerant therein is also provided. And pressure regulating means (18) for alternately performing a pressurizing operation for raising an internal pressure of the tank means (T) and a pressure reducing operation for lowering the internal pressure is further provided.

In addition, refrigerant control means (H) is further provided for allowing only a supply of the liquid refrigerant from the tank means (T) to any of the heat exchange means to be an evaporator during the pressurizing operation of the pressure regulating means (18) and allowing only a recovery of the liquid refrigerant from any of the heat exchange means to be a condenser to the tank means (T) during the pressure reducing operation thereof, thereby circulating the refrigerant of the refrigerant circuit (B) and making the heat exchange means (3) on the application side absorb or radiate heat.

In the first solution, the liquid refrigerant is supplied from the tank means (T) to the heat exchange means to be an evaporator during the pressurizing operation of the pressure regulating means (18). On the other hand, during the pressure reducing operation of the pressure regulating means (18), the liquid refrigerant is recovered from the heat exchange means to be a condenser to the tank means (T). Thus, the refrigerant is circulated in a predetermined direction between the heat exchange means (1) on the heat source side and the heat exchange means (3) on the application side and the heat absorption or radiation is caused in the heat exchange means (3) on the application side.

In this manner, the refrigerant is circulated by utilizing the pressure applied from the pressure regulating means (18) to the tank means (T). Also, the recovery of the liquid refrigerant from the heat exchange means to be a condenser to the tank means (T) is performed by a low pressure generated in the tank means (T).

Thus, in accordance with the first solution, since a high-pressure state and a low-pressure state are alternately and switchably established in the tank means (T) connected to the liquid pipe (7) and the refrigerant is circulated between the heat exchange means (1) on the heat source side and the heat exchange means (3) on the application side by utilizing this pressure, special transport means, such as a refrigerant circulating pump for circulating the refrigerant is no longer necessary. As a result, the power consumption and the number of parts having such factors as to cause a failure can be reduced and the reliability of the entire system can be ensured.

In addition, since the liquid refrigerant in the heat exchange means to be a condenser is sucked by utilizing the low pressure of the tank means (T), the conventional restriction on the positions where units are disposed, such as disposing the tank means (T) at a lower position than that of the heat exchange means, can be eliminated, thereby improving the practicality.

Moreover, since the refrigerant circulation operation in the refrigerant circuit (B) can be performed stably, the refrigerant can be circulated satisfactorily even when the entire circuitry is formed in a large size. Consequently, the system can be enlarged.

In the second solution provided by the present invention, the first solution is modified such that the heat exchange means (3) on the application side functions as an evaporator for absorbing heat as shown in FIG. 1. The refrigerant control means (H) allows the liquid refrigerant to be supplied from the tank means (T) to the heat exchange means (3) on the application side and prevents the liquid refrigerant from being supplied from the tank means (T) to the heat exchange means (1) on the heat source side during the pressurizing operation of the pressure regulating means (18), and allows the liquid refrigerant to be recovered from the heat exchange means (1) on the heat source side to the tank means (T) and prevents the liquid refrigerant from being recovered from the heat exchange means (3) on the application side to the tank means (T) during the pressure reducing operation of the pressure regulating means (18).

In the second solution, during the heat absorption running of the heat exchange means (3) on the application side, the liquid refrigerant is supplied from the tank means (T) to the heat exchange means (3) on the application side, and is evaporated in the heat exchange means (3) on the application side. And the gaseous refrigerant is condensed in the heat exchange means (1) on the heat source side and then recovered into the tank means (T). Thus, a heat absorption operation is realized by the refrigerant evaporated in the heat exchange means (3) on the application side.

In accordance with the second solution, only the supply of the liquid refrigerant from the tank means (T) to the heat exchange means (3) on the application side is allowed during the pressurizing operation of the pressure regulating means (18), and only the recovery of the liquid refrigerant from the heat exchange means (1) on the heat source side to the tank means (T) is allowed during the pressure reducing operation of the pressure regulating means (18), thereby making the heat exchange means (3) on the application side perform heat absorption running. Thus, the heat absorption running of the heat exchange means (3) on the application side can be performed with certainty and the reliability of the system can be improved.

In the third solution provided by the present invention, the first solution is modified such that the heat exchange means (3) on the application side functions as a condenser for radiating heat, as shown in FIG. 7. The refrigerant control means (H) allows the liquid refrigerant to be supplied from the tank means (T) to the heat exchange means (1) on the heat source side and prevents the liquid refrigerant from being supplied from the tank means (T) to the heat exchange means (3) on the application side during the pressurizing operation of the pressure regulating means (18), and allows the liquid refrigerant to be recovered from the heat exchange means (3) on the application side to the tank means (T) and prevents the liquid refrigerant from being recovered from the heat exchange means (1) on the heat source side to the tank means (T) during the pressure reducing operation of the pressure regulating means (18).

In the third solution, during the heat radiation running of the heat exchange means (3) on the application side, the liquid refrigerant is supplied from the tank means (T) to the heat exchange means (1) on the heat source side, and is evaporated in the heat exchange means (1) on the heat source side. And the gaseous refrigerant is condensed in the heat exchange means (3) on the application side and then recovered into the tank means (T). Thus, a heat radiation operation is realized by the refrigerant condensed in the heat exchange means (3) on the application side.

In accordance with the third solution, only the supply of the liquid refrigerant from the tank means (T) to the heat exchange means (1) on the heat source side is allowed during the pressurizing operation of the pressure regulating means (18), and only the recovery of the liquid refrigerant from the heat exchange means (3) on the application side to the tank means (T) is allowed during the pressure reducing operation of the pressure regulating means (18), thereby making the heat exchange means (3) on the application side perform heat radiation running. Thus, the heat radiation running of the heat exchange means (3) on the application side can be performed with certainty and the reliability of the system can be improved.

In the fourth solution provided by the present invention, the first, second or third solution is modified such that the pressure regulating means (18) applies heat to the refrigerant in the tank means (T) so as to raise the internal pressure of the tank means (T) during the pressurizing operation, and extracts heat from the refrigerant of the tank means (T) so as to lower the internal pressure of the tank means (T) during the pressure reducing operation as shown in FIGS. 4 and 5.

In the fourth solution, the refrigerant in the tank means (T) is directly heated and cooled, thereby changing the internal pressure of the tank means (T) and transporting the refrigerant.

In accordance with the fourth solution, the refrigerant in the tank means (T) is directly heated and cooled by the pressure regulating means (18), thereby changing the internal pressure of the tank means (T) in this manner. Thus, the internal pressure of the tank means (T) can be changed with a mechanism having a relatively small heat loss and the efficiency of refrigerant transport can be improved.

In the fifth solution provided by the present invention, the fourth solution is modified such that the pressure regulating means (18) is constituted by heat exchange means (18*b*), which is adjacent to the tank means (T) and switchably performs a heating operation of applying heat to the refrigerant of the tank means (T) and a cooling operation of extracting heat from the refrigerant of the tank means (T), as shown in FIG. 4.

In the sixth solution provided by the present invention, the fourth solution is modified such that the pressure regulating means (18) includes a refrigerant circuit (D) including: a compressor (D1); a first heat exchanger (D3); a pressure reducing mechanism (D4); a second heat exchanger (D5); and selector means (D2) for alternately switching connection states of the first heat exchanger (D3) and the second heat exchanger (D5) to an outlet side of the compressor (D1), as shown in FIG. 5. And, the first heat exchanger (D3) exchanges heat with the tank means (T) and heats and cools the refrigerant in the tank means (T) in accordance with a switching operation of the selector means (D2).

In accordance with the fifth and the sixth solutions, specific arrangements can be obtained for the pressure regulating means.

Thus, in accordance with the fifth and the sixth solutions, since the arrangements of the pressure regulating means are specified, the practicality of the system itself can be improved. In addition, since the internal pressure of the tank means (T) can be regulated accurately, the reliability of the running operation can also be improved.

In the seventh solution provided by the present invention, the first, second or third solution is modified such that the pressure regulating means (18) includes pressure generating means (18*a*, 18*c*, 19*c*) coupled to the tank means (T) through a pressure pipe (19), applies a high pressure from the pressure generating means (18*a*, 18*c*, 19*c*) to the inside of the tank means (T) during a pressurizing operation, and applies a low pressure from the pressure generating means (18*a*, 18*c*, 19*c*) to the inside of the tank means (T) during a pressure reducing operation as shown in FIGS. 2, 3 and 6.

In accordance with the seventh solution, the pressure generating means (18*a*, 18*c*, 19*c*), which is a source of generating pressure to be applied to the tank means (T), is coupled to the tank means (T) through a pressure pipe (19). Thus, the pressure generation source need not be disposed in proximity of the tank means (T), and the flexibility of the installation positions can be improved.

In the eighth solution provided by the present invention, the seventh solution is modified such that the pressure generating means functions as a reservoir container (18*a*) in which a liquid refrigerant is reservable, as shown in FIG. 2. The pressure regulating means (18) applies heat to the liquid refrigerant in the reservoir container (18*a*) so as to evaporate the liquid refrigerant and to raise an internal pressure of the reservoir container (18*a*) during a pressurizing operation, and extracts heat from a gaseous refrigerant in the reservoir container (18*a*) so as to condense the gaseous refrigerant and to lower the internal pressure of the reservoir container (18*a*) during a pressure reducing operation.

On the other hand, in the ninth solution provided by the present invention, the seventh solution is modified such that the pressure generating means functions as a compressor (18*c*) as shown in FIG. 3. A connection state of the pressure pipe (19) to the compressor (18*c*) is switched to an outlet side and an inlet side of the compressor (18*c*) by selector means (I). And the pressure regulating means (18) connects the pressure pipe (19) to the outlet side of the compressor (18*c*) during a pressurizing operation and connects the pressure pipe (19) to the inlet side of the compressor (18*c*) during a pressure reducing operation in accordance with a switching operation of the selector means (I).

Moreover, in the tenth solution provided by the present invention, the seventh solution is modified such that the pressure generating means functions as a heat exchanger (19*c*) in which a refrigerant is reservable as shown in FIG. 6. The pressure regulating means (18) applies heat to the refrigerant in the heat exchanger (19*c*) so as to raise an internal pressure of the heat exchanger (19*c*) during a pressurizing operation and extracts heat from the refrigerant in the heat exchanger (19*c*) so as to lower the internal pressure of the heat exchanger (19*c*) during a pressure reducing operation.

Furthermore, in the eleventh solution provided by the present invention, the tenth solution is modified such that the pressure regulating means (18) includes a refrigerant circuit (D) including: a compressor (D1); a first heat exchanger (D3); a pressure reducing mechanism (D4); a second heat exchanger (D5); and selector means (D2) for alternately switching connection states of the first heat exchanger (D3) and the second heat exchanger (D5) to an outlet side of the compressor (D1) as shown in FIG. 6. And, the first heat exchanger (D3) exchanges heat with the heat exchanger (19*c*) and heats and cools the refrigerant of the heat exchanger (19*c*) in accordance with a switching operation of the selector means (D2).

In the eighth to the eleventh solutions, specific arrangements can be obtained for the pressure generating means (18*a*, 18*c*, 19*c*) to be a pressure generation source for performing a pressurizing operation and a pressure reducing operation with respect to the tank means (T).

In accordance with the eighth to the eleventh solutions, the arrangements of the pressure generating means (18*a*, 18*c*, 19*c*) can be specified. Thus, the practicality of the system itself can be improved.

In the twelfth solution provided by the present invention, the second solution is modified such that the refrigerant control means (H) is constituted by: a first solenoid valve (SV-A), which is provided between a connecting point of the tank means (T) to the liquid pipe (7) and the heat exchange means (1) on the heat source side, closes during the pressurizing operation of the pressure regulating means (18) and opens during the pressure reducing operation thereof; and a second solenoid valve (SV-B), which is provided between the connecting point of the tank means (T) to the liquid pipe (7) and the heat exchange means (3) on the application side, opens during the pressurizing operation of the pressure regulating means (18) and closes during the pressure reducing operation thereof, as shown in FIG. 8.

On the other hand, in the thirteenth solution provided by the present invention, the third solution is modified such that the refrigerant control means (H) is constituted by: a first solenoid valve (SV-A), which is provided between a connecting point of the tank means (T) to the liquid pipe (7) and the heat exchange means (1) on the heat source side, opens during the pressurizing operation of the pressure regulating means (18) and closes during the pressure reducing operation thereof; and a second solenoid valve (SV-B), which is provided between the connecting point of the tank means (T) to the liquid pipe (7) and the heat exchange means (3) on the application side, closes during the pressurizing operation of the pressure regulating means (18) and opens during the pressure reducing operation thereof, as shown in FIG. 8.

Moreover, in the fourteenth solution provided by the present invention, the second solution is modified such that the refrigerant control means (H) is constituted by: a first check valve (CV1), which is provided between a connecting point of the tank means (T) to the liquid pipe (7) and the heat exchange means (1) on the heat source side and allows only the liquid refrigerant to flow from the heat exchange means (1) on the heat source side to the tank means (T); and a second check valve (CV2), which is provided between the connecting point of the tank means (T) to the liquid pipe (7) and the heat exchange means (3) on the application side and allows only the liquid refrigerant to flow from the tank means (T) to the heat exchange means (3) on the application side, as shown in FIG. 1.

Furthermore, in the fifteenth solution provided by the present invention, the third solution is modified such that the refrigerant control means (H) is constituted by: a first check valve (CV3), which is provided between a connecting point of the tank means (T) to the liquid pipe (7) and the heat exchange means (1) on the heat source side and allows only the liquid refrigerant to flow from the tank means (T) to the heat exchange means (1) on the heat source side; and a second check valve (CV4), which is provided between the connecting point of the tank means (T) to the liquid pipe (7) and the heat exchange means (3) on the application side and allows only the liquid refrigerant to flow from the heat exchange means (3) on the application side to the tank means (T), as shown in FIG. 7.

In the twelfth to the fifteenth solutions, specific arrangements can be obtained for the refrigerant control means (H).

In accordance with the twelfth to the fifteenth solutions, since specific arrangements can be obtained for the refrigerant control means (H), the refrigerant circulation direction can be accurately set in order to make the heat exchange means (3) on the application side perform heat absorption or radiation running. This also makes it possible to improve the reliability of the running operation and the practicality.

In the sixteenth solution provided by the present invention, by providing a plurality of tank means (T1, T2), the heat radiation or absorption running of the heat exchange means (3) on the application side can be performed continuously.

Specifically, as shown in FIGS. 10, 12, etc., first, a refrigerant circuit (B), constituted such that heat exchange means (1) on a heat source side is connected to heat exchange means (3) on an application side through a gas pipe (6) and a liquid pipe (7) so as to circulate a refrigerant therein and that the heat exchange means (1) on the heat source side exchanges heat with heat source means (A), is provided.

And, at least one first tank means (T1) and at least one second tank means (T2), which are connected in parallel to the liquid pipe (7) and reserve a liquid refrigerant therein, are also provided.

Moreover, pressure regulating means (18) for alternately switching a first pressure state, in which an internal pressure of the first tank means (T1) is raised and an internal pressure of the second tank means (T2) is lowered, and a second pressure state, in which the internal pressure of the first tank means (T1) is lowered and the internal pressure of the second tank means (T2) is raised, is further provided.

In addition, refrigerant control means (H) is further provided for supplying the liquid refrigerant from the first tank means (T1) to any of the heat exchange means to be an evaporator and recovering the liquid refrigerant from any of the heat exchange means to be a condenser to the second tank means (T2) during the first pressure state of the pressure regulating means (18), and for supplying the liquid refrigerant from the second tank means (T2) to any of the heat exchange means to be an evaporator and recovering the liquid refrigerant from any of the heat exchange means to be a condenser to the first tank means (T1) during the second pressure state of the pressure regulating means (18), thereby circulating the refrigerant of the refrigerant circuit (B) and making the heat exchange means (3) on the application side continuously absorb or radiate heat.

In the sixteenth solution, by making the refrigerant control means (H) prevent the refrigerant from flowing while alternately switching the first pressure state and the second pressure state of the pressure regulating means (18), tank means supplying the liquid refrigerant to one heat exchange means and tank means recovering the refrigerant from the other heat exchange means are alternately switched. Thus, the heat absorption or radiation running of the heat exchange means (3) on the application side is performed continuously.

In accordance with the sixteenth solution, an operation of applying a high pressure to the first tank means (T1) and a low pressure to the second tank means (T2) and an operation of applying a high pressure to the second tank means (T2) and a low pressure to the first tank means (T1) are alternately performed. Thus, since the heat absorption or radiation running of the heat exchange means (3) on the application side can be performed continuously, performance and practicality of the entire system can be improved.

In addition, in this solution as in the first solution described above, special transport means for circulating the refrigerant between the heat exchange means (1) on the heat source side and the heat exchange means (3) on the application side is not necessary, either. As a result, the power consumption and the number of parts having such factors as to cause a failure can be reduced and the reliability of the entire system can be ensured.

Moreover, since the restriction on the installation positions of the units can be alleviated, the universality can be improved.

In the seventeenth solution provided by the present invention, the sixteenth solution is modified such that, firstly, the heat exchange means (3) on the application side functions as an evaporator for absorbing heat as shown in FIG. 12. And, the refrigerant control means (H) switches refrigerant flow states in the liquid pipe (7) so as to supply the liquid refrigerant from the first tank means (T1) to the heat exchange means (3) on the application side and recover the liquid refrigerant from the heat exchange means (1) on the heat source side to the second tank means (T2) during the first pressure state of the pressure regulating means (18), and so as to supply the liquid refrigerant from the second tank means (T2) to the heat exchange means (3) on the application side and recover the liquid refrigerant from the heat exchange means (1) on the heat source side to the first tank means (T1) during the second pressure state of the pressure regulating means (18).

In the seventeenth solution, a state where the liquid refrigerant is recovered from the heat exchange means (1) on the heat source side to the second tank means (T2) while the liquid refrigerant is supplied from the first tank means (T1) to the heat exchange means (3) on the application side, and a state where the liquid refrigerant is recovered from the heat exchange means (1) on the heat source side to the first tank means (T1) while the liquid refrigerant is supplied from the second tank means (T2) to the heat exchange means (3) on the application side are alternately established. As a result, the heat absorption running of the heat exchange means (3) on the application side is performed continuously.

On the other hand, in the eighteenth solution provided by the present invention, the sixteenth solution is modified such that, firstly, the heat exchange means (3) on the application side functions as a condenser for radiating heat as shown in FIG. 13. And the refrigerant control means (H) switches refrigerant flow states in the liquid pipe (7) so as to supply the liquid refrigerant from the first tank means (T1) to the heat exchange means (1) on the heat source side and recover the liquid refrigerant from the heat exchange means (3) on the application side to the second tank means (T2) during the first pressure state of the pressure regulating means (18), and so as to supply the liquid refrigerant from the second tank means (T2) to the heat exchange means (1) on the heat source side and recover the liquid refrigerant from the heat exchange means (3) on the application side to the first tank means (T1) during the second pressure state of the pressure regulating means (18).

In the eighteenth solution, a state where the liquid refrigerant is recovered from the heat exchange means (3) on the application side to the second tank means (T2) while the liquid refrigerant is supplied from the first tank means (T1) to the heat exchange means (1) on the heat source side, and a state where the liquid refrigerant is recovered from the heat exchange means (3) on the application side to the first tank means (T1) while the liquid refrigerant is supplied from the second tank means (T2) to the heat exchange means (1) on the heat source side are alternately established. As a result, the heat radiation running of the heat exchange means (3) on the application side is performed continuously.

Thus, in accordance with the seventeenth solution, by alternately switching the pressure application states onto the respective tank means (T1, T2), the heat absorption running of the heat exchange means (3) on the application side can be performed continuously. On the other hand, in accordance with the eighteenth solution, by alternately switching the pressure application states onto the respective tank means (T1, T2) in a similar manner, the heat radiation running of the heat exchange means (3) on the application side can be performed continuously. Accordingly, when the air is conditioned by cooling or heating the indoor air while disposing the heat exchange means (3) on the application side indoors, the air condition in the room can always be kept satisfactory.

Moreover, in the nineteenth solution provided by the present invention, the sixteenth, seventeenth or eighteenth solution is modified such the pressure regulating means (18) includes pressure generating means (18A, 18B, D1, E1, E2) coupled to the respective tank means (T1, T2) through pressure pipes (19*d*, 19*e*), makes the pressure generating means (18A, 18B, D1, E1, E2) apply a high pressure to the inside of the first tank means (T1) and a low pressure to the inside of the second tank means (T2) during the first pressure state and makes the pressure generating means (18A, 18B, D1, E1, E2) apply a high pressure to the inside of the second tank means (T2) and a low pressure to the inside of the first tank means (T1) during the second pressure state, as shown in FIGS. 10 to 12.

Thus, in accordance with the nineteenth solution, as for a unit for making the heat exchange means (3) on the application side perform heat absorption or radiation running continuously, the generation source of the pressure to be applied onto the respective tank means (T1, T2) need not be disposed in the proximity of the respective tank means (T1, T2) in the same way as in the seventh solution described above. As a result, the flexibility in installation positions can be improved.

In the twentieth solution provided by the present invention, the nineteenth solution is modified such that the pressure generating means are constituted by a first reservoir container (18A) which is connected to the first tank means (T1) and in which a liquid refrigerant is reservable, and a second reservoir container (18B) which is connected to the second tank means (T2) and in which a liquid refrigerant is reservable, as shown in FIG. 10.

And the pressure regulating means (18) applies heat to the liquid refrigerant in the first reservoir container (18A) so as to evaporate the liquid refrigerant and to raise an internal pressure of the reservoir container (18A), and extracts heat from a gaseous refrigerant in the second reservoir container (18B) so as to condense the gaseous refrigerant and to lower the internal pressure of the reservoir container (18B) during the first pressure state. And the pressure regulating means (18) applies heat to the liquid refrigerant in the second reservoir container (18B) so as to evaporate the liquid refrigerant and to raise an internal pressure of the reservoir container (18B), and extracts heat from a gaseous refrigerant in the first reservoir container (18A) so as to condense the gaseous refrigerant and to lower the internal pressure of the reservoir container (18A) during the second pressure state.

On the other hand, in the twenty-first solution provided by the present invention, the nineteenth solution is modified such that, firstly, the pressure generating means is constituted by a compressor (D1) as shown in FIG. 11. And switching of connection states of the first tank means (T1) and the second tank means (T2) to the compressor (D1) is performed by making selector means (I) switch the pressure pipes (19*d*, 19*e*) to an outlet side and an inlet side of the compressor (D1).

In addition, the pressure regulating means (18) connects the outlet side of the compressor (D1) to the first tank means (T1) and the inlet side of the compressor (D1) to the second tank means (T2) during the first pressure state and connects the outlet side of the compressor (D1) to the second tank means (T2) and the inlet side of the compressor (D1) to the first tank means (T1) during the second pressure state.

Moreover, in the twenty-second solution provided by the present invention, the nineteenth solution is modified such that, firstly, the pressure generating means are constituted by a first heat exchanger (E1) which is connected to the first tank means (T1) and in which a refrigerant is reservable, and a second heat exchanger (E2) which is connected to the second tank means (T2) and in which a refrigerant is reservable, as shown in FIG. 12.

And, the pressure regulating means (18) applies heat to the refrigerant in the first heat exchanger (E1) so as to raise an internal pressure of the heat exchanger (E1) and extracts heat from the refrigerant in the second heat exchanger (E2) so as to lower the internal pressure of the heat exchanger (E2) during the first pressure state. And the pressure regulating means (18) applies heat to the refrigerant in the second heat exchanger (E2) so as to raise an internal pressure of the heat exchanger (E2) and extracts heat from the refrigerant in the first heat exchanger (E1) so as to lower the internal pressure of the heat exchanger (E1) during the second pressure state.

Furthermore, in the twenty-third solution provided by the present invention, the twenty-second solution is modified such that, firstly, the pressure regulating means (18) includes a refrigerant circuit (D) including: a compressor (D1); a first heat exchanger (D3); a pressure reducing mechanism (D4); a second heat exchanger (D5); and selector means (I) for alternately switching connection states of the first heat exchanger (D3) and the second heat exchanger (D5) to an outlet side of the compressor (D1) as shown in FIG. 12.

And, the first heat exchanger (D3) exchanges heat with the first heat exchanger (E1) connected to the first tank means (T1), the second heat exchanger (D5) exchanges heat with the second heat exchanger (E2) connected to the second tank means (T2), and the heat exchangers (E1, E2) are switched between the first pressure state and the second pressure state in accordance with a switching operation of the selector means (I).

Furthermore, in the twenty-fourth solution provided by the present invention, the nineteenth solution is modified such that, firstly, the pressure generating means is constituted by a pressurizing heat exchanger (E2) to be heated by a heating heat exchanger (D3) and a pressure reducing heat exchanger (E1) to be cooled by a cooling heat exchanger (D5), as shown in FIG. 16.

And, the pressure regulating means (18) connects the pressurizing heat exchanger (E2) to the first tank means (T1) and the pressure reducing heat exchanger (E1) to the second tank means (T2) during the first pressure state, and connects the pressurizing heat exchanger (E2) to the second tank means (T2) and the pressure reducing heat exchanger (E1) to the first tank means (T1) during the second pressure state.

Furthermore, in the twenty-fifth solution provided by the present invention, the twenty-fourth solution is modified such that the pressure regulating means (18) includes a refrigerant circuit (D) formed by connecting a compressor (D1), a heating heat exchanger (D3), a pressure reducing mechanism (D4) and a cooling heat exchanger (D5) in this order through a refrigerant pipe as shown in FIG. 16.

Thus, in accordance with the twentieth to the twenty-fifth solutions, specific arrangements can be obtained for the pressure generating means that can attain the effects of the nineteenth solution described above. As a result, the practicality can be further improved.

In the twenty-sixth solution provided by the present invention, the first solution is modified such the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T), as shown in FIG. 22.

And, the pressure reducing means (60) includes a circulating condenser (61), which is connected to the tank means (T) and which lowers the internal pressure of the tank means (T) by condensing the refrigerant. A condensing pressure of the circulating condenser (61) is set lower than a condensing pressure of the heat exchange means to be the condenser.

In the twenty-sixth solution, owing to the condensation of the refrigerant in the circulating condenser (61), a low pressure is built up inside the tank means (T). And, since this pressure is lower than the condensing pressure of the heat exchange means to be a condenser, the liquid refrigerant in the condenser is sucked into the tank means (T).

In accordance with the twenty-sixth solution, by condensing the refrigerant in the circulating condenser (61) of the pressure reducing means (60) connected to the tank means (T), a low pressure for recovering the liquid refrigerant from the condenser to the tank means (T) can be generated. Thus, in such a case, respective units can be disposed without receiving such restriction as disposing the tank means (T) at a position lower than that of the condenser.

In addition, the internal pressure of the tank means (T) can be changed only by switching the communication/non-communication states between the pressure reducing means (60) and the tank means (T). Thus, if a solenoid valve or the like is employed for a closed circuit formed by the pressure reducing means (60) and the tank means (T), the refrigerant circulation operation can be performed only by opening/closing the valve. As a result, high reliability is realized and the number of parts having such factors as to cause some failure can be reduced.

In the twenty-seventh solution provided by the present invention, the first solution is modified such that, firstly, the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T), as shown in FIG. 23.

And, the pressurizing means (50) includes a circulating evaporator (51), which is connected to the tank means (T) and which raises the internal pressure of the tank means (T) by evaporating the refrigerant. An evaporating pressure of the circulating evaporator (51) is set higher than an evaporating pressure of the heat exchange means to be the evaporator.

In the twenty-seventh solution, owing to the evaporation of the refrigerant in the circulating evaporator (51), a high pressure is built up inside the tank means (T). And, since this pressure is higher than the evaporating pressure of the heat exchange means to be an evaporator, the liquid refrigerant is supplied from the tank means (T) to the evaporator.

In accordance with the twenty-seventh solution, by evaporating the refrigerant in the circulating evaporator (51) of the pressurizing means (50) connected to the tank means (T), a high pressure for supplying the liquid refrigerant from the tank means (T) to the evaporator can be generated. Thus, in such a case, restriction on the installation positions of the tank means (T) and the evaporator can be eliminated.

In addition, according to this invention, the internal pressure of the tank means (T) can also be changed only by switching the communication/non-communication states between the pressurizing means (50) and the tank means (T). As a result, high reliability is realized and the number of parts having such factors as to cause some failure can be reduced.

In the twenty-eighth solution provided by the present invention, the twenty-seventh solution is modified such that, firstly, auxiliary tank means (ST) is provided above the circulating evaporator (51) as shown in FIG. 26. And selector means (I) is also provided for recovering the liquid refrigerant in the liquid pipe (7) to the auxiliary tank means (ST) by making the auxiliary tank means (ST) communicate with the pressure reducing means (60) and the liquid pipe (7) during the pressure reducing operation of the pressure reducing means (60) and for dripping and supplying the liquid refrigerant in the auxiliary tank means (ST) to the circulating evaporator (51) by making the auxiliary tank means (ST) communicate with the pressurizing means (50) during the pressurizing operation of the pressurizing means (50).

In the twenty-eighth solution, if the auxiliary tank means (ST) of a relatively small size is disposed above the circulating evaporator (51), the liquid refrigerant can be supplied to the circulating evaporator (51). Thus, it is possible to eliminate a situation where the circulation of a refrigerant is disabled by the exhaustion of the liquid refrigerant in the circulating evaporator (51).

In accordance with the twenty-eighth solution, the auxiliary tank means (ST) is provided above the circulating evaporator (51) and the liquid refrigerant to be supplied to the circulating evaporator (51) is temporarily reserved in the auxiliary tank means (ST). Thus, a sufficient amount of liquid refrigerant can be supplied to the circulating evaporator (51) without receiving any restriction on the installation positions of the tank means (T) and the circulating evaporator (51) in the vertical direction.

In the twenty-ninth solution provided by the present invention, the twenty-seventh solution is modified such that, firstly, at least one first auxiliary tank means (ST1) and at least one second auxiliary tank means (ST2) are provided above the circulating evaporator (51) as shown in FIG. 27. And, a selector means (I) is also provided for selecting a first selection state in which the liquid refrigerant in the liquid pipe (7) is recovered to the first auxiliary tank means (ST1) by making the first auxiliary tank means (ST1) communicate with the pressure reducing means (60) and the liquid pipe (7) and in which the liquid refrigerant in the second auxiliary tank means (ST2) is dripped and supplied to the circulating evaporator (51) by making the second auxiliary tank means (ST2) communicate with the pressurizing means (50) or a second selection state in which the liquid refrigerant in the liquid pipe (7) is recovered to the second auxiliary tank means (ST2) by making the second auxiliary tank means (ST2) communicate with the pressure reducing means (60) and the liquid pipe (7) and in which the liquid refrigerant in the first auxiliary tank means (ST1) is dripped and supplied to the circulating evaporator (51) by making the first auxiliary tank means (ST1) communicate with the pressurizing means (50).

In the twenty-ninth solution, a state where the liquid refrigerant is recovered into one auxiliary tank means and a state where the liquid refrigerant is supplied from the other tank means to the circulating evaporator (51) simultaneously established. Thus, the number of times by which the operations of recovering/supplying the liquid refrigerant are repeatedly performed on the respective auxiliary tank means (ST1, ST2) can be reduced.

In accordance with the twenty-ninth solution, a plurality of auxiliary tank means (ST1, ST2) are provided and the liquid refrigerant is recovered into one of the auxiliary tank means and is supplied from the other auxiliary tank means to the circulating evaporator. Thus, it is no longer necessary to switch the operations of the auxiliary tank means (ST1, ST2) in synchronism with the pressurizing/pressure reducing operations with respect to the tank means (T). Accordingly, the number of times by which the operations of recovering/supplying the liquid refrigerant are repeatedly performed on the respective auxiliary tank means (ST1, ST2) can be reduced, and the lifetimes thereof can be lengthened.

In the thirtieth solution provided by the present invention, the sixteenth solution is modified such that, firstly, the pressure regulating means (18) includes: pressurizing means (50) for performing a pressurizing operation of pushing the liquid refrigerant in one of the first tank means (T1) and the second tank means (T2) to the liquid pipe (7) by raising the internal pressure of the one tank means (T1 or T2); and pressure reducing means (60) for performing a pressure reducing operation of recovering the liquid refrigerant from the liquid pipe (7) to the other tank means (T2 or T1) by lowering the internal pressure of the other tank means (T2 or T1) as shown in FIG. 24.

And, the pressure reducing means (60) includes a circulating condenser (61), which is connected to the respective tank means (T1, T2) and which lowers the internal pressure of each said tank means (T1, T2) by condensing the refrigerant. A condensing pressure of the circulating condenser (61) is set lower than a condensing pressure of the heat exchange means to be the condenser.

Furthermore, the pressure regulating means (18) makes the pressurizing means (50) pressurize the first tank means (T1) and makes the pressure reducing means (60) reduce a pressure of the second tank means (T2) during a first pressure state. And the pressure regulating means (18) makes the pressurizing means (50) pressurize the second tank means (T2) and makes the pressure reducing means (60) reduce a pressure of the first tank means (T1) during a second pressure state.

In the thirtieth solution, the respective tank means (T1, T2) are not disposed at positions lower than that of the condenser and the liquid refrigerant is recovered from the condenser to the tank means (T1, T2) in a refrigerant circuit that can continuously perform the heat absorption or radiation running of the heat exchange means (3) on the application side.

Thus, in accordance the thirtieth solution, the liquid refrigerant can be recovered from the condenser to the tank means (T1, T2) and circulated, without receiving such restriction that the respective tank means (T1, T2) are disposed at positions lower than that of the condenser, in a refrigerant circuit that can continuously perform the heat absorption or radiation running of the heat exchange means (3) on the application side.

In the thirty-first solution provided by the present invention, the sixteenth solution is modified such that, firstly, the pressure regulating means (18) includes: pressurizing means (50) for performing a pressurizing operation of pushing the liquid refrigerant in one of the first tank means (T1) and the second tank means (T2) to the liquid pipe (7) by raising the internal pressure of the one tank means (T1 or T2); and pressure reducing means (60) for performing a pressure reducing operation of recovering the liquid refrigerant from the liquid pipe (7) to the other tank means (T2 or T1) by lowering the internal pressure of the other tank means (T2 or T1), as shown in FIG. 25.

And, the pressurizing means (50) includes a circulating evaporator (51), which is connected to the respective tank means (T1, T2) and which raises the internal pressure of each said tank means (T1, T2) by evaporating the refrigerant. An evaporating pressure of the circulating evaporator

(51) is set higher than an evaporating pressure of the heat exchange means to be the evaporator.

Furthermore, the pressure regulating means (18) makes the pressurizing means (50) pressurize the first tank means (T1) and makes the pressure reducing means (60) reduce a pressure of the second tank means (T2) during a first pressure state. And the pressure regulating means (18) makes the pressurizing means (50) pressurize the second tank means (T2) and makes the pressure reducing means (60) reduce a pressure of the first tank means (T1) during a second pressure state.

In the thirty-first solution, the liquid refrigerant is supplied from the tank means (T1, T2) to the evaporator without receiving any restriction on the installation positions of the respective tank means (T1, T2) with respect to the evaporator in a refrigerant circuit that can continuously perform the heat absorption or radiation running of the heat exchange means (3) on the application side.

Thus, in accordance the thirty-first solution, the liquid refrigerant can be supplied from the tank means (T1, T2) to the evaporator, without receiving any restriction on the installation positions of the respective tank means (T1, T2) with respect to the evaporator, in a refrigerant circuit that can continuously perform the heat absorption or radiation running of the heat exchange means (3) on the application side.

In the thirty-second solution provided by the present invention, the thirty-first solution is modified such that, firstly, at least one first auxiliary tank means (ST1) and at least one second auxiliary tank means (ST2) are provided above the circulating evaporator (51) as shown in FIGS. 30, 33, 36, etc.

And selector means (I) is also provided for selecting a first selection state in which the liquid refrigerant in the liquid pipe (7) is recovered to the first auxiliary tank means (ST1) by making the first auxiliary tank means (ST1) communicate with the pressure reducing means (60) and the liquid pipe (7) and in which the liquid refrigerant in the second auxiliary tank means (ST2) is dripped and supplied to the circulating evaporator (51) by making the second auxiliary tank means (ST2) communicate with the pressurizing means (50) or a second selection state in which the liquid refrigerant in the liquid pipe (7) is recovered to the second auxiliary tank means (ST2) by making the second auxiliary tank means (ST2) communicate with the pressure reducing means (60) and the liquid pipe (7) and in which the liquid refrigerant in the first auxiliary tank means (ST1) is dripped and supplied to the circulating evaporator (51) by making the first auxiliary tank means (ST1) communicate with the pressurizing means (50).

Thus, in accordance with the thirty-second solution, by providing a plurality of auxiliary tank means (ST1, ST2), the same effects as those attained by the twenty-ninth solution can be attained. Accordingly, in a refrigerant circuit that can continuously perform the heat absorption or radiation running of the heat exchange means (3) on the application side, the number of times by which the operations of recovering/supplying the liquid refrigerant are repeatedly performed on the respective auxiliary tank means (ST1, ST2) can be reduced, and the lifetimes thereof can be lengthened.

In the thirty-third solution provided by the present invention, the twenty-sixth or thirtieth solution is modified such that, firstly, the heat source means (A) includes first heat exchange means (12) for exchanging heat with the heat exchange means (1) on the heat source side and second heat exchange means (72) for exchanging heat with the circulating condenser (61) as shown in FIG. 22.

And, during the heat absorption running of the heat exchange means (3) on the application side, an evaporating temperature of the first heat exchange means (12) and an evaporating temperature of the second heat exchange means (72) are equal to each other but a ratio of a capacity of the circulating condenser (61) to a flow rate of the refrigerant flowing through the second heat exchange means (72) is set larger than a ratio of a capacity of the heat exchange means (1) on the heat source side to a flow rate of the refrigerant flowing through the first heat exchange means (12).

In accordance with the thirty-third solution, a specific arrangement for setting the condensing pressure of the circulating condenser (61) to be lower than the condensing pressure of the heat exchange means (1) on the heat source side to be the condenser can be obtained.

In the thirty-fourth solution provided by the present invention, the twenty-seventh or twenty-first solution is modified such that, firstly, the heat source means (A) includes first heat exchange means (12) for exchanging heat with the heat exchange means (1) on the heat source side and second heat exchange means (71) for exchanging heat with the circulating evaporator (51) as shown in FIG. 23.

And, during the heat radiation running of the heat exchange means (3) on the application side, a condensing temperature of the first heat exchange means (12) and a condensing temperature of the second heat exchange means (71) are equal to each other but a ratio of a capacity of the circulating evaporator (51) to a flow rate of the refrigerant flowing through the second heat exchange means (71) is set larger than a ratio of a capacity of the heat exchange means (1) on the heat source side to a flow rate of the refrigerant flowing through the first heat exchange means (12).

In accordance with the thirty-fourth solution, a specific arrangement for setting the evaporating pressure of the circulating evaporator (51) to be higher than the evaporating pressure of the heat exchange means (1) on the heat source side to be the evaporator can be obtained.

Thus, in accordance with the thirty-third solution, a specific arrangement for setting the condensing pressure of the circulating condenser (61) to be lower than the condensing pressure of the heat exchange means on the heat source side to be the condenser can be obtained. On the other hand, in accordance with the thirty-fourth solution, a specific arrangement for setting the evaporating pressure of the circulating evaporator (51) to be higher than the evaporating pressure of the heat exchange means on the heat source side to be the evaporator can be obtained. As a result, a predetermined pressure can be applied onto the tank means (T) with certainty and the reliability of the system can be improved.

In the thirty-fifth solution provided by the present invention, the twenty-sixth or the thirtieth solution is modified such that, firstly, the pressure reducing means (60) includes: a gas recovering pipe (62) for connecting an upper end of the tank means (T) to a gas side of the circulating condenser (61); and a liquid supplying pipe (63) for connecting a lower end of the tank means (T) to a liquid side of the circulating condenser (1) as shown in FIG. 23. And the liquid supplying pipe (63) is connected to the lower end of the tank means (T) independent of the liquid pipe (7).

In accordance with the thirty-fifth solution, the liquid supplying pipe (63) of the pressure reducing means (60) is connected to the lower end of the tank means (T) independent of the liquid pipe (7) and heat exchangers to be the circulating condenser (61) and the condenser are respectively connected to the tank means (T). Thus, the pipes (63, 7) can be provided with check valves having diameters respectively corresponding to the pipe diameters thereof. In particular, a check valve allowing for the reduction in pressure loss is applicable to the liquid supplying pipe (63). As a result, the refrigerant can be circulated smoothly in the pressure reducing means (60).

In the thirty-sixth solution provided by the present invention, the first or the sixteenth solution is modified such that, firstly, the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T) as shown in FIGS. 30 and 33.

And, the pressure reducing means (60) includes a circulating condenser (61), which is connected to the tank means (T) and which lowers the internal pressure of the tank means (T) by condensing the refrigerant. The pressurizing means (50) includes a circulating evaporator (51), which is connected to the tank means (T) and which raises the internal pressure of the tank means (T) by evaporating the refrigerant.

Furthermore, the heat source means (A) includes: first heat exchange means (12) for exchanging heat with the compressor (11) and the heat exchange means (1) on the heat source side; second heat exchange means (72) for exchanging heat with the circulating condenser (61); and third heat exchange means (71) for exchanging heat with the circulating evaporator (51). During the heat radiation running of the heat exchange means (3) on the application side, the heat source means (A) makes the third heat exchange means (71) exchange heat of the gaseous refrigerant discharged from the compressor (11) with the circulating evaporator (51) so as to change sensible heat of the refrigerant, makes the first heat exchange means (12) exchange the heat with the heat exchange means (1) on the heat source side so as to condense the refrigerant, and then makes the second heat exchange means (72) exchange the heat with the circulating condenser (61) so as to evaporate the refrigerant.

On the other hand, in the thirty-seventh solution provided by the present invention, the first or the sixteenth solution is modified such that, firstly, the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T) as shown in FIG. 36.

And, the pressure reducing means (60) includes a circulating condenser (61), which is connected to the tank means (T) and which lowers the internal pressure of the tank means (T) by condensing the refrigerant. The pressurizing means (50) includes a circulating evaporator (51), which is connected to the tank means (T) and which raises the internal pressure of the tank means (T) by evaporating the refrigerant.

Furthermore, the heat source means (A) includes: first heat exchange means (12) for exchanging heat with the compressor (11) and the heat exchange means (1) on the heat source side; second heat exchange means (72) for exchanging heat with the circulating condenser (61); and third heat exchange means (71) for exchanging heat with the circulating evaporator (51). During the heat radiation running of the heat exchange means (3) on the application side, the heat source means (A) distributes the gaseous refrigerant discharged from the compressor (11) to the third heat exchange means (71) and the first heat exchange means (12), makes the third heat exchange means (71) exchange heat with the circulating evaporator (51) so as to condense the refrigerant, makes the first heat exchange means (12) exchange heat with the heat exchange means (1) on the heat source side so as to condense the refrigerant, and then makes the second heat exchange means (72) exchange heat of the condensed refrigerant with the circulating condenser (61) so as to evaporate the refrigerant.

Thus, in accordance with the thirty-sixth and the thirty-seventh solutions, a refrigerant circuit applicable as heat source means (A) to a circuit for circulating a refrigerant by making the pressurizing means (50) and the pressure reducing means (60) pressurize/reduce the pressure of the tank means (T) can be obtained and the overall arrangement of the system can be specified.

BEST MODE FOR CARRYING OUT THE INVENTION

Hereinafter, embodiments of the present invention will be described with reference to the drawings. In each of the embodiments, two-system refrigerant circuitry including a primary refrigerant circuit and a secondary refrigerant circuit is provided. And, in each of the embodiments, the present invention is applied to refrigerant circuitry for an air conditioning system for conditioning the indoor air by exchanging heat between the primary refrigerant circuit and the secondary refrigerant circuit.

(First Embodiment)

Figure 1:
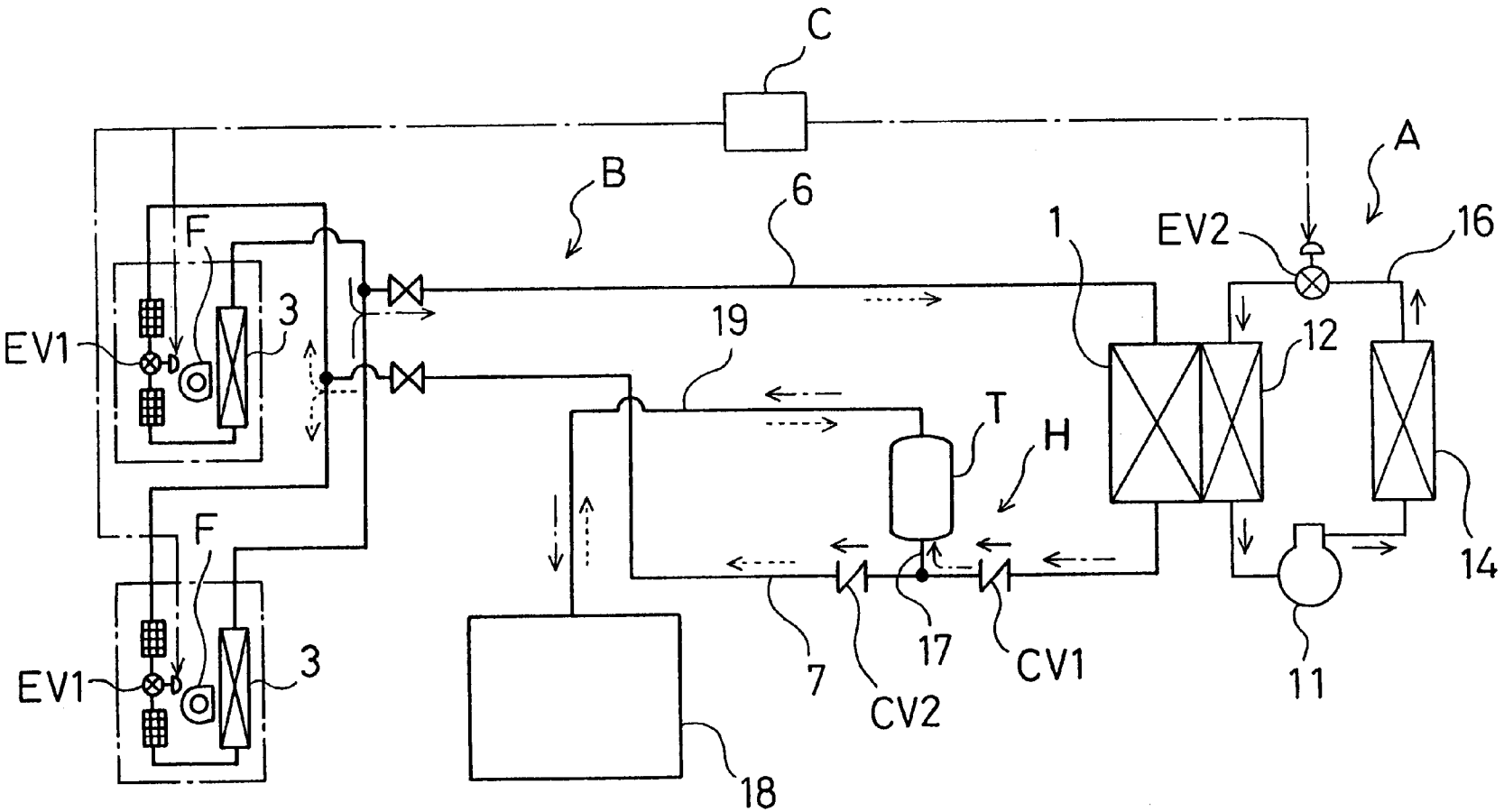
FIG. 1 is a diagram showing an overall arrangement of refrigerant circuitry in the first embodiment.

First, the first embodiment will be described with reference to FIG. 1.

In this embodiment, an air-conditioning system exclusively used for cooling is constructed and a primary refrigerant circuit (A) constitutes heat source means (A). And, FIG. 1 shows refrigerant circuitry as an entire heat transport system according to this embodiment.

First, a secondary refrigerant circuit (B) for cooling the indoor air by exchanging heat with the indoor air will be described.

The secondary refrigerant circuit (B) is constructed such that indoor heat exchangers (3, 3) disposed in a room to be air-conditioned as heat exchange means on the application side and a heat exchanger (1) on the secondary heat source side functioning as heat exchange means on the heat source side for applying/extracting heat with the primary refrigerant circuit (A) are connected through a gas pipe (6) and a liquid pipe (7), and is formed as a closed circuit in which a refrigerant can circulate. The indoor heat exchangers (3, 3) are connected in parallel to each other and indoor electrically motorized expansion valves (EV1, EV1) are provided for the liquid pipe (7) so as to correspond to the respective indoor heat exchangers (3, 3).

This embodiment is characterized in that a tank (T), in which a liquid refrigerant is reserved, is connected to the liquid pipe (7). A lower end of the tank (T) is connected to the liquid pipe (7) through a connecting pipe (17).

A first check valve (CV1) allowing only the liquid refrigerant to flow from the heat exchanger (1) on the secondary heat source side to the tank (T) is provided between the connecting point of the connecting pipe (17) to the liquid pipe (7) and the heat exchanger (1) on the secondary heat source side. In addition, a second check valve (CV2) allowing only the liquid refrigerant to flow from the tank (T) to the indoor heat exchangers (3, 3) is provided between the connecting point of the connecting pipe (17) to the liquid pipe (7) and the indoor heat exchangers (3, 3). Refrigerant control means (H) is constituted by these check valves (CV1, CV2).

Figure 2:
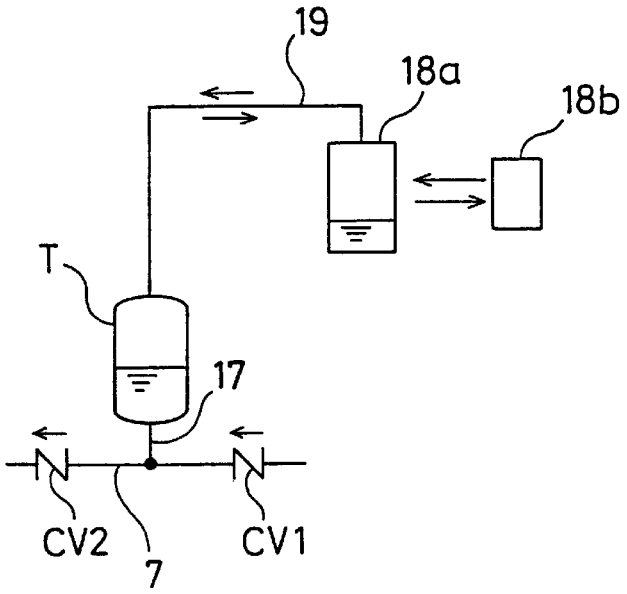
FIG. 2 is a diagram showing a pressurizing/pressure reducing mechanism.

A pressurizing/pressure-reducing mechanism (18) functioning as pressure regulating means is connected to an upper end of the tank (T) through a pressurizing/pressure-reducing pipe (19), which is a pressure pipe. The pressurizing/pressure-reducing mechanism (18) is constituted, for example, by a reservoir container **(18*a*) functioning as pressure generating means for reserving the liquid refrigerant therein and a heat exchange unit (18*b*) functioning as heat exchange means for heating or cooling the reservoir container (18*a*) as shown in FIG. 2. More specifically, if the reservoir container (18*a*) is heated by the heat exchange unit (18*b*), then the inner pressure is raised by the refrigerant evaporating in the reservoir container (18*a*). On the other hand, if the reservoir container (18*a*) is cooled by the heat exchange unit (18*b*), then the inner pressure is lowered by the refrigerant condensing in the reservoir container (18*a*)**.

Next, the primary refrigerant circuit (A) for exchanging heat with the secondary refrigerant circuit (B) will be described.

The primary refrigerant circuit (A) is constituted by connecting a compressor (11), an outdoor heat exchanger (14), an outdoor electrically motorized expansion valve (EV2) and a heat exchanger (12) on the primary heat source side in this order through a refrigerant pipe (16). The outlet side of compressor (11) is connected to the outdoor heat exchanger (14) and the inlet side thereof is connected to the heat exchanger (12) on the primary heat source side.

Moreover, the opening/closing states of the respective electrically motorized expansion valves (EV1, EV2) are controlled by a controller (C). In FIG. 1, (F) denotes an indoor fan.

Next, the room cooling running of the refrigerant circuits (A, B) having the above-described arrangements will be described.

When the cooling running is started, the compressor (11) is driven in the primary refrigerant circuit (A). As indicated by the solid-line arrows in FIG. 1, a high-temperature, high-pressure gaseous refrigerant discharged from the compressor (11) exchanges heat with the outdoor air and is condensed in the outdoor heat exchanger (14). Then, the pressure of the refrigerant is reduced in the outdoor electrically motorized expansion valve (EV2). In the heat exchanger (12) on the primary heat source side, the refrigerant exchanges heat with the heat exchanger (1) on the secondary heat source side, extracts heat from the refrigerant in the heat exchanger (1) on the secondary heat source side and is evaporated to be sucked into the compressor (11). This circulation operation is repeated.

On the other hand, in the secondary refrigerant circuit (B), the reservoir container (18*a*) of the pressurizing/pressure-reducing mechanism (18) is heated by the heat exchange unit (18*b*). As a result, the refrigerant is evaporated in the reservoir container (18*a*) and the internal pressure thereof rises. As indicated by the broken-line arrows in FIG. 1, the pressure is applied into the tank (T) through the pressurizing/pressure-reducing pipe (19) and pushes out the liquid refrigerant in the tank (T) to the liquid pipe (7) through the connecting pipe (17) while pushing down the water level of the liquid refrigerant. The pushed-out liquid refrigerant flows through the liquid pipe (7) toward the indoor heat exchangers (3, 3). The pressure of the liquid refrigerant is reduced in the indoor electrically motorized expansion valves (EV1, EV1). Then, in the respective indoor heat exchangers (3, 3), the liquid refrigerant exchanges heat with the indoor air and is evaporated, thereby cooling the indoor air. The gaseous refrigerant flows through the gas pipe (6) to the heat exchanger (1) on the secondary heat source side, and then exchanges heat with the heat exchanger (12) on the primary heat source side so as to be condensed.

If the reservoir container (18*a*) of the pressurizing/pressure-reducing mechanism (18) is cooled by the heat exchange unit (18*b*) after such an operation has been performed, the refrigerant is condensed in the reservoir container (18*a*) and the internal pressure thereof falls. As indicated by the one-dot-chain arrows in FIG. 1, the pressure is applied to the inside of the tank (T) through the pressurizing/pressure-reducing pipe (19), and the internal pressure of the tank (T) falls. As a result, the liquid refrigerant condensed in the heat exchanger (1) on the secondary heat source side is recovered into the tank (T) through the liquid pipe (7).

The pressurizing/pressure-reducing mechanism (18) repeatedly pressurizes/reduces the pressure of the tank (T) in the above-described manner. As a result, the liquid refrigerant is pushed out from the tank (T) during pressurizing, while the liquid refrigerant is recovered into the tank (T) during pressure reducing. Consequently, the refrigerant is circulated in the secondary refrigerant circuit (B), thereby cooling the indoor air.

Accordingly, the heat transport system of this embodiment can transport heat in the secondary refrigerant circuit (B) without providing any mechanical driving source such as a pump for the secondary refrigerant circuit (B). As a result, the power consumption can be reduced, the number of parts having such factors as to cause some failure can also be reduced, and reliability can be ensured for the entire system.

In addition, since the liquid refrigerant in the heat exchanger (1) on the secondary heat source side is recovered by utilizing the suction force generated in the tank (T), it is no longer necessary to dispose the tank (T) at a position lower than that of the heat exchanger (1) on the secondary heat source side. As a result, the restrictions on the positions where units are disposed can be alleviated, and the universality thereof can be improved.

Moreover, the refrigerant can be circulated stably in the secondary refrigerant circuit (B) by utilizing the pressure of the refrigerant. Thus, even when the secondary refrigerant circuit (B) is formed in a large size, the refrigerant can be circulated satisfactorily. As a result, the system can be enlarged and high reliability can be attained.

(Variants of Pressurizing/pressure-reducing Mechanism)

Next, variants of the pressurizing/pressure-reducing mechanism (18) applicable to the above-described secondary refrigerant circuit (B) will be described.

Figure 3:
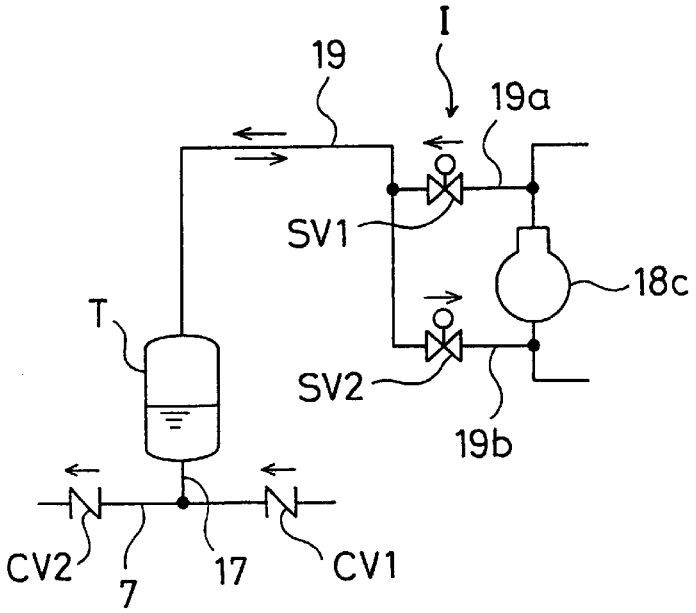
FIG. 3 is a diagram showing a first variant of the pressurizing/pressure reducing mechanism.

FIG. 3 shows a first variant. The pressurizing/pressure-reducing mechanism (18) includes a pressurizing/pressure-reducing compressor (18*c*). More specifically, the pressurizing/pressure-reducing pipe (19) is branched into two (first and second) branch pipes (19*a*, 19*b*). The first branch pipe (19*a*) is connected to the outlet side of the compressor (18*c*) and the second branch pipe (19*b*) is connected to the inlet side of the compressor (18*c*). A first and a second solenoid valve (SV1, SV2) are provided for the branch pipes (19*a*, 19*b*), respectively.

Selector means (I) is constituted by these branch pipes (19*a*, 19*b*) and the solenoid valves (SV1, SV2). It is noted that the compressor (11) of the primary refrigerant pipe (A) may also be used as the pressurizing/pressure-reducing compressor (18*c*).

In pushing out the liquid refrigerant from the tank (T) into the liquid pipe (7), the first solenoid valve (SV1) is opened and the second solenoid valve (SV2) is closed, thereby applying a high pressure into the tank (T). On the other hand, in recovering the liquid refrigerant into the tank (T) through the liquid pipe (7), the second solenoid valve (SV2) is opened and the first solenoid valve (SV1) is closed, thereby establishing a low-pressure state in the tank (T).

By repeatedly pressurizing and reducing the pressure of the tank (T), a state where the liquid refrigerant is pushed out from the tank (T) and a state where the liquid refrigerant is recovered into the tank (T) are alternately established in the same way as in the above-described embodiment. The indoor air is cooled while circulating the refrigerant in the secondary refrigerant circuit (B).

Figure 4:
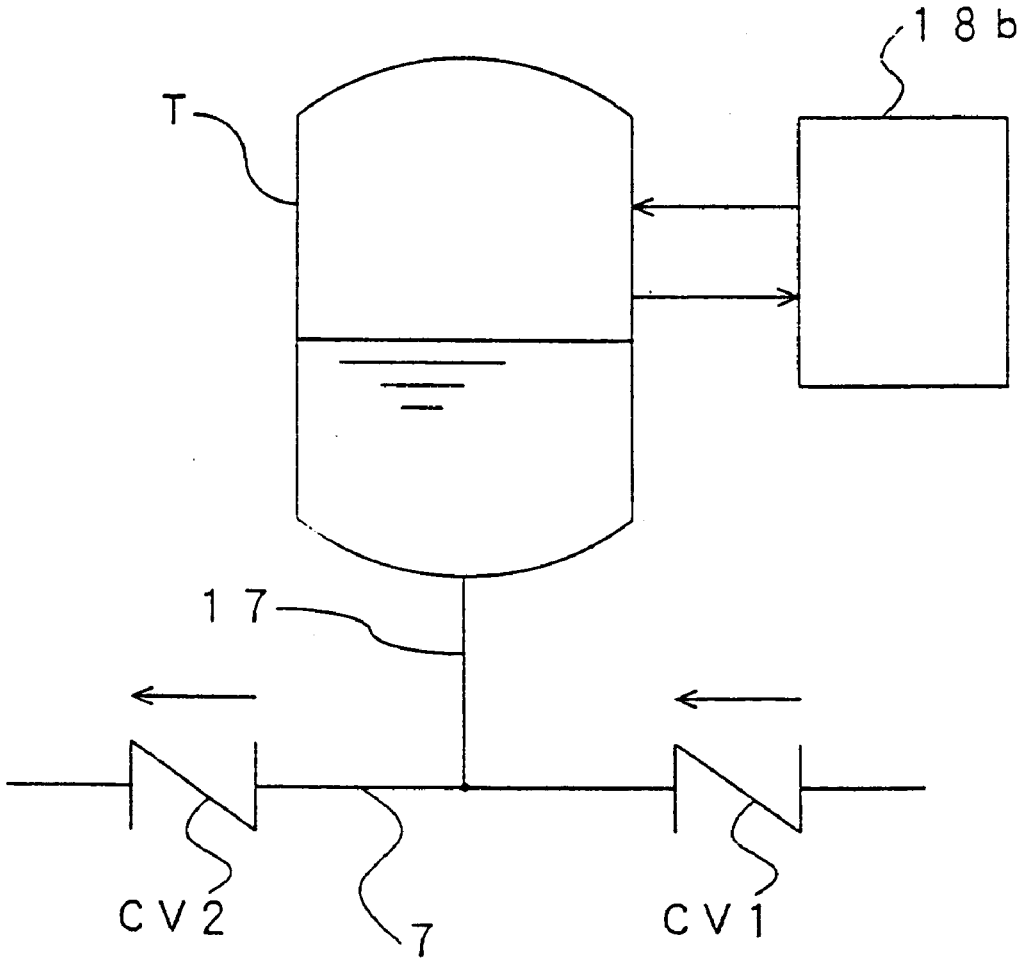
FIG. 4 is a diagram showing a second variant of the pressurizing/pressure reducing mechanism.

FIG. 4 shows a second variant of the pressurizing/pressure-reducing mechanism (18). The pressurizing/pressure-reducing mechanism (18) changes the internal pressure of the tank (T) by directly heating and cooling the tank (T).

Specifically, a similar heat exchange unit (18*b*) to that of the above-described embodiment is disposed adjacent to the tank (T). If the tank (T) is heated by the heat exchange unit (18*b*), the internal pressure of the tank is raised by the refrigerant evaporating in the tank (T). On the other hand, if the tank (T) is cooled, the internal pressure of the tank is lowered by the refrigerant condensing therein.

By repeatedly heating and cooling the tank (T), the indoor air is cooled while circulating the refrigerant in the secondary refrigerant circuit (B).

Figure 5:
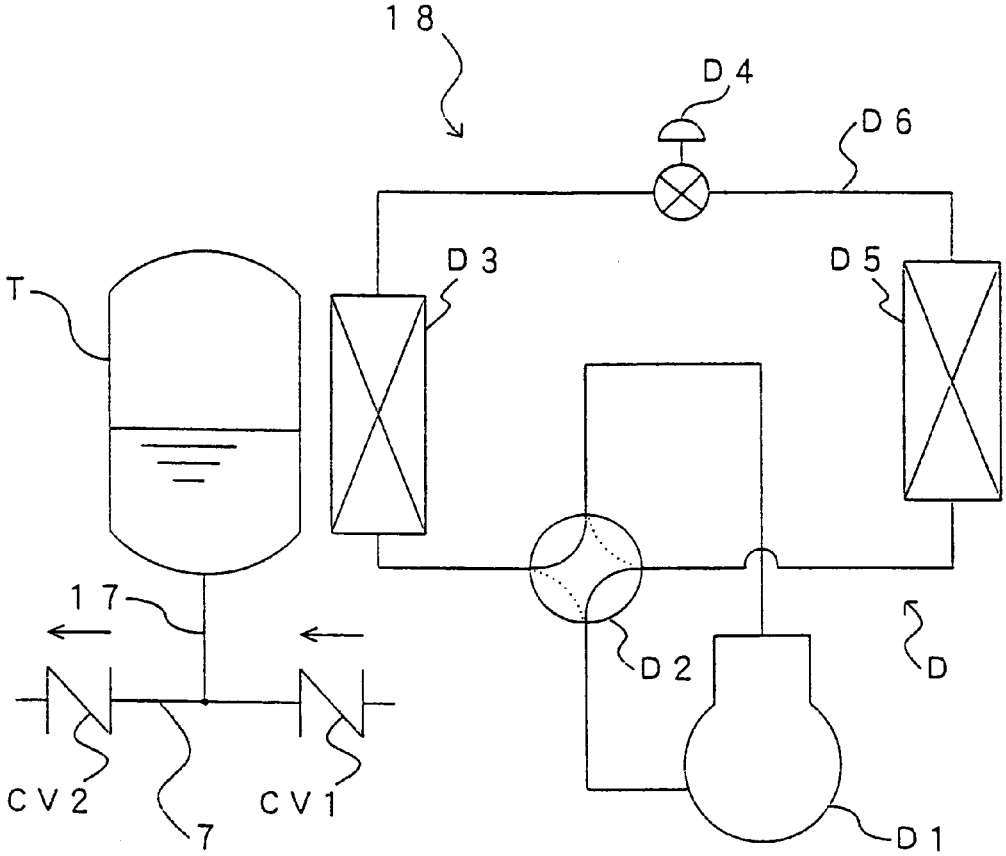
FIG. 5 is a diagram showing a third variant of the pressurizing/pressure reducing mechanism.

FIG. 5 shows a third variant of the pressurizing/pressure-reducing mechanism (18). The pressurizing/pressure-reducing mechanism (18) includes a pressurizing/pressure-reducing refrigerant circuit (D) for directly heating and cooling the tank (T).

The refrigerant circuit (D) is constructed by connecting a compressor (D1), a four-position selector valve (D2), a first heat exchanger (D3), an expansion valve (D4) and a second heat exchanger (D5) to each other through a refrigerant pipe (D6). The gas side of the first heat exchanger (D3) is switchably connected to the inlet side and the outlet side of the compressor (D1) through the four-position selector valve (D2). The first heat exchanger (D3) is disposed adjacent to the tank (T) and exchanges heat with the tank (T).

In pushing out the liquid refrigerant from the tank (T) to the liquid pipe (7), the four-position selector valve (D2) is switched to the direction indicated by the solid lines. The gaseous refrigerant discharged from the compressor (D1) flows through the first heat exchanger (D3) and is condensed while applying heat to the refrigerant in the tank (T). Thereafter, the pressure of the refrigerant is reduced in the expansion valve (D4). Then, the refrigerant is evaporated in the second heat exchanger (D5) so as to return to the compressor (D1). The refrigerant in the tank (T), which has received heat from the refrigerant in the first heat exchanger (D3), is evaporated and a high pressure is built up in the tank (T). Owing to the pressure, the liquid refrigerant is pushed out from the tank (T) to the liquid pipe (7).

Conversely, in recovering the liquid refrigerant into the tank (T) through the liquid pipe (7), the four-position selector valve (D2) is switched to the direction indicated by the broken lines. The gaseous refrigerant discharged from the compressor (D1) is condensed in the second heat exchanger (D5). Thereafter, the pressure of the refrigerant is reduced in the expansion valve (D4). Then, the refrigerant flows through the first heat exchanger (D3), extracts heat from the refrigerant in the tank (T) and is evaporated to return to the compressor (D1). The refrigerant in the tank (T), the heat of which has been extracted by the refrigerant in the first heat exchanger (D3), is condensed and a low pressure is built up in the tank (T). Owing to the pressure, the liquid refrigerant is recovered into the tank (T) through the liquid pipe (7).

By repeatedly heating and cooling the tank (T), the indoor air is cooled while circulating the refrigerant in the secondary refrigerant circuit (B).

Figure 6:
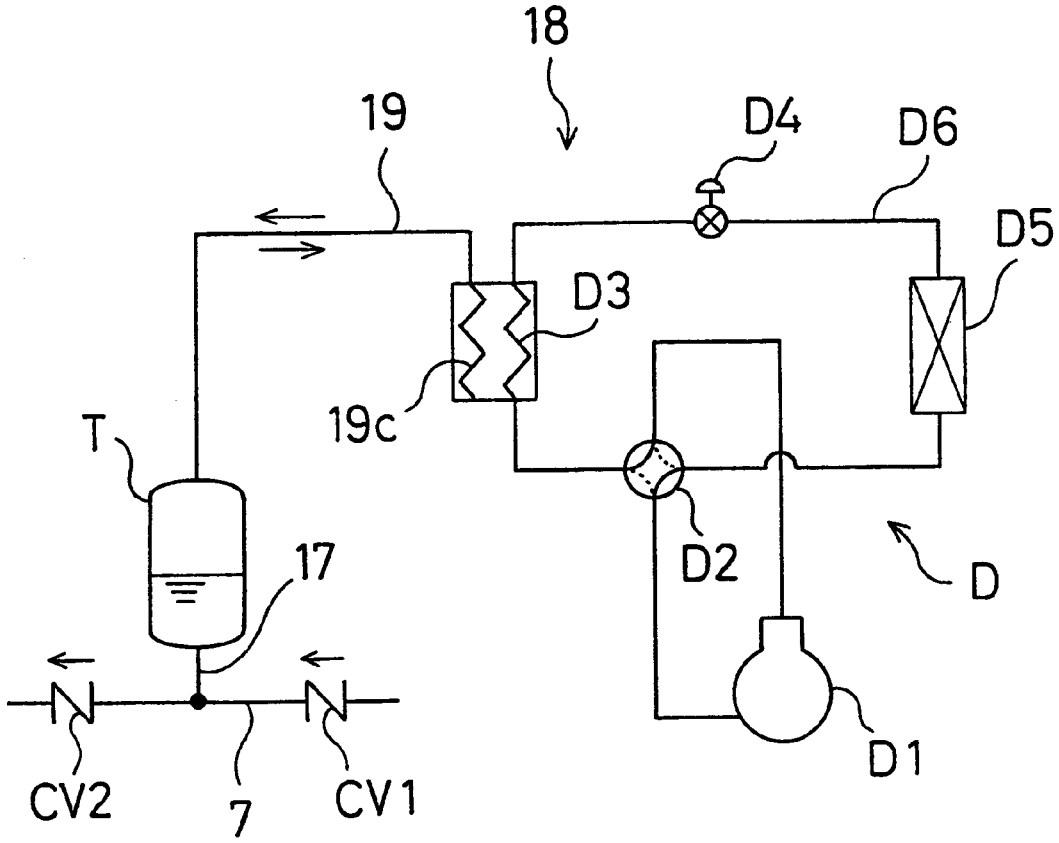
FIG. 6 is a diagram showing a fourth variant of the pressurizing/pressure reducing mechanism.

FIG. 6 shows a fourth variant of the pressurizing/pressure-reducing mechanism (18). The pressurizing/pressure-reducing mechanism (18) also includes the above-described pressurizing/pressure-reducing refrigerant circuit (D). A heat exchanger (19*c*) is connected to the pressurizing/pressure-reducing pipe (19) connected to the tank (T). Heat is exchanged between the heat exchanger (19*c*) and the first heat exchanger (D3) of the refrigerant circuit (D).

If the selection states of the four-position selector valve (D2) are alternately switched, then a high-pressure state and a low-pressure state are alternately switched in the heat exchanger (19*c*). As a result, the pressure of the heat exchanger (19*c*) is applied to the tank (T) and push-out of the liquid refrigerant from the tank (T) and recovery of the liquid refrigerant into the tank (T) are alternately performed.

By repeatedly pressurizing and reducing the pressure of the tank (T), the indoor air is cooled while circulating the refrigerant in the secondary refrigerant circuit (B).

(Second Embodiment)

Next, the second embodiment of the present invention will be described. It is noted that only the difference from the foregoing first embodiment will be described hereinafter.

The refrigerant circuitry of this embodiment constitutes an air conditioning system exclusively used for heating. The arrangement of a primary refrigerant circuit and check valves provided for the liquid pipe (7) are different from the counterparts of the first embodiment.

Figure 7:
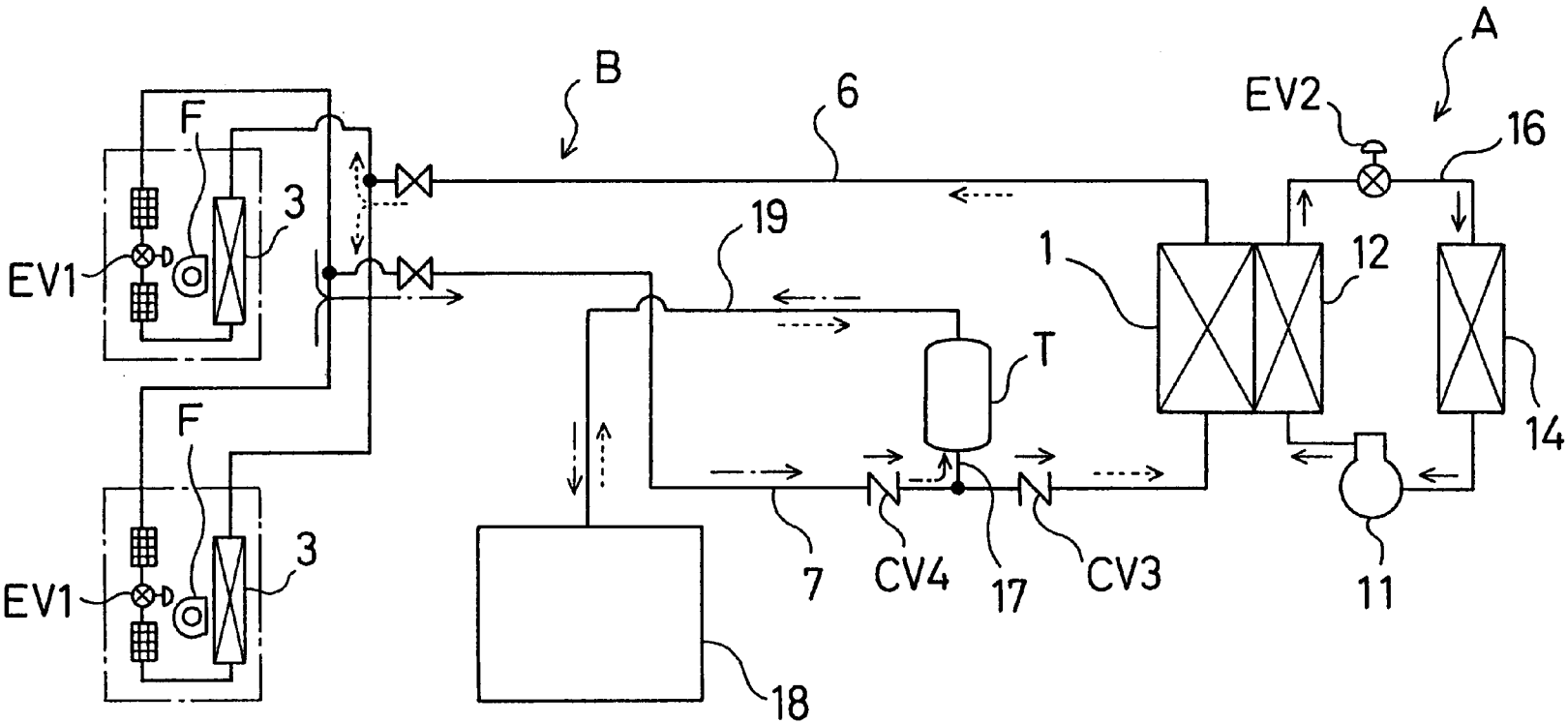
FIG. 7 is a diagram, corresponding to FIG. 1, in the second embodiment.

As shown in FIG. 7, the primary refrigerant circuit (A) is constituted by connecting a compressor (11), a heat exchanger (12) on the primary heat source side, an outdoor electrically motorized expansion valve (EV2) and an outdoor heat exchanger (14) in this order through a refrigerant pipe (16). The outlet side of compressor (11) is connected to the heat exchanger (12) on the primary heat source side and the inlet side thereof is connected to the outdoor heat exchanger (14).

On the other hand, a third check valve (CV3) and a fourth check valve (CV4) are provided for the secondary refrigerant circuit (B). The third check valve (CV3) is provided between a connecting point of the connecting pipe (17) to the liquid pipe (7) and the heat exchanger (1) on the secondary heat source side, and allows only the liquid refrigerant to flow from the tank (T) to the heat exchanger (1) on the secondary heat source side. The fourth check valve (CV4) is provided between the connecting point of the connecting pipe (17) to the liquid pipe (7) and the indoor heat exchangers (3, 3), and allows only the liquid refrigerant to flow from the indoor heat exchangers (3) to the tank (T).

It is noted that the pressurizing/pressure-reducing mechanism (18) of this embodiment is the same as that of the first embodiment described above.

Next, the room heating running of the refrigerant circuits (A, B) having the above-described arrangements will be described.

When the heating running is started, the compressor (11) is driven in the primary refrigerant circuit (A). As indicated by the solid-line arrows in FIG. 7, a high-temperature, high-pressure gaseous refrigerant discharged from the compressor (11) exchanges heat with the heat exchanger (1) on the secondary heat source side in the heat exchanger (12) on the primary heat source side. The refrigerant applies heat to the refrigerant in the heat exchanger (1) on the secondary heat source side and is condensed. Then, the pressure of the refrigerant is reduced in the outdoor electrically motorized expansion valve (EV2). In the outdoor heat exchanger (14), the refrigerant exchanges heat with the outdoor air and is evaporated to return to the compressor (11). This circulation operation is repeated.

On the other hand, in the secondary refrigerant circuit (B), the reservoir container (18*a*) of the pressurizing/pressure-reducing mechanism (18) is heated by the heat exchange unit (18*b*). As a result, the refrigerant in the reservoir container (18*a*) is evaporated and the internal pressure thereof rises (see FIG. 2). As indicated by the broken-line arrows in FIG. 7, the pressure is applied into the tank (T) through the pressurizing/pressure-reducing pipe (19) and pushes out the liquid refrigerant in the tank (T) to the liquid pipe (7) through the connecting pipe (17) while pushing down the water level of the liquid refrigerant. The pushed-out liquid refrigerant flows through the liquid pipe (7) toward the heat exchanger (1) on the secondary heat source side. In the heat exchanger (1) on the secondary heat source side, the liquid refrigerant exchanges heat with the refrigerant in the heat exchanger (12) on the primary heat source side and is evaporated. Thereafter, the refrigerant passes through the gas pipe (71) and exchanges heat with the indoor air in the indoor heat exchangers (3, 3). As a result, the refrigerant is condensed, thereby heating the indoor air.

If the reservoir container (18*a*) of the pressurizing/pressure-reducing mechanism (18) is cooled by the heat exchange unit (18*b*) after such an operation has been performed, the refrigerant is condensed in the reservoir container (18*a*) and the internal pressure thereof falls. As indicated by the one-dot-chain arrows in FIG. 7, the pressure is applied to the tank (T) through the pressurizing/pressure-reducing pipe (19), and the internal pressure of the tank (T) falls. As a result, the liquid refrigerant condensed in the indoor heat exchangers (3) is recovered into the tank (T) through the liquid pipe (7).

The pressurizing/pressure-reducing mechanism (18) repeatedly pressurizes/reduces the pressure of the tank (T). As a result, the refrigerant is circulated in the secondary refrigerant circuit (B), thereby heating the indoor air. Accordingly, the heat transport system of this embodiment can also transport heat in the secondary refrigerant circuit (B) without providing any driving source such as a pump for the secondary refrigerant circuit (B).

In addition, the arrangements shown in the above-described respective variants are also applicable to the pressurizing/pressure-reducing mechanism (18) of the refrigerant circuitry exclusively used for heating in the second embodiment.

Figure 8:
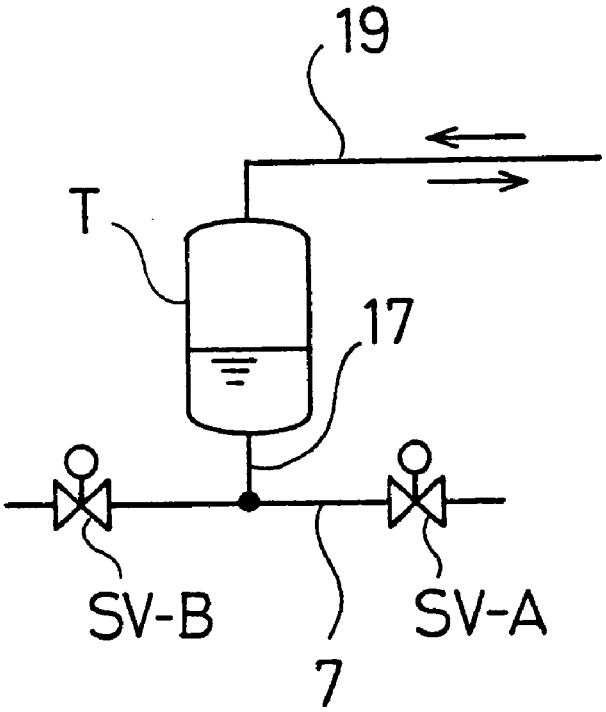
FIG. 8 is a diagram showing a variant of refrigerant flow control means.

It is noted that an arrangement, in which freely opening/closing solenoid valves (SV1-A, SV-B) such as those shown in FIG. 8 are provided, instead of the check valves (CV1 to CV4), for the liquid pipe (7) in the first and the second embodiments and in which the opening/closing states of the respective solenoid valves (SV1-A, SV-B) are switched in accordance with the states of the pressure applied from the pressurizing/pressure-reducing mechanism (18), may also be employed.

(Third Embodiment)

Next, the third embodiment of the present invention will be described. It is noted that only the difference from the foregoing second embodiment will be described hereinafter.

The refrigerant circuitry of this embodiment constitutes an air conditioning system of a so-called "heat pump type" which selectively cool or heat the indoor air.

Figure 9:
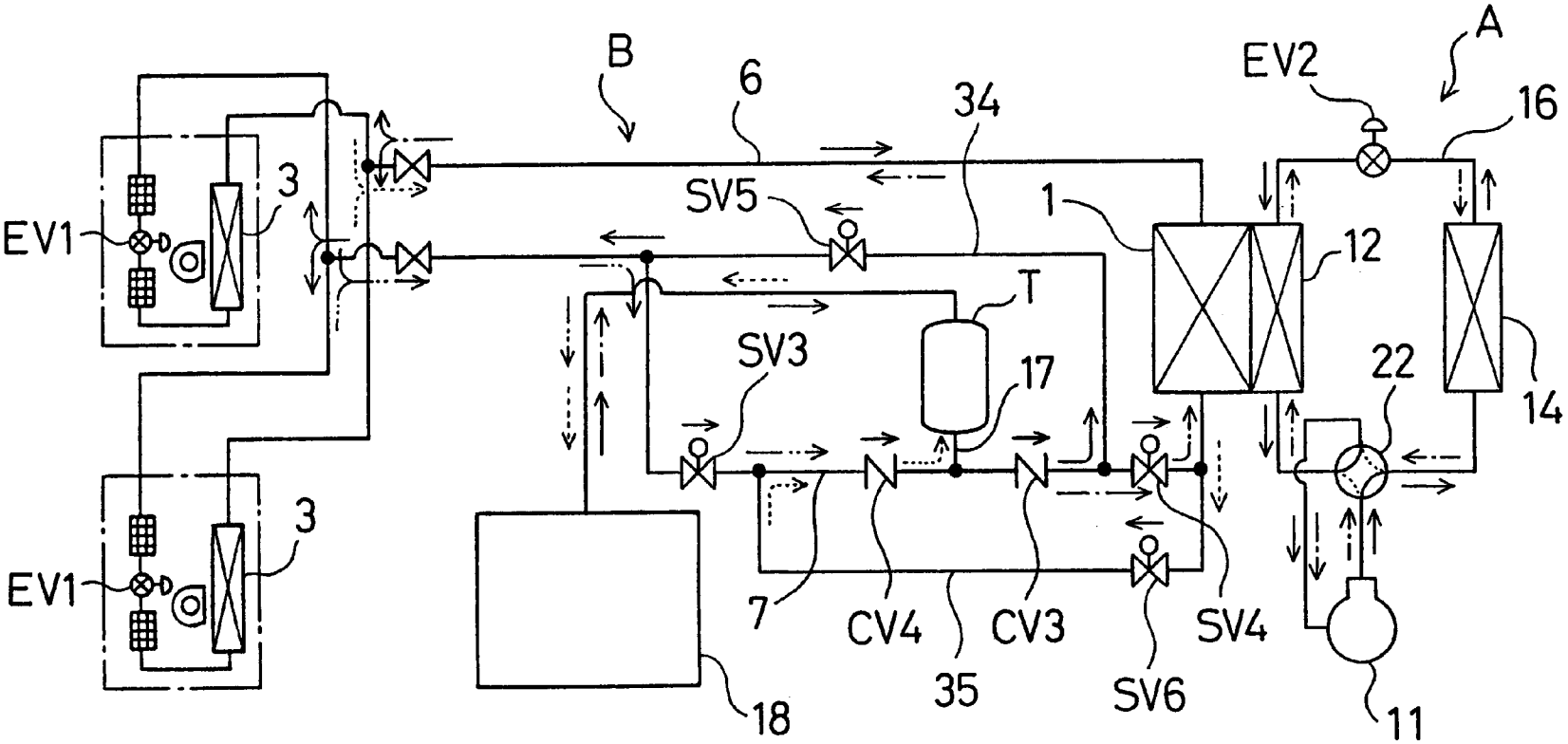
FIG. 9 is a diagram, corresponding to FIG. 1, in the third embodiment.

Specifically, as shown in FIG. 9, the secondary refrigerant circuit (B) is provided with a third solenoid valve (SV3) and a fourth solenoid valve (SV4). The third solenoid valve (SV3) is provided between the fourth check valve (CV4) of the liquid pipe (7) and the indoor heat exchangers (3, 3), opens during the room heating running and closes during the cooling running. The fourth solenoid valve (SV4) is provided between the third check valve (CV3) of the liquid pipe (7) and the heat exchanger (1) on the secondary heat source side, opens during the room heating running and closes during the cooling running.

One end of a cooling liquid pipe (34) on the supply side is connected between the third solenoid valve (SV3) of the liquid pipe (7) and the indoor heat exchangers (3, 3). And the other end of the cooling liquid pipe (34) on the supply side is connected between the third check valve (CV3) and the fourth solenoid valve (SV4) of the liquid pipe (7). A fifth solenoid valve (SV5) opening during the cooling running and closing during the heating running is provided for the cooling liquid pipe (34) on the supply side.

One end of a cooling liquid pipe (35) on the recovery side is connected between the fourth check valve (CV4) and the third solenoid valve (SV3) of the liquid pipe (7). And the other end of the cooling liquid pipe (35) on the recovery side is connected between the fourth solenoid valve (SV4) of the liquid pipe (7) and the heat exchanger (1) on the secondary heat source side. A sixth solenoid valve (SV6) opening during the cooling running and closing during the heating running is provided for the cooling liquid pipe (35) on the recovery side.

On the other hand, the primary refrigerant circuit (A) makes the heat exchanger (12) on the primary heat source side heat/cool the heat exchanger (1) on the secondary heat source side. Specifically, a compressor (11), a four-position selector valve (22), an outdoor heat exchanger (14), an outdoor electrically motorized expansion valve (EV2) and the heat exchanger (12) on the primary heat source side are connected to each other through a refrigerant pipe (16). The gas side of the heat exchanger (12) on the primary heat source side is switched between the inlet side and the outlet side of the compressor (11) via the four-position selector valve (22).

Next, the room cooling and heating running will be described.

In the cooling running, first, the four-position selector valve (22) of the primary refrigerant circuit (A) is switched to the direction indicated by the solid lines, the fifth solenoid valve (SV5) and the sixth solenoid valve (SV6) are opened and the third solenoid valve (SV3) and the fourth solenoid valve (SV4) are closed in the secondary refrigerant circuit (B). In such a state, in the primary refrigerant circuit (A), as indicated by the solid-line arrows in FIG. 9, a high-temperature, high-pressure gaseous refrigerant discharged from the compressor (11) exchanges heat with the outdoor air and is condensed in the outdoor heat exchanger (14) in the same way as in the first embodiment. Then, the pressure of the refrigerant is reduced in the outdoor electrically motorized expansion valve (EV2). In the heat exchanger (12) on the primary heat source side, the refrigerant exchanges heat with the heat exchanger (1) on the secondary heat source side, extracts heat from the refrigerant in the heat exchanger (1) on the secondary heat source side and is evaporated to return to the compressor (11). This circulation operation is repeated.

On the other hand, in the secondary refrigerant circuit (B), when a high pressure is applied from the pressurizing/pressure-reducing mechanism (18) to the tank (T) through the pressurizing/pressure-reducing pipe (19) as indicated by the solid-line arrows in FIG. 9, the water level of the liquid refrigerant in the tank (T) is pushed down and the liquid refrigerant is pushed out to the liquid pipe (7) through the connecting pipe (17). The pushed-out liquid refrigerant flows through the liquid pipe (7) and the cooling liquid pipe (34) on the supply side toward the indoor heat exchangers (3, 3). The pressure of the liquid refrigerant is reduced in the indoor electrically motorized expansion valves (EV1, EV1). Then, in the respective indoor heat exchangers (3, 3), the liquid refrigerant exchanges heat with the indoor air and is evaporated, thereby cooling the indoor air. Thereafter, the gaseous refrigerant flows through the gas pipe (6) toward the heat exchanger (1) on the secondary heat source side, exchanges heat with the heat exchanger (12) on the primary heat source side, and is condensed.

After this operation has been performed, a low pressure is applied from the pressurizing/pressure-reducing mechanism (18) to the tank (T). When the internal pressure of the tank (T) falls, the liquid refrigerant in the heat exchanger (1) on the secondary heat source side is recovered through the liquid pipe (7) and the cooling liquid pipe (35) on the recovery side to the tank (T) as indicated by the broken-line arrows in FIG. 9.

By repeatedly pressurizing and reducing the pressure of the tank (T) by the pressurizing/pressure-reducing mechanism (18), the refrigerant circulates in the secondary refrigerant circuit (B), thereby cooling the indoor air.

Next, the room heating running will be described.

In the heating running, first, the four-position selector valve (22) of the primary refrigerant circuit (A) is switched to the direction indicated by the broken lines, the third solenoid valve (SV3) and the fourth solenoid valve (SV4) are opened and the fifth solenoid valve (SV5) and the sixth solenoid valve (SV6) are closed in the secondary refrigerant circuit (B). In such a state, in the primary refrigerant circuit (A), as indicated by the one-dot-chain arrows in FIG. 9, a high-temperature, high-pressure gaseous refrigerant discharged from the compressor (11) exchanges heat with the heat exchanger (1) on the secondary heat source side in the heat exchanger (12) on the primary heat source side in the same way as in the second embodiment described above. The refrigerant is condensed while applying heat to the refrigerant in the heat exchanger (1) on the secondary heat source side. Thereafter, the pressure of the refrigerant is reduced in the outdoor electrically motorized expansion valve (EV2). Then, in the outdoor heat exchanger (14), the refrigerant exchanges heat with the outdoor air and is evaporated to returns to the compressor (11). This circulation operation is repeated.

On the other hand, in the secondary refrigerant circuit (B), when a high pressure is applied from the pressurizing/pressure-reducing mechanism (18) to the tank (T) through the pressurizing/pressure-reducing pipe (19) as indicated by the one-dot-chain arrows in FIG. 9, the water level of the liquid refrigerant in the tank (T) is pushed down and the liquid refrigerant is pushed out to the liquid pipe (7) through the connecting pipe (17). The pushed-out liquid refrigerant flows through the liquid pipe (7) toward the heat exchanger (1) on the secondary heat source side. Then, in the heat exchanger (1) on the secondary heat source side, the refrigerant exchanges heat with the refrigerant in the heat exchanger (12) on the primary heat source side and is evaporated. Thereafter, the refrigerant passes through the gas pipe (6), exchanges heat with the indoor air and is condensed in the respective indoor heat exchangers (3, 3), thereby heating the indoor air.

After this operation has been performed, a low pressure is applied from the pressurizing/pressure-reducing mechanism (18) to the tank (T). When the internal pressure of the tank (T) falls, the liquid refrigerant condensed in the indoor heat exchangers (3) is recovered through the liquid pipe (7) into the tank (T) as indicated by the two-dot-chain arrows in FIG. 9.

By repeatedly pressurizing and reducing the pressure of the tank (T) by the pressurizing/pressure-reducing mechanism (18), the refrigerant circulates in the secondary refrigerant circuit (B), thereby heating the indoor air.

(Fourth Embodiment)

Next, the fourth embodiment of the present invention will be described. It is noted that only the difference from the foregoing first embodiment will be described hereinafter.

The refrigerant circuitry of this embodiment modifies the secondary refrigerant circuit (B) so as to continuously perform indoor air conditioning running, and is applicable to the secondary refrigerant circuit (B) in any of the foregoing first to third embodiments.

Figure 10:
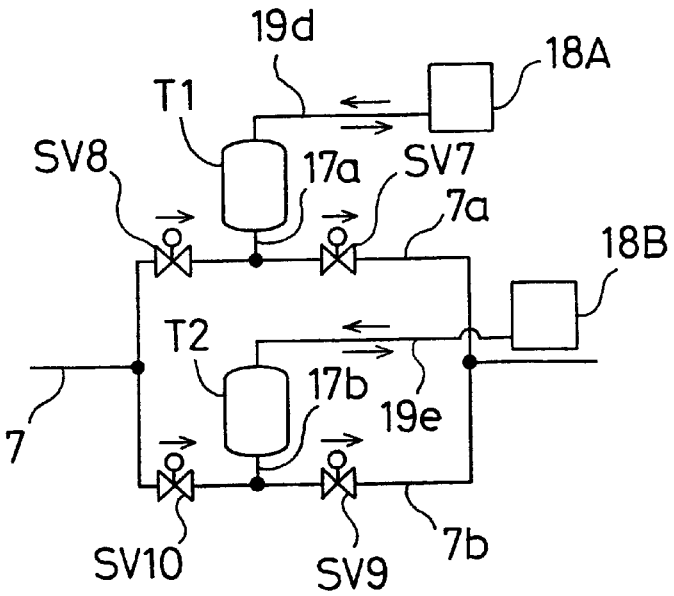
FIG. 10 is a diagram, corresponding to FIG. 2, in the fourth embodiment.

Specifically, as shown in FIG. 10, a part of the liquid pipe (7) is branched into a first and a second branch pipe (7*a*, 7*b*). A first and a second tank (T1, T2) are connected to the respective pipes through connecting pipes (17*a*, 17*b*), respectively. That is to say, the tanks (T1, T2) are connected in parallel to the liquid pipe (7).

A first and a second pressurizing/pressure-reducing mechanism (18A, 18B) are individually connected to the respective upper ends of the tanks (T1, T2) through pressurizing/pressure-reducing pipes (19*d*, 19*e*), respectively. In the pressurizing/pressure-reducing mechanisms (18A, 18B), while one pressurizing/pressure-reducing mechanism (18A) applies a high pressure to the tank (T1) connected thereto, the other pressurizing/pressure-reducing mechanism (18B) applies a low pressure to the tank (T2) connected thereto. Such high-pressure and low-pressure application states are alternately switched.

In addition, a pair of solenoid valves (SV7 and SV8, SV9 and SV10) to be switchably controlled in accordance with the states of the pressure applied from the associated pressurizing/pressure-reducing mechanism (18A, 18B) are provided on both sides of the connecting point of the connecting pipe (17*a*, 17*b*) to each branch pipe (7*a*, 7*b*).

Next, the air conditioning running operations will be described.

For example, during the room heating running, when the liquid refrigerant is pushed out from the first tank (T1) and is recovered to the second tank (T2), the solenoid valve (SV7) located closer to the heat exchanger (1) on the heat source side is opened and the solenoid valve (SV0) located closer to the indoor heat exchangers (3) is closed on the first branch pipe (7*a*). On the other hand, on the second branch pipe (7*b*), the solenoid valve (SV9) located closer to the heat exchanger (1) on the heat source side is closed and the solenoid valve (SV10) located closer to the indoor heat exchangers (3) is opened. In such a state, a high pressure is applied from the first pressurizing/pressure-reducing mechanism (18A) to the first tank (T1) and a low pressure is applied from the second pressurizing/pressure-reducing mechanism (18B) to the second tank (T2), thereby circulating the refrigerant in the secondary refrigerant circuit (B).

After such a running condition has lasted for a predetermined time and almost all the liquid refrigerant in the first tank (T1) has been drained, switching is performed to establish such a running condition that the liquid refrigerant is drained from the second tank (T2) and is recovered to the first tank (T1). During this running, the solenoid valve (SV7) located closer to the heat exchanger (1) on the heat source side is closed and the solenoid valve (SV8) located closer to the indoor heat exchangers (3) is opened on the first branch pipe (7*a*). On the other hand, on the second branch pipe (7*b*), the solenoid valve (SV9) located closer to the heat exchanger (1) on the heat source side is opened and the solenoid valve (SV10) located closer to the indoor heat exchangers (3) is closed. In such a state, a high pressure is applied from the second pressurizing/pressure-reducing mechanism (18B) to the second tank (T2) and a low pressure is applied from the first pressurizing/pressure-reducing mechanism (18A) to the first tank (T1), thereby circulating the refrigerant in the secondary refrigerant circuit (B).

The states of the pressures applied from the respective pressurizing/pressure-reducing mechanisms (18A, 18B) to the corresponding tanks (T1, T2) and the opening/closing states of the respective solenoid valves (SV7 to SV10) are alternately switched, thereby continuously performing the indoor air conditioning running. It is noted that the opening/closing states of the respective solenoid valves (SV7 to SV10) are inverted during the room cooling running.

(Variant of Pressurizing/Pressure-reducing Mechanism)

Figure 11:
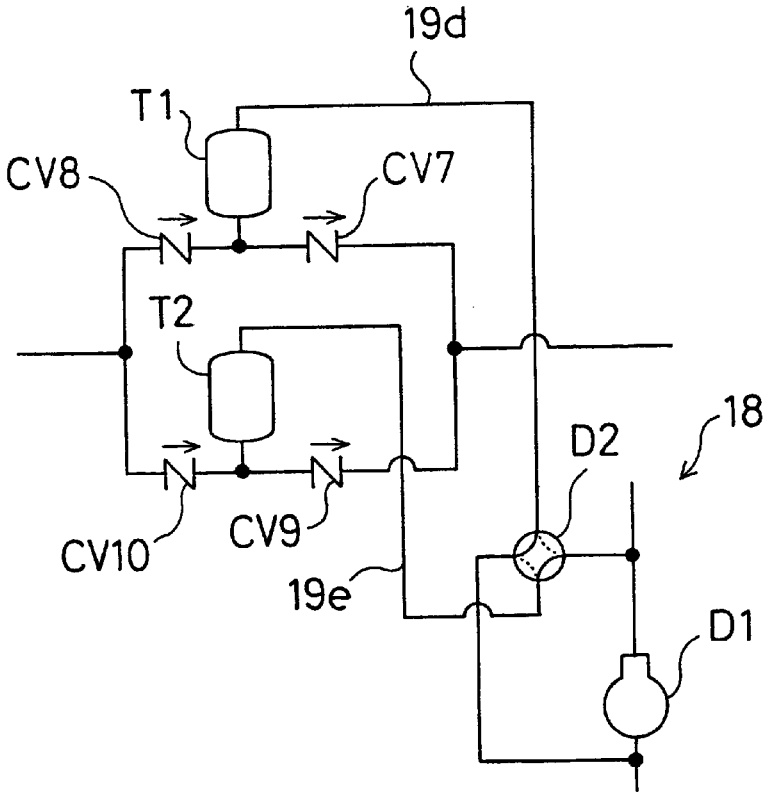
FIG. 11 is a diagram corresponding to FIG. 3 and showing a variant of the fourth embodiment.

Next, a variant of the pressurizing/pressure-reducing mechanism (18) applicable to the secondary refrigerant circuit (B) of the foregoing fourth embodiment will be described with reference to FIG. 11.

In this variant, a pressurizing/pressure-reducing compressor (D1) is provided. Specifically, the compressor (D1) is connected to pressurizing/pressure-reducing pipes (19*d*, 19*e*) extending from the respective tanks (T1, T2) via a four-position selector valve (D2). In accordance with the switching operations of the four-position selector valve (D2), a state (i.e., a state indicated by the broken lines in FIG. 11) in which the first tank (T1) is connected to the outlet side of the compressor (D1) and the second tank (T2) is connected to the inlet side of the compressor (D1), and a state (i.e., a state indicated by the solid lines in FIG. 11) in which the first tank (T1) is connected to the inlet side of the compressor (D1) and the second tank (T2) is connected to the outlet side of the compressor (D1) are switched.

In accordance with the switching operations of the four-position selector valve (D2), the pressure application states with respect to the respective tanks (T1, T2) are alternately switched in the same way as in the fourth embodiment described above. As a result, the indoor air conditioning running can be performed continuously.

It is noted that, in this variant, check valves (CV7 to CV10) are used instead of the respective solenoid valves (SV7 to SV10) of the fourth embodiment described above. That is to say, the circuit shown in FIG. 11 is a circuit for heating. In a circuit exclusively used for cooling, these check valves are replaced by the counterparts in which the refrigerant is allowed in flow in an inverted direction.

(Fifth Embodiment)

Next, a specific secondary refrigerant circuit (B), which is provided with a plurality of tanks (T1, T2) in the same way as in the fourth embodiment described above, for continuously performing air conditioning running, will be described.

Figure 12:
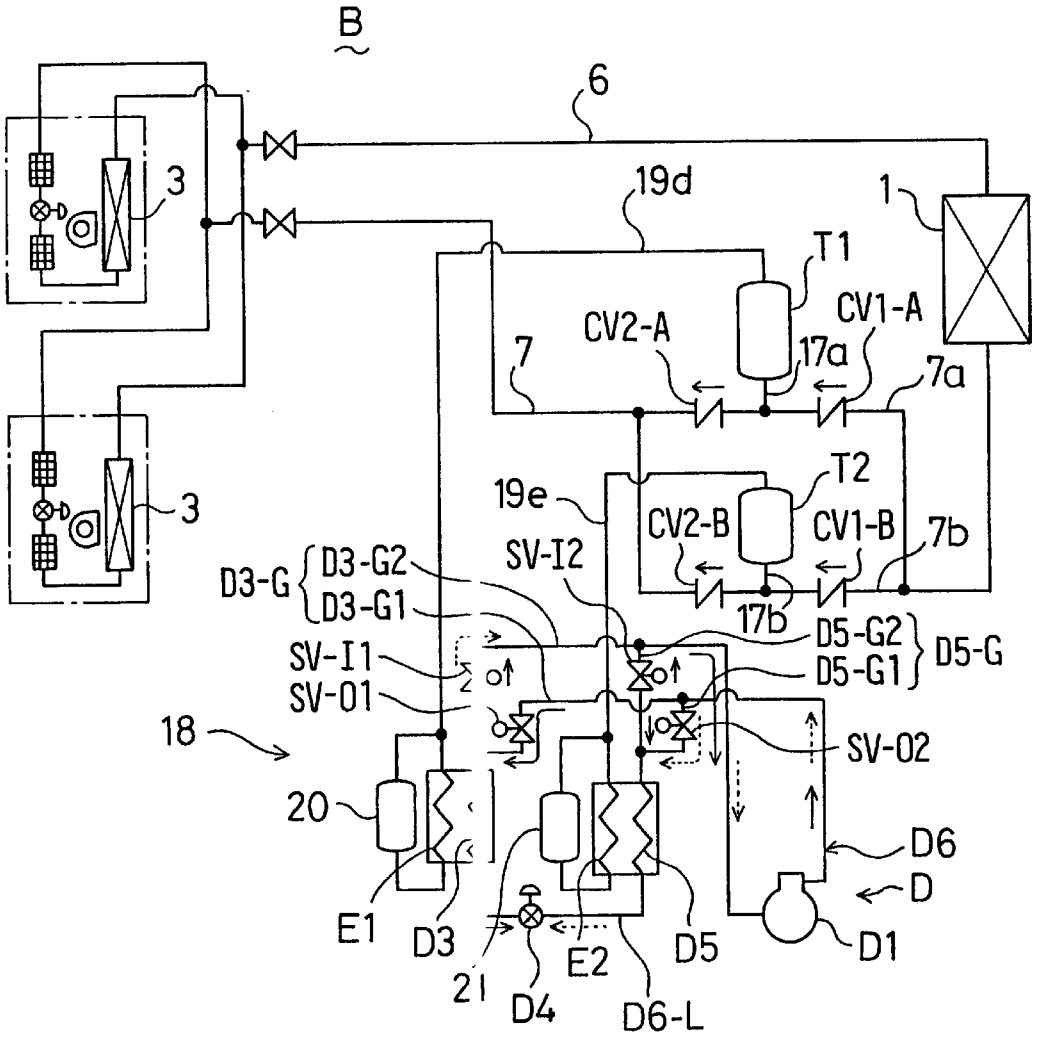
FIG. 12 is a diagram showing a secondary refrigerant circuit in the fifth embodiment.

The circuitry shown in FIG. 12 constitutes an air conditioning system exclusively used for cooling. In this secondary refrigerant circuit (B), a first and a second driving heat exchanger (E1, E2) are connected to pressurizing/pressure-reducing pipes (19*d*, 19*e*) extending from the respective tanks (T1, T2) and a pressurizing/pressure-reducing refrigerant circuit (D) is also provided. By exchanging heat between the refrigerant circuit (D) and the driving heat exchangers (E1, E2), pressure for circulating the refrigerant is applied to the respective tanks (T1, T2).

The refrigerant circuit (D) will be described. A compressor (D1), a first heat exchanger (D3) that can exchange heat with the first driving heat exchanger (E1), an expansion valve (D4) and a second heat exchanger (D5) that can exchange heat with the second driving heat exchanger (E2) are connected to each other through a refrigerant pipe (D6). Specifically, a gas-side pipe (D3-G) of the first heat exchanger (D3) is branched into two, which are connected to the outlet side and the inlet side of the compressor (D1), respectively. Of these branch pipes, a pipe (D3-G1) on the outlet side of the compressor (D1) is provided with a first outlet-side solenoid valve (SV-O1) and a pipe (D3-G2) on the inlet side thereof is provided with a first inlet-side solenoid valve (SV-I1).

Similarly, a gas-side pipe (D5-G) of the second heat exchanger (D5) is also branched into two, which are connected to the outlet side and the inlet side of the compressor (D1), respectively. A pipe (DS-G1) on the outlet side of the compressor (D1) is provided with a second outlet-side solenoid valve (SV-O2) and a pipe (D5-G2) on the inlet side thereof is provided with a second inlet-side solenoid valve (SV-I2). Also, the liquid sides of the respective heat exchangers (D3, D5) are coupled to each other through a liquid pipe (D6-L) via the expansion valve (D4).

Reservoirs (20, 21) for reserving a refrigerant for driving are connected to the respective driving heat exchangers (E1, E2). A check valve (CV1-A) allowing only the liquid refrigerant to flow from the heat exchanger (1) on the secondary heat source side to the first tank (T1) is provided between the connecting point of a connecting pipe (17*a*) to the first branch pipe (7*a*) of the liquid pipe (7) and the heat exchanger (1) on the secondary heat source side. A check valve (CV2-A) allowing only the liquid refrigerant to flow from the first tank (T1) to the indoor heat exchangers (3, 3) is provided between the connecting point of the connecting pipe (17*a*) to the first branch pipe (7*a*) and the indoor heat exchangers (3, 3).

On the other hand, a check valve (CV1-B) allowing only the liquid refrigerant to flow from the heat exchanger (1) on the secondary heat source side to the second tank (T2) is provided between the connecting point of a connecting pipe (17*b*) to the second branch pipe (7*b*) of the liquid pipe (7) and the heat exchanger (1) on the secondary heat source side. A check valve (CV2-B) allowing only the liquid refrigerant to flow from the second tank (T2) to the indoor heat exchangers (3, 3) is provided between the connecting point of the connecting pipe (17*b*) to the second branch pipe (7*b*) and the indoor heat exchangers (3, 3).

The other arrangements are the same as those of the primary and the secondary refrigerant circuits (A, B) of the first embodiment described above.

Next, the room cooling running operation will be described.

First, in the pressurizing/pressure-reducing refrigerant circuit (D), the first outlet-side solenoid valve (SV-O1) and the second inlet-side solenoid valve (SV-I2) are opened, the first inlet-side solenoid valve (SV-I1) and the second outlet-side solenoid valve (SV-O2) are closed and the compressor (D1) is driven. The high-temperature, high-pressure gaseous refrigerant discharged from the compressor (D1) flows through the gas-side pipe (D3-G1) and the first heat exchanger (D3) as indicated by the solid-line arrows in FIG. 12. In the first heat exchanger (D3), the refrigerant exchanges heat with the first driving heat exchanger (E1), applies heat to the refrigerant in the first driving heat exchanger (E1) and is condensed. Thereafter, the pressure of the liquid refrigerant is reduced by the expansion valve (D4) in the liquid pipe (D6-L), exchanges heat with the second driving heat exchanger (E2) in the second heat exchanger (D5), extracts heat from the refrigerant in the second driving heat exchanger (E2) and is evaporated to return to the compressor (D1) through the gas-side pipe (D5-G2). This circulation operation is repeated.

In accordance with this refrigerant circulation operation, the refrigerant is evaporated and a high pressure is built up in the first driving heat exchanger (E1), while the refrigerant is condensed and a low pressure is built up in the second driving heat exchanger (E2). Thus, a high pressure is applied to the first tank (T1) and a low pressure is applied to the second tank (T2). In the same way as in the fourth embodiment described above, the operation of draining the liquid refrigerant from the first tank (T1) and the operation of recovering the liquid refrigerant into the second tank (T2) are simultaneously performed, thereby circulating the refrigerant in the secondary refrigerant circuit (B).

After such a running state has lasted for a predetermined period of time, the opening/closing states of the respective solenoid valves in the pressurizing/pressure-reducing refrigerant circuit (D) are switched. Specifically, the first outlet-side solenoid valve (SV-O1) and the second inlet-side solenoid valve (SV-I2) are closed and the first inlet-side solenoid valve (SV-I1) and the second outlet-side solenoid valve (SV-O2) are opened. As a result, the refrigerant flows as indicated by the broken-line arrows in FIG. 12. The refrigerant is condensed and a low pressure is built up in the first driving heat exchanger (E1), while the refrigerant is evaporated and a high pressure is built up in the second driving heat exchanger (E2). Thus, a low pressure is applied to the first tank (T1) and a high pressure is applied to the second tank (T2). As a result, the operation of draining the liquid refrigerant from the second tank (T2) and the operation of recovering the liquid refrigerant into the first tank (T1) are simultaneously performed, thereby circulating the refrigerant in the secondary refrigerant circuit (B).

The pressure application states with respect to the respective tanks (T1, T2) are alternately switched, thereby continuously performing room cooling running. Also, the gaseous refrigerant recovered from the tank (T2), to which a low pressure is applied, into the driving heat exchanger (E2) is condensed in the driving heat exchanger (E2) so as to be temporarily reserved in the reservoir (21). And, when the opening/closing states of the respective solenoid valves (SV-O1 to SV-I2) are switched, the refrigerant is evaporated in the driving heat exchanger (E2), thereby applying a high pressure to the tank (T2).

(Sixth Embodiment)

Next, an air conditioning system, which is provided with a plurality of tanks (T1, T2) for performing continuous running and which is an air conditioning system exclusively used for heating, will be described. It is noted that, in this embodiment, only the difference from the foregoing fifth embodiment will be described hereinafter.

Figure 13:
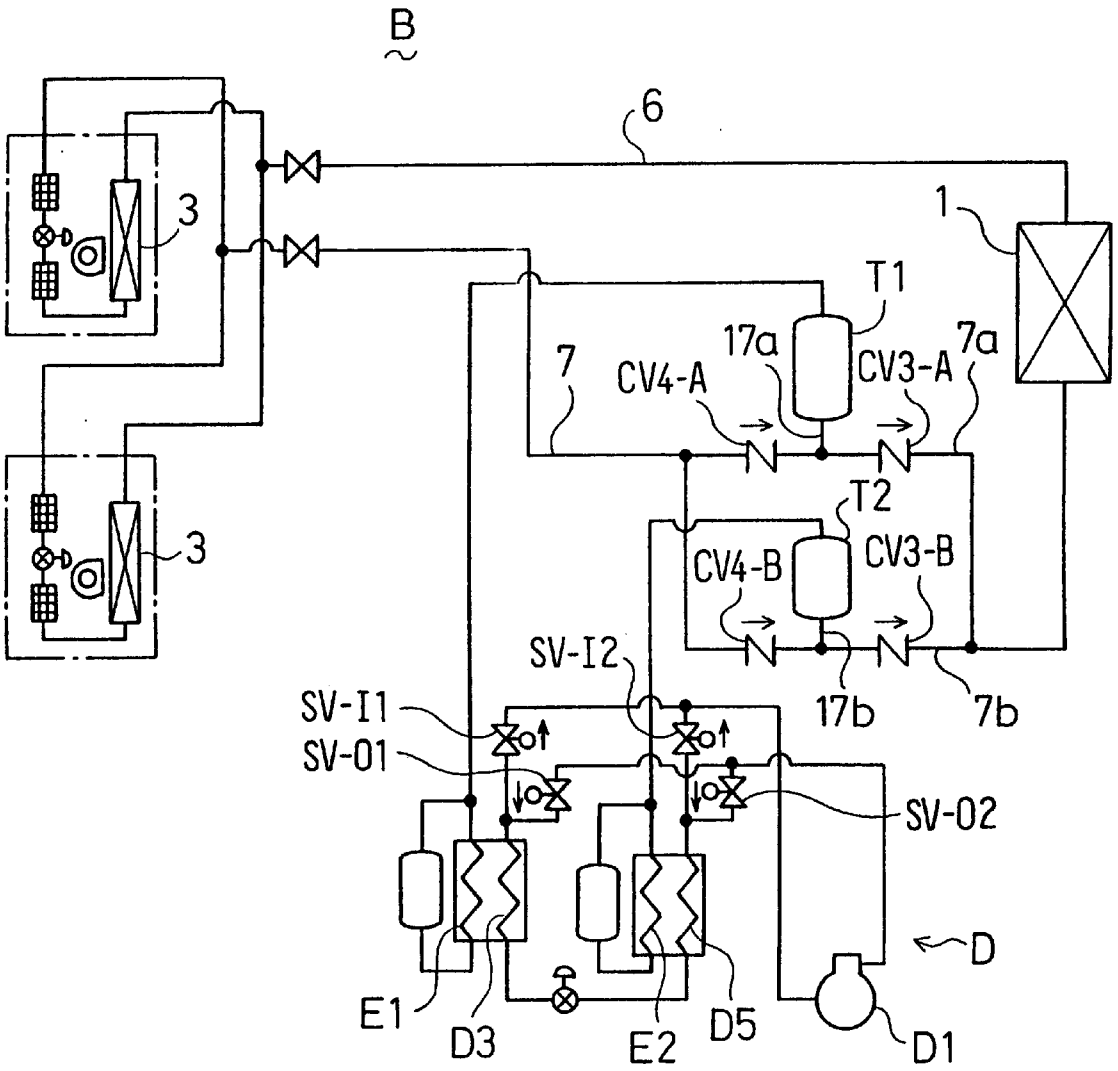
FIG. 13 is a diagram showing a secondary refrigerant circuit in the sixth embodiment.

As shown in FIG. 13, this secondary refrigerant circuit (B) is different from that of the fifth embodiment in the arrangements of the check valves provided for the respective branch pipes (7*a*, 7*b*) of the liquid pipe (7).

Specifically, a check valve (CV3-A) allowing only the liquid refrigerant to flow from the first tank (T1) to the heat exchanger (1) on the secondary heat source side is provided between the connecting point of the connecting pipe (17*a*) to the first branch pipe (7*a*) of the liquid pipe (7) and the heat exchanger (1) on the secondary heat source side. A check valve (CV4-A) allowing only the liquid refrigerant to flow from the indoor heat exchangers (3, 3) to the first tank (T1) is provided between the connecting point of the connecting pipe (17*a*) to the first branch pipe (7*a*) and the indoor heat exchangers (3, 3).

On the other hand, a check valve (CV3-B) allowing only the liquid refrigerant to flow from the second tank (T2) to the heat exchanger (1) on the secondary heat source side is provided between the connecting point of a connecting pipe (17*b*) to the second branch pipe (7*b*) of the liquid pipe (7) and the heat exchanger (1) on the secondary heat source side. A check valve (CV4-B) allowing only the liquid refrigerant to flow from the indoor heat exchangers (3, 3) to the second tank (T2) is provided between the connecting point of the connecting pipe (17*b*) to the second branch pipe (7*b*) and the indoor heat exchangers (3, 3).

The other arrangements are the same as the counterparts of the secondary refrigerant circuit of the fifth embodiment described above.

Next, the room heating running operation will be described.

In the same way as in the fifth embodiment described above, the respective solenoid valves of the pressurizing/pressure-reducing refrigerant circuit (D) are switched. Specifically, a state where the first outlet-side solenoid valve (SV-O1) and the second inlet-side solenoid valve (SV-I2) are opened and the first inlet-side solenoid valve (SV-I1) and the second outlet-side solenoid valve (SV-O2) are closed, and a state where the first outlet-side solenoid valve (SV-O1) and the second inlet-side solenoid valve (SV-I2) are closed and the first inlet-side solenoid valve (SV-I1) and the second outlet-side solenoid valve (SV-O2) are opened, are alternately and repeatedly established. Thus, a running condition where a high pressure is applied to the first tank (T1) and a low pressure is applied to the second tank (T2), and a running condition where a low pressure is applied to the first tank (T1) and a high pressure is applied to the second tank (T2), are alternately and repeatedly established. And, the liquid refrigerant drained from one tank (T1) to the liquid pipe (7) is evaporated in the heat exchanger (1) on the secondary heat source side, and then condensed in the indoor heat exchangers (3, 3), thereby heating the indoor air. Thereafter, the liquid refrigerant is recovered into the other tank (T2). This refrigerant circulation operation is repeated, thereby continuously performing the room heating running.

(Seventh Embodiment)

Next, the seventh embodiment of the present invention will be described. It is noted that only the difference from the foregoing sixth embodiment will be described hereinafter.

The secondary refrigerant circuit (B) of this embodiment is applied to an air conditioning system of a heat pump type.

Figure 14:
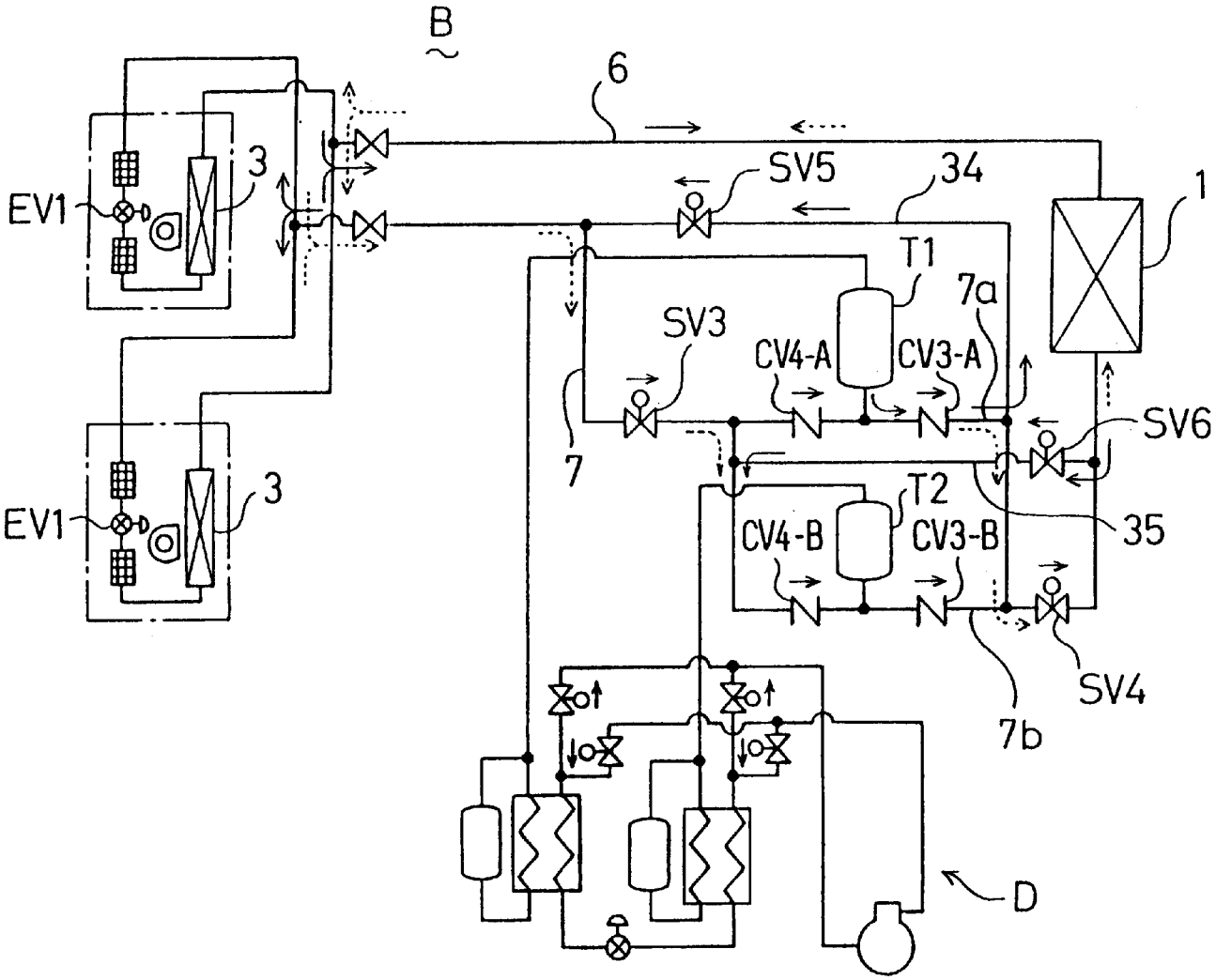
FIG. 14 is a diagram showing a secondary refrigerant circuit in the seventh embodiment.

Specifically, as shown in FIG. 14, a third solenoid valve (SV3) opening during the room heating running and closing during the cooling running is provided between a branch point of the branch pipes (7*a*, 7*b*) of the liquid pipe (7) on the side of the indoor heat exchangers (3) and the indoor heat exchangers (3, 3). A fourth solenoid valve (SV4) opening during the room heating running and closing during the cooling running is provided between a branch point of the branch pipes (7*a*, 7*b*) of the liquid pipe (7) on the side of the heat exchanger (1) on the secondary heat source side and the heat exchanger (1) on the secondary heat source side.

In addition, one end of a cooling liquid pipe (34) on the supply side is connected between the third solenoid valve (SV3) of the liquid pipe (7) and the indoor heat exchangers (3, 3). And the other end of the cooling liquid pipe (34) on the supply side is connected to the downstream of the third check valve (CV3-A) of the first branch pipe (7*a*). The cooling liquid pipe (34) on the supply side is provided with a fifth solenoid valve (SV5) opening during the cooling running and closing during the heating running.

Moreover, one end of a cooling liquid pipe (35) on the recovery side is connected between the fourth solenoid valve (SV4) of the liquid pipe (7) and the heat exchanger (1) on the secondary heat source side. And the other end of the cooling liquid pipe (35) on the recovery side is connected to the upstream of the fourth check valve (CV4-B) of the second branch pipe (7*b*). The cooling liquid pipe (35) on the recovery side is provided with a sixth solenoid valve (SV6) opening during the cooling running and closing during the heating running.

The other arrangements are the same as the counterparts of the sixth embodiment. Also, in this embodiment, the primary refrigerant circuit of the third embodiment described above is used as the primary refrigerant circuit.

Hereinafter, the room cooling and heating running will be described.

During the cooling running, in accordance with the switching operations of the respective solenoid valves in the pressurizing/pressure-reducing refrigerant circuit (D), as indicated by the solid-line arrows in FIG. 14, the liquid refrigerant drained from one tank (T1) to the branch pipe (7*a*) is passed through the cooling liquid pipe (34) on the supply side in the same way as in the fifth embodiment described above. The pressure of the refrigerant is reduced in the indoor electrically motorized expansion valves (EV1, EV1). Then, the refrigerant is evaporated in the indoor heat exchangers (3, 3), thereby cooling the indoor air. Thereafter, the gaseous refrigerant is condensed in the heat exchanger (1) on the secondary heat source side, passed through the cooling liquid pipe (35) on the recovery side and then recovered into the other tank (T2). This refrigerant circulation operation is repeated and a tank draining the liquid refrigerant and a tank recovering the refrigerant are alternately switched, thereby continuously performing the room cooling running.

On the other hand, during the room heating running, in accordance with the switching operations of the respective solenoid valves in the pressurizing/pressure-reducing refrigerant circuit (D), as indicated by the broken-line arrows in FIG. 14, the liquid refrigerant drained from one tank (T1) to the liquid pipe (7) flows through the liquid pipe (7) toward the heat exchanger (1) on the secondary heat source side in the same way as in the sixth embodiment described above. In the heat exchanger (1) on the secondary heat source side, the refrigerant exchanges heat with the refrigerant in the heat exchanger (12) on the primary heat source side and is evaporated. Thereafter, the refrigerant is passed through the gas pipe (6), exchanges heat with the indoor air and is condensed in the indoor heat exchangers (3, 3), thereby heating the indoor air. Thereafter, the liquid refrigerant condensed in the indoor heat exchanger (3) is passed through the liquid pipe (7) and recovered into the other tank (T2). This refrigerant circulation operation is repeated and a tank draining the liquid refrigerant and a tank recovering the refrigerant are alternately switched, thereby continuously performing the room heating running.

(Eighth Embodiment)

Next, the eighth embodiment of the present invention will be described. It is noted that only the difference from the foregoing sixth embodiment will be described hereinafter.

The secondary refrigerant circuit (B) of this embodiment is also applied to an air conditioning system of a heat pump type. The arrangement of the primary refrigerant circuit (A) is the same as that of the third embodiment described above and thus the description thereof will be omitted herein.

Figure 15:
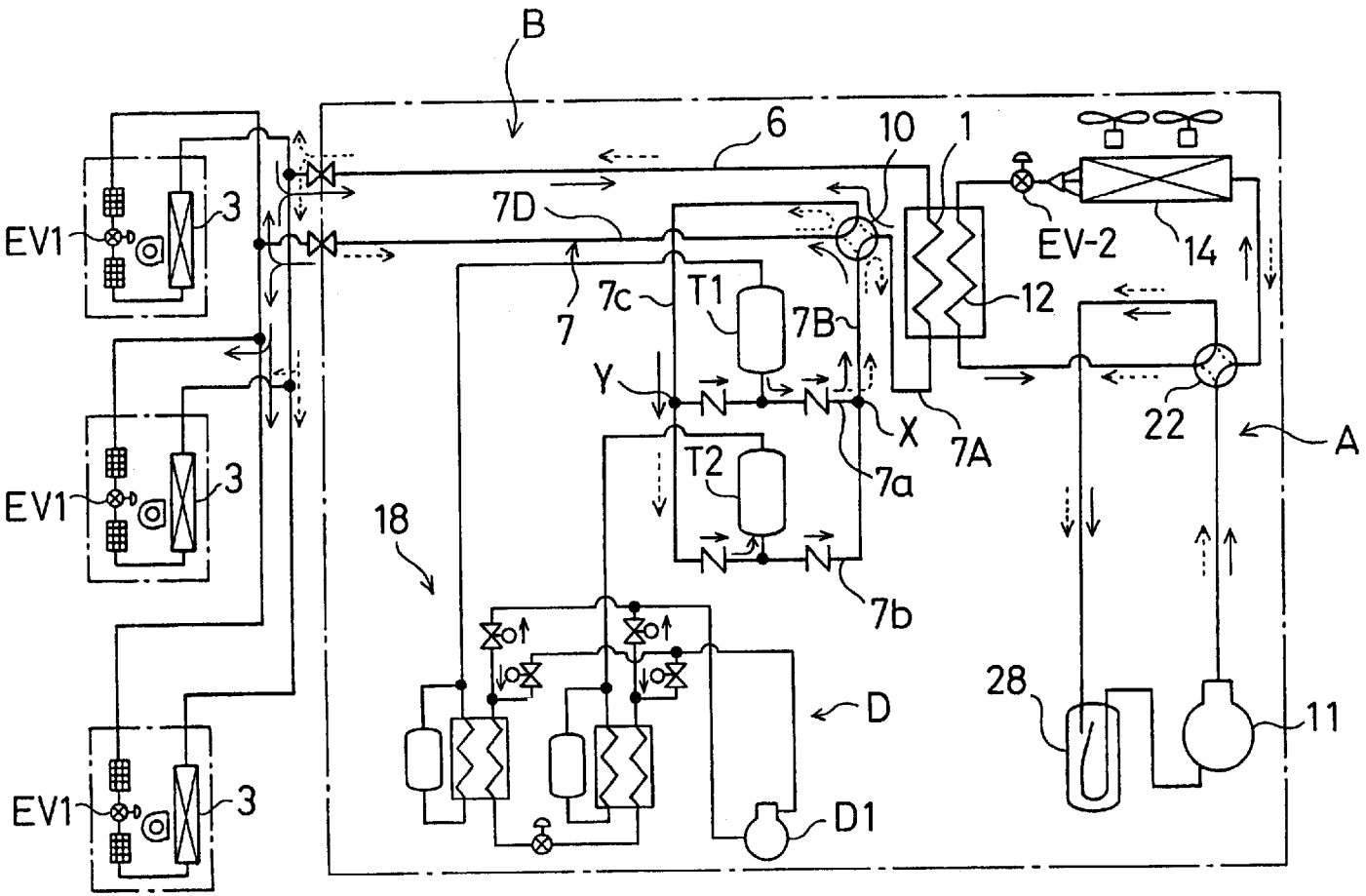
FIG. 15 is a diagram, corresponding to FIG. 1, in the eighth embodiment.

As shown in FIG. 15, the secondary refrigerant circuit (B) includes a four-position selector valve (10) in the liquid pipe (7). The four-position selector valve (10) is connected to a first liquid pipe (7A) extending from the liquid side of the heat exchanger (1) on the secondary heat source side, to a second and a third liquid pipe (7B, 7C) respectively extending from a first and a second branch points (X, Y) (where X is a branch point closer to the heat exchanger (1) on the secondary heat source side and Y is a branch point closer to the indoor heat exchanger (3)) on both ends of the respective branch pipes (7*a*, 7*b*) of the liquid pipe (7) and to a fourth liquid pipe (7D) extending from the indoor heat exchangers (3, 3, 3) to the tanks (T1, T2).

The four-position selector valve (10) switches the connection states between the liquid side of the heat exchanger (1) on the secondary heat source side and the respective branch points (X, Y) of the branch pipes (7*a*, 7*b*) and between the liquid sides of the indoor heat exchangers (3, 3, 3) and the respective branch points (X, Y) of the branch pipes (7*a*, 7*b*). Specifically, a state where the liquid side of the heat exchanger (1) on the secondary heat source side is connected to the first branch point (X) and the liquid sides of the indoor heat exchangers (3, 3, 3) are connected to the second branch point (Y) (i.e., a selected state indicated by the solid lines in FIG. 15) and a state where the liquid side of the heat exchanger (1) on the secondary heat source side is connected to the second branch point (Y) and the liquid sides of the indoor heat exchangers (3, 3, 3) are connected to the first branch point (X) (i.e., a selected state indicated by the broken lines in FIG. 15) are switched.

Also, the secondary refrigerant circuit (B) of this embodiment includes three indoor heat exchangers (3). The other arrangements are the same as the counterparts of the sixth embodiment described above. In FIG. 15, (28) denotes an accumulator.

Hereinafter, the room cooling and heating running will be described.

First, during the cooling running, the four-position selector valve (22) is switched to the direction indicated by the solid lines in the primary refrigerant circuit (A) and the four-position selector valve (10) is switched to the direction indicated by the broken lines in the secondary refrigerant circuit (B). In such a state, the compressor (11) of the primary refrigerant circuit (A) and the compressor (D1) of the pressurizing/pressure-reducing refrigerant circuit (D) in the secondary refrigerant circuit (B) are both driven.

As a result, in accordance with the switching operations of the respective solenoid valves in the pressurizing/pressure-reducing refrigerant circuit (D), as indicated by the solid-line arrows in FIG. 15, the liquid refrigerant drained from one tank (T1) is passed through the second liquid pipe (7B) and flows through the four-position selector valve (10) and the fourth liquid pipe (7D) in the same way as in the fifth embodiment. Then, the pressure of the refrigerant is reduced in the indoor electrically motorized expansion valves (EV1, EV1). The refrigerant is evaporated in the indoor heat exchangers (3, 3), thereby cooling the indoor air. Thereafter, the gaseous refrigerant is passed through the gas pipe (6), condensed in the heat exchanger (1) on the secondary heat source side, passed through the first liquid pipe (7A), the four-position selector valve (10) and the third liquid pipe (7C) and then recovered into the other tank (T2). This refrigerant circulation operation is repeated and a tank draining the liquid refrigerant and a tank recovering the refrigerant are alternately switched, thereby continuously performing the room cooling running.

On the other hand, during the room heating running, the four-position selector valve (22) is switched to the direction indicated by the broken lines in the primary refrigerant circuit (A) and the four-position selector valve (10) is switched to the direction indicated by the solid lines in the secondary refrigerant circuit (B). In such a state, the compressor (11) of the primary refrigerant circuit (A) and the compressor (D1) of the pressurizing/pressure-reducing refrigerant circuit (D) in the secondary refrigerant circuit (B) are both driven.

As a result, in accordance with the switching operations of the respective solenoid valves in the pressurizing/pressure-reducing refrigerant circuit (D), as indicated by the broken-line arrows in FIG. 15, the liquid refrigerant drained from one tank (T1) flows through the second liquid pipe (7B), the four-position selector valve (10) and the first liquid pipe (7A) in the same way as in the sixth embodiment described above. Then, in the heat exchanger (1) on the secondary heat source side, the refrigerant exchanges heat with the refrigerant in the heat exchanger (12) on the primary heat source side and is evaporated. The gaseous refrigerant is passed through the gas pipe (6), is introduced into the indoor heat exchangers (3, 3), exchanges heat with the indoor air and is condensed, thereby heating the indoor air. Thereafter, the liquid refrigerant condensed in the indoor heat exchanger (3) is passed through the fourth liquid pipe (7D), the four-position selector valve (10) and the third liquid pipe (7C) and is recovered into the other tank (T2). This refrigerant circulation operation is repeated and a tank draining the liquid refrigerant and a tank recovering the refrigerant are alternately switched, thereby continuously performing the room heating running.

(Ninth Embodiment)

Next, the ninth embodiment of the present invention will be described. It is noted that only the difference from the foregoing eighth embodiment will be described hereinafter. The secondary refrigerant circuit (B) of this embodiment is also applied to an air conditioning system of a heat pump type. The arrangement of the primary refrigerant circuit (A) is the same as that of the third embodiment described above and thus the description thereof will be omitted herein. This embodiment is different from the eighth embodiment in the arrangement of the pressurizing/pressure-reducing mechanism (18). Thus, only the pressurizing/pressure-reducing mechanism (18) will be described.

Figure 16:
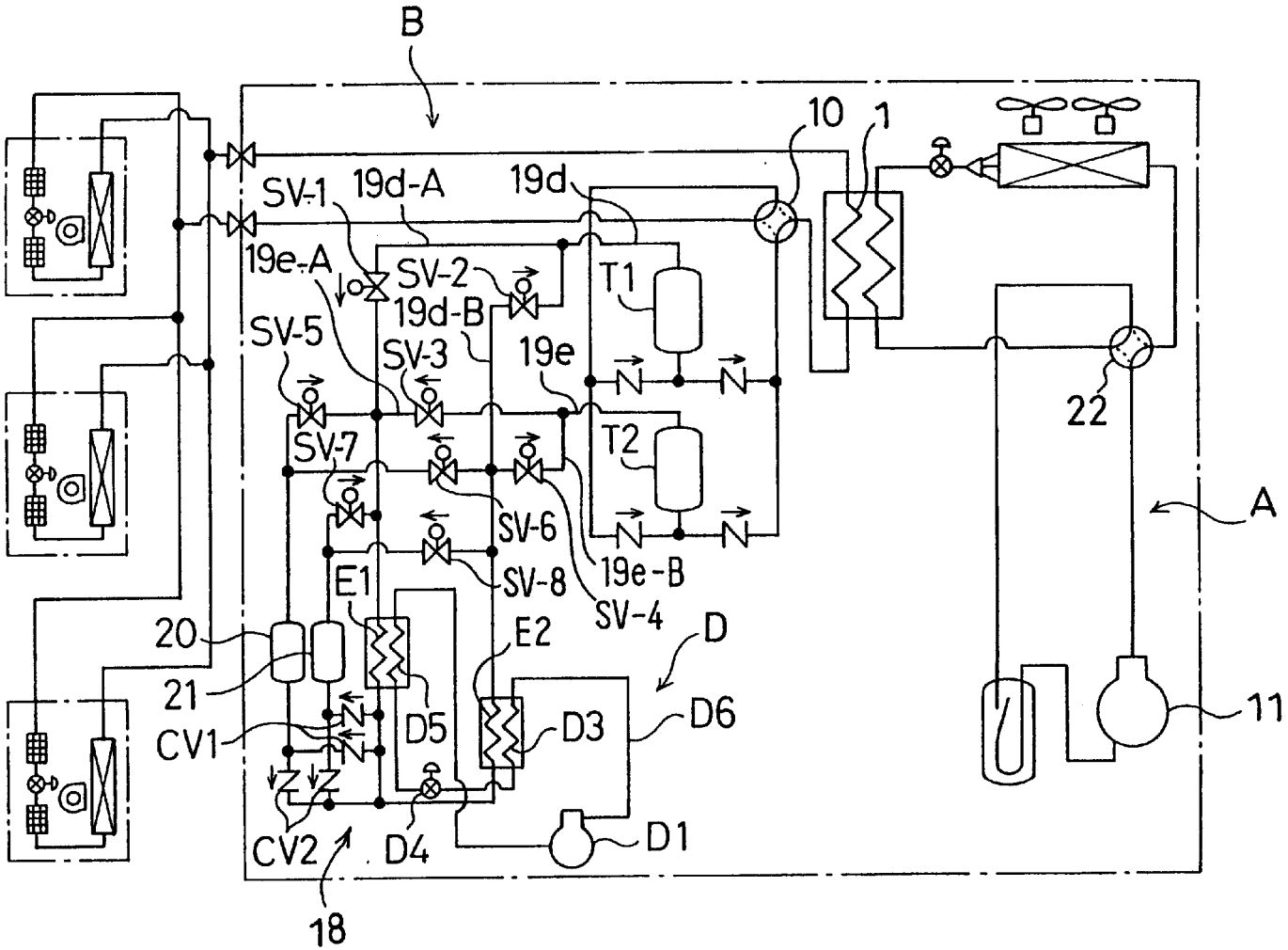
FIG. 16 is a diagram, corresponding to FIG. 1, in the ninth embodiment.

As shown in FIG. 16, in the secondary refrigerant circuit (B), a first and a second driving heat exchanger (E1, E2) are connected to a first and a second pressurizing/pressure-reducing pipes (19*d*, 19*e*) extending from the respective tanks (T1, T2), and a pressurizing/pressure-reducing refrigerant circuit (D) is also provided. By exchanging heat between the refrigerant circuit (D) and the driving heat exchangers (E1, E2), pressures for circulating the refrigerant are applied to the respective tanks (T1, T2).

Specifically, the first pressurizing/pressure-reducing pipe (19*d*) connected to the upper end of the first tank (T1) is branched into a first pressurizing/pressure-reducing branch pipe (19*d*-A) leading to the first driving heat exchanger (E1) and a second pressurizing/pressure-reducing branch pipe (19*d*-B) leading to the second driving heat exchanger (E2). A first pressurizing/pressure-reducing solenoid valve (SV-1) and a second pressurizing/pressure-reducing solenoid valve (SV-2) are provided for the first pressurizing/pressure-reducing branch pipe (19*d*-A) and the second pressurizing/pressure-reducing branch pipe (19*d*-B), respectively.

On the other hand, the second pressurizing/pressure-reducing pipe (19*e*) connected to the upper end of the second tank (T2) is branched into a third pressurizing/pressure-reducing branch pipe (19*e*-A) leading to a point between the first pressurizing/pressure-reducing solenoid valve (SV-1) of the first pressurizing/pressure-reducing branch pipe (19*d*-A) and the first driving heat exchanger (E1) and a fourth pressurizing/pressure-reducing branch pipe (19*e*-B) leading to a point between the second pressurizing/pressure-reducing solenoid valve (SV-2) of the second pressurizing/pressure-reducing branch pipe (19*d*-B) and the second driving heat exchanger (E2). A third pressurizing/pressure-reducing solenoid valve (SV-3) and a fourth pressurizing/pressure-reducing solenoid valve (SV-4) are provided for the third pressurizing/pressure-reducing branch pipe (19*e*-A) and the fourth pressurizing/pressure-reducing branch pipe (19*e*-B), respectively.

The refrigerant circuit (D) will be described. A compressor (D1), a second heat exchanger (D3) that can exchange heat with the second driving heat exchanger (E2), an expansion valve (D4) and a first heat exchanger (D5) that can exchange heat with the first driving heat exchanger (E1) are connected in this order through a refrigerant pipe (D6).

Reservoirs (20, 21) for reserving a refrigerant for driving are connected to the respective driving heat exchangers (E1, E2) via check valves (CV-1, CV-2) and solenoid valves (SV-5 to SV-8). Specifically, the lower end of the first driving heat exchanger (E1) is connected to the lower ends of the respective reservoirs (20, 21) via check valves (CV1, CV1) allowing only the liquid refrigerant to flow from the first driving heat exchanger (E1) to the respective reservoirs (20, 21). The lower end of the second driving heat exchanger (E2) is connected to the lower ends of the respective reservoirs (20, 21) via check valves (CV2, CV2) allowing only the liquid refrigerant to flow from the respective reservoirs (20, 21) to the second driving heat exchanger (E2).

The upper end of the first reservoir (20) is connected to the first pressurizing/pressure-reducing branch pipe (19*d*-A) via the fifth solenoid valve (SV-5) and to the second pressurizing/pressure-reducing branch pipe (19*d*-B) via the sixth solenoid valve (SV-6). The upper end of the second reservoir (21) is connected to the first pressurizing/pressure-reducing branch pipe (19*d*-A) via the seventh solenoid valve (SV-7) and to the second pressurizing/pressure-reducing branch pipe (19*d*-B) via the eighth solenoid valve (SV-8).

The other arrangements are the same as those of the primary and the secondary refrigerant circuits (A, B) of the eighth embodiment described above.

Next, the room cooling and heating running will be described.

First, during the cooling running, the four-position selector valve (22) is switched to the direction indicated by the solid lines in the primary refrigerant circuit (A). On the other hand, in the secondary refrigerant circuit (B), the four-position selector valve (10) is switched to the direction indicated by the broken lines. Furthermore, in the pressurizing/pressure-reducing mechanism (18), the second solenoid valve (SV-2), the third solenoid valve (SV-3), the sixth solenoid valve (SV-6) and the seventh solenoid valve (SV-7) are opened, while the first solenoid valve (SV-1), the fourth solenoid valve (SV-4), the fifth solenoid valve (SV-5) and the eighth solenoid valve (SV-8) are closed.

In such a state, the compressor (11) of the primary refrigerant circuit (A) and the compressor (D1) of the pressurizing/pressure-reducing refrigerant circuit (D) in the secondary refrigerant circuit (B) are both driven. And, in the pressurizing/pressure-reducing refrigerant circuit (D), as indicated by the solid-line arrows in FIG. 17, the refrigerant discharged from the compressor (D1) flows through the first heat exchanger (D3). In the first heat exchanger (D3), the refrigerant exchanges heat with the second driving heat exchanger (E2), applies heat to the refrigerant in the second driving heat exchanger (E2) and is condensed. Thereafter, the pressure of the refrigerant is reduced in the expansion valve (D4). And, in the second heat exchanger (D5), the refrigerant exchanges heat with the first driving heat exchanger (E1), extracts heat from the refrigerant in the first driving heat exchanger (E1) and is evaporated to return to the compressor (D1). This circulation operation is repeated.

As a result of the refrigerant circulation operation, the refrigerant is evaporated and a high pressure is built up in the second driving heat exchanger (E2), while the refrigerant is condensed and a low pressure is built up in the first driving heat exchanger (E1). Thus, a high pressure is applied through the second pressurizing/pressure-reducing branch pipe (19*d*-B) to the first tank (T1) and a low pressure is applied through the third pressurizing/pressure-reducing branch pipe (19*e*-A) to the second tank (T2). In the same way as in the fourth embodiment, the operation of draining the liquid refrigerant from the first tank (T1) and the operation of recovering the liquid refrigerant into the second tank (T2) are simultaneously performed, thereby circulating the refrigerant in the secondary refrigerant circuit (B).

Figure 17:
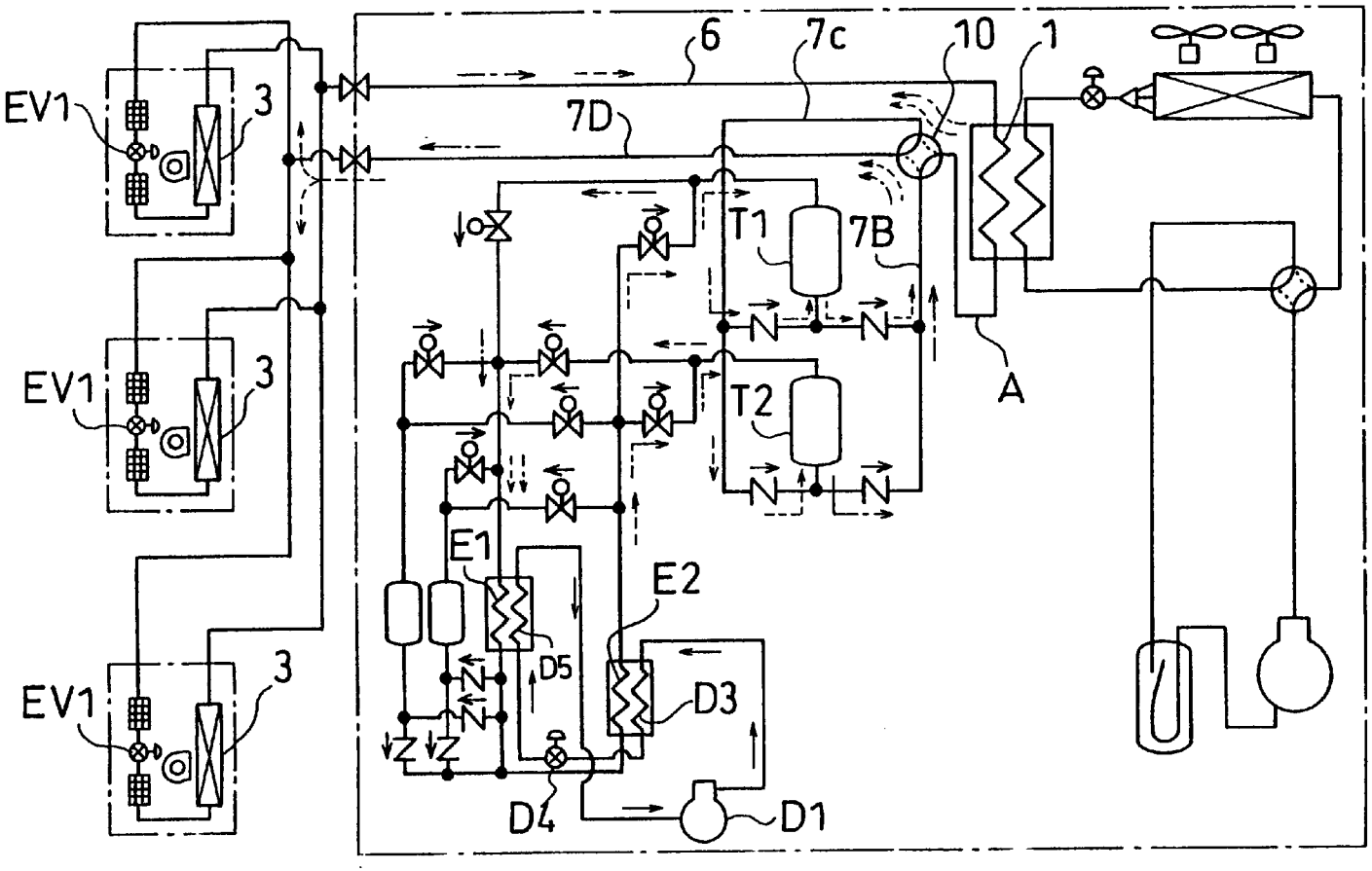
FIG. 17 is a diagram showing a cooling running operation in the ninth embodiment.

Specifically, as indicated by the broken-line arrows in FIG. 17, the liquid refrigerant drained from the first tank (T1) passes through the second liquid pipe (7B) and flows through the four-position selector valve (10) and the fourth liquid pipe (7D). Thereafter, the pressure of the refrigerant is reduced in the indoor electrically motorized expansion valves (EV1, EV1, . . . ). And the refrigerant is evaporated in the indoor heat exchangers (3, 3, . . . ) thereby cooling the indoor air. Thereafter, the gaseous refrigerant is passed through the gas pipe (6), condensed in the heat exchanger (1) on the secondary heat source side and passed through the first liquid pipe (7A), the four-position selector valve (10) and the third liquid pipe (7C) so as to be recovered into the second tank (T2). This refrigerant circulation operation is repeated.

In this case, the gaseous refrigerant, which has been recovered from the second tank (T2) into the first driving heat exchanger (El) through the third pressurizing/pressure-reducing branch pipe (19*e*-A), is condensed and reserved in the second reservoir (21). The pressure of the second driving heat exchanger (E2) is equalized with that of the first reservoir (20), and the liquid refrigerant in the reservoir (20) is supplied to the second driving heat exchanger (E2).

After such a refrigerant circulation operation has been performed for a predetermined period of time, the switching operations are performed for the respective solenoid valves. Specifically, the first solenoid valve (SV-1), the fourth solenoid valve (SV-4), the fifth solenoid valve (SV-5) and the eighth solenoid valve (SV-8) are opened, while the second solenoid valve (SV-2), the third solenoid valve (SV-3), the sixth solenoid valve (SV-6) and the seventh solenoid valve (SV-7) are closed.

When the respective solenoid valves are switched in such a manner, a high pressure is applied through the fourth pressurizing/pressure-reducing branch pipe (19*e*-B) to the second tank (T2) and a low pressure is applied through the first pressurizing/pressure-reducing branch pipe (19*d*-A) to the first tank (T1). As a result, the operation of draining the liquid refrigerant from the second tank (T2) and the operation of recovering the liquid refrigerant into the first tank (T1) are simultaneously performed, thereby circulating the refrigerant in the secondary refrigerant circuit (B).

Specifically, as indicated by the one-dot-chain arrows in FIG. 17, the liquid refrigerant drained from the second tank (T2) passes through the second liquid pipe (7B) and flows through the four-position selector valve (10) and the fourth liquid pipe (7D). Thereafter, the pressure of the refrigerant is reduced in the indoor electrically motorized expansion valves (EV1, EV1, . . . ). And the refrigerant is evaporated in the indoor heat exchangers (3, 3, . . . ), thereby cooling the indoor air. Thereafter, the gaseous refrigerant is passed through the gas pipe (6), condensed in the heat exchanger (1) on the secondary heat source side and passed through the first liquid pipe (7A), the four-position selector valve (10) and the third liquid pipe (7C) so as to be recovered into the first tank (T1). This refrigerant circulation operation is repeated.

In this case, the gaseous refrigerant, which has been recovered from the first tank (T1) into the first driving heat exchanger (El) through the first pressurizing/pressure-reducing branch pipe (19*d*-A), is condensed and reserved in the first reservoir (20). The pressure of the second driving heat exchanger (E2) is equalized with that of the second reservoir (21), and the liquid refrigerant in the reservoir (21) is supplied to the second driving heat exchanger (E2).

A tank draining the liquid refrigerant and a tank recovering the refrigerant are alternately switched in such a manner, thereby continuously performing the room cooling running.

On the other hand, during the room heating running, the four-position selector valve (22) is switched to the direction indicated by the broken lines in the primary refrigerant circuit (A). In the secondary refrigerant circuit (B), the four-position selector valve (10) is switched to the direction indicated by the solid lines. Furthermore, in the pressurizing/pressure-reducing mechanism (18), the second solenoid valve (SV-2), the third solenoid valve (SV-3), the sixth solenoid valve (SV-6) and the seventh solenoid valve (SV-7) are opened, while the first solenoid valve (SV-1), the fourth solenoid valve (SV-4), the fifth solenoid valve (SV-5) and the eighth solenoid valve (SV-8) are closed in the same way as in the case of the cooling running described above. As a result, a high pressure is applied to the first tank (T1) and a low pressure is applied to the second tank (T2).

Alternatively, the first solenoid valve (SV-1), the fourth solenoid valve (SV-4), the fifth solenoid valve (SV-5) and the eighth solenoid valve (SV-8) are opened and the second solenoid valve (SV-2), the third solenoid valve (SV-3), the sixth solenoid valve (SV-6) and the seventh solenoid valve (SV-7) are closed. As a result, a high pressure is applied to the second tank (T2) and a low pressure is applied to the first tank (T1). These two states are alternately switched.

Figure 18:
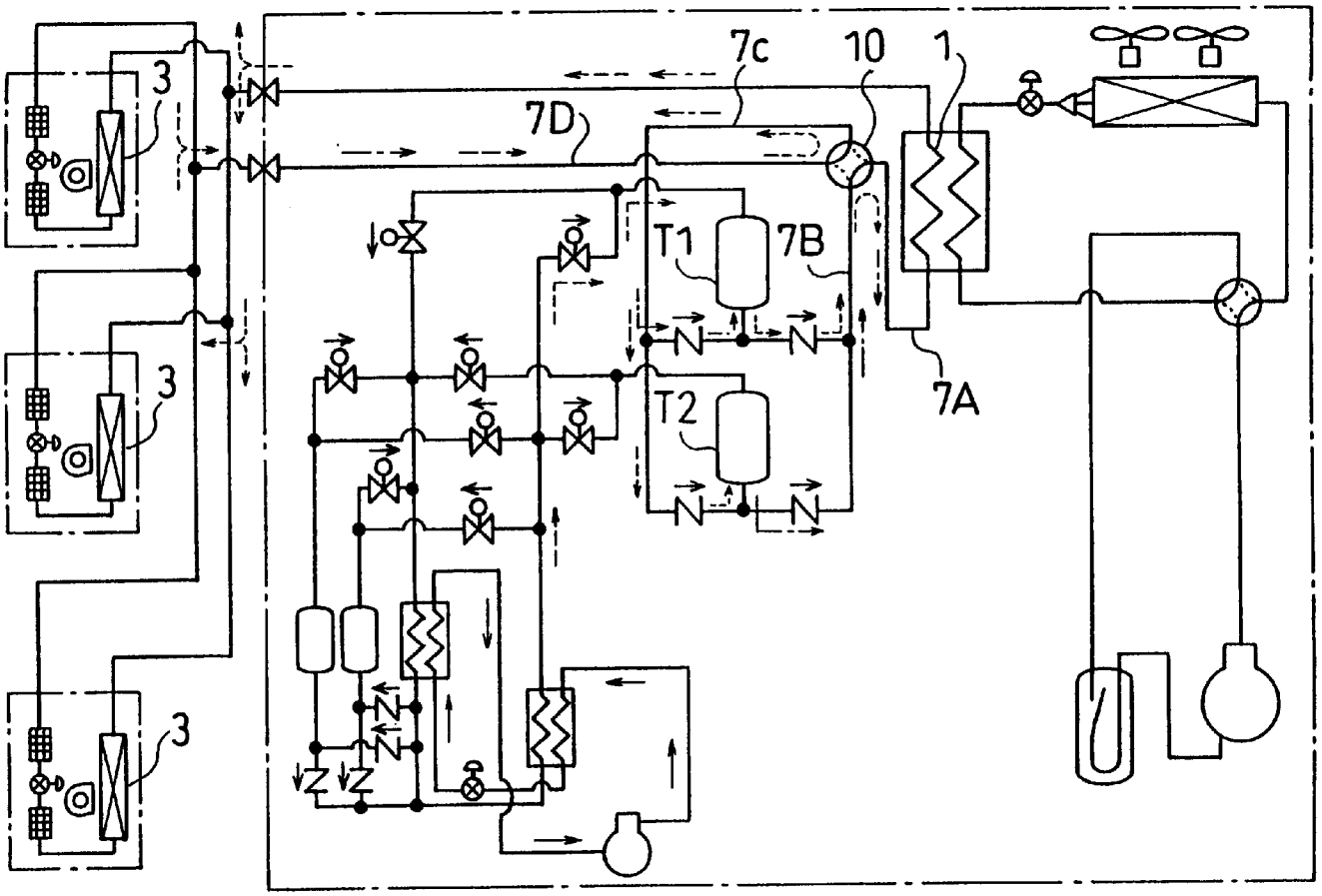
FIG. 18 is a diagram showing a heating running operation in the ninth embodiment.

As a result, as indicated by the broken-line and one-dot-chain arrows in FIG. 18, the liquid refrigerant drained from one tank (T1) passes through the second liquid pipe (7B) and flows through the four-position selector valve (10) and the first liquid pipe (7A). Thereafter, in the heat exchanger (1) on the secondary heat source side, the refrigerant exchanges heat with the refrigerant in the heat exchanger (12) on the primary heat source side and is evaporated. The gaseous refrigerant is passed through the gas pipe (6) and introduced into the indoor heat exchangers (3, 3), in which the refrigerant exchanges heat with the indoor air and is condensed, thereby heating the indoor air. Then, the liquid refrigerant condensed in the indoor heat exchanger (3) is passed through the fourth liquid pipe (7D), the four-position selector valve (10) and the third liquid pipe (7C) and recovered into the other tank (T2). This refrigerant circulation operation is repeated and a tank draining the liquid refrigerant and a tank recovering the refrigerant are alternately switched, thereby continuously performing the room heating running.

(Tenth Embodiment)

Figure 19:
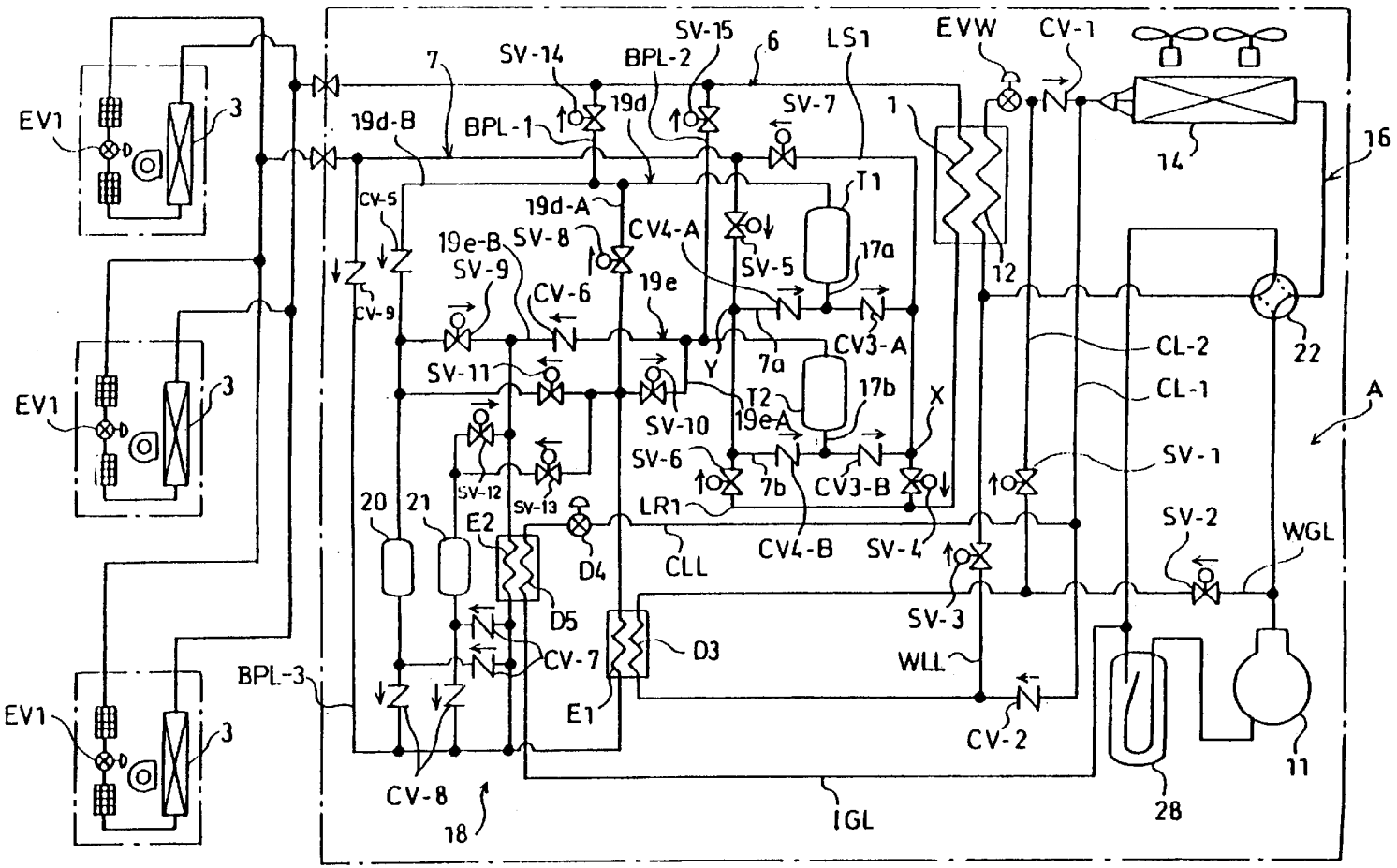
FIG. 19 is a diagram, corresponding to FIG. 1, in the tenth embodiment.

Next, the tenth embodiment of the present invention will be described with reference to FIGS. 19 to 21. This embodiment is a variant of the primary refrigerant circuit (A) to be combined with substantially the same circuit as the secondary refrigerant circuit (B) of the ninth embodiment described above. Also, this embodiment is a heat pump circuit for cooling and heating.

First, the primary refrigerant circuit (A) will be described.

The primary refrigerant circuit (A) is constituted by connecting a compressor (11), a four-position selector valve (22), an outdoor heat exchanger (14), an outdoor electrically motorized expansion valve (EVW) and a heat exchanger (12) on the primary heat source side through a refrigerant pipe (16). The gas side of heat exchanger (12) on the primary heat source side is switched between the inlet side and the outlet side of the compressor (11) via the four-position selector valve (22).

A check valve (CV-1) allowing only the refrigerant to flow from the outdoor electrically motorized expansion valve (EVW) to the outdoor heat exchanger (14) is provided between the outdoor heat exchanger (14) and the outdoor electrically motorized expansion valve (EVW). The primary refrigerant circuit (A) includes a heating heat exchanger (D3) and a cooling heat exchanger (D5) both for exchanging heat with the secondary refrigerant circuit (B).

One end (i.e., the lower end in FIG. 19) of the heating heat exchanger (D3) is connected between the outdoor heat exchanger (14) and the check valve (CV-1) of the refrigerant pipe (16) through a first cooling liquid line (CL-1) including a check valve (CV-2). The other end (i.e., the upper end in FIG. 19) thereof is connected between the outdoor electrically motorized expansion valve (EVW) and the check valve (CV-1) in the refrigerant pipe (16) through a second cooling liquid line (CL-2).

A first solenoid valve (SV-1) opening during cooling and closing during heating is provided for the second cooling liquid line (CL-2). One end of a heating gas line (WGL) is connected between the heating heat exchanger (D3) and the first solenoid valve (SV-1) in the second cooling liquid line (CL-2) and the other end of the heating gas line (WGL) is connected to the outlet side of the compressor (11). A second solenoid valve (SV-2) opening during heating and closing during cooling is provided for the heating gas line (WGL).

A heating liquid line (WLL) is connected between the first cooling liquid line (CL-1) and the heat exchanger (12) on the primary heat source side. A third solenoid valve (SV-3) opening during heating and closing during cooling is provided for the heating liquid line (WLL). Furthermore, one end of the cooling heat exchanger (D5)(i.e., the lower end in FIG. 19) is connected to the inlet side of the compressor (11) through an inlet gas line (IGL) and the other end thereof (i.e., the upper end in FIG. 19) is connected to the first cooling liquid line (CL-1) through the cooling liquid line (CLL). A motor operated valve (D4) is provided for the cooling liquid line (CLL).

On the other hand, in the secondary refrigerant circuit (B), a heat exchanger (1) on the secondary heat source side for exchanging heat with the heat exchanger (12) on the primary heat source side and indoor heat exchangers (3, 3, 3) are connected to each other through a gas pipe (6) and a liquid pipe (7). A part of the liquid pipe (7) is branched into a first and a second branch pipe (7*a*, 7*b*), to which a first and a second tank (T1, T2) reserving the liquid refrigerant therein are respectively connected through connection pipes (17*a*, 17*b*). A check valve (CV3-A) allowing only the liquid refrigerant to flow from the first tank (T1) to the heat exchanger (1) on the secondary heat source side is provided between the connecting point of the connecting pipe (17*a*) to the first branch pipe (7*a*) of the liquid pipe (7) and the heat exchanger (1) on the secondary heat source side. A check valve (CV4-A) allowing only the liquid refrigerant to flow from the indoor heat exchangers (3, 3) to the first tank (T1) is provided between the connecting point of the connecting pipe (17*a*) to the first branch pipe (7*a*) and the indoor heat exchangers (3, 3).

On the other hand, a check valve (CV3-B) allowing only the liquid refrigerant to flow from the second tank (T2) to the heat exchanger (1) on the secondary heat source side is provided between the connecting point of a connecting pipe (17*b*) to the second branch pipe (7*b*) of the liquid pipe (7) and the heat exchanger (1) on the secondary heat source side. A check valve (CV4-B) allowing only the liquid refrigerant to flow from the indoor heat exchangers (3, 3) to the second tank (T2) is provided between the connecting point of the connecting pipe (17*b*) to the second branch pipe (7*b*) and the indoor heat exchangers (3, 3).

Of the two connecting points (X, Y) of each of the connecting pipes (17*a*, 17*b*), a fourth solenoid valve (SV-4) is provided between the connecting point (X) closer to the heat exchanger (1) on the secondary heat source side and the heat exchanger (1) on the secondary heat source side, and a fifth solenoid valve (SV-5) is provided between the connecting point (Y) closer to the indoor heat exchangers (3, 3, 3) and the indoor heat exchangers (3, 3, 3).

One end of a liquid refrigerant recovery pipe (LR1) is connected between the heat exchanger (1) on the secondary heat source side and the fourth solenoid valve (SV-4). The liquid refrigerant recovery pipe (LR1) is connected to the upstream of the check valve (CV4-B) at the other end, and is provided with a sixth solenoid valve (SV-6). One end of a liquid refrigerant supply pipe (LS1) is connected between the indoor heat exchangers (3, 3, 3) and the fifth solenoid valve (SV-5). The liquid refrigerant supply pipe (LS1) is connected to the downstream of the check valve (CV3-A) at the other end, and is provided with a seventh solenoid valve (SV-7).

A pressurizing/pressure-reducing mechanism (18) is connected to the respective upper ends of the tanks (T1, T2) through a first and a second pressurizing/pressure-reducing pipes (19*d*, 19*e*). The pressurizing/pressure-reducing mechanism (18) is constructed such that while a high pressure is applied to one tank (T1), a low pressure is applied to the other tank (T2) and alternately switches these states. Specifically, a first and a second driving heat exchanger (E1, E2) are connected to the first and the second pressurizing/pressure-reducing pipes (19*d*, 19*e*). These driving heat exchangers (E1, E2) exchange heat with the heating and the cooling heat exchangers (D3, D5), thereby applying pressure for circulating the refrigerant onto the respective tanks (T1, T2).

That is to say, the first pressurizing/pressure-reducing pipe (19*d*) connected to the upper end of the first tank (T1) is branched into a first branch pipe (19*d*-A) leading to the first driving heat exchanger (E1) and a second branch pipe (19*d*-B) leading to the second driving heat exchanger (E2). An eighth solenoid valve (SV-8) is provided for the first branch pipe (19*d*-A). A check valve (CV-5) allowing only the refrigerant to flow from the first tank (T1) to the second driving heat exchanger (E2) and a ninth solenoid valve (SV-9) are provided for the second branch pipe (19*d*-B).

On the other hand, the second pressurizing/pressure-reducing pipe (19*e*) connected to the upper end of the second tank (T2) is also branched into two. One of them or the first branch pipe (19*e*-A) is connected between the eighth solenoid valve (SV-8) and the first driving heat exchanger (E1) of the first branch pipe (19*d*-A) via a tenth solenoid valve (SV-10). The other of them or the second branch pipe (19*e*-B) is connected between the ninth solenoid valve (SV-9) and the second driving heat exchanger (E2) of the second branch pipe (19*d*-B) through a check valve (CV-6).

In addition, the secondary refrigerant circuit (B) further includes a pair of reservoirs (20, 21). A pipe connected to the upper end of the first reservoir (20) is branched into two. One of them is connected between the check valve (CV-5) and the ninth solenoid valve (SV-9) of the second branch pipe (19*d*-B), and the other is connected between the eighth solenoid valve (SV-8) and the first driving heat exchanger (El) of the first branch pipe (19*d*-A) via an eleventh solenoid valve (SV-11). A pipe connected to the lower end of the first reservoir (20) is also branched into two, which are connected to the first driving heat exchanger (El) and the second driving heat exchanger (E2), respectively. Each of the branch pipes is provided with a check valve (CV-8) allowing only the refrigerant to flow from the reservoir (20) into the first driving heat exchanger (E1) and a check valve (CV-7) allowing only the refrigerant to flow from the second driving heat exchanger (E2) into the reservoir (20).

A pipe connected to the upper end of the second reservoir (21) is also branched into two. One of them is connected between the ninth solenoid valve (SV-9) of the second branch pipe (19*d*-B) and the second driving heat exchanger (E2) via a twelfth solenoid valve (SV-12), and the other is connected between the eighth solenoid valve (SV-8) of the first branch pipe (19*d*-A) and the first driving heat exchanger (E1) via a thirteenth solenoid valve (SV-13). A pipe connected to the lower end of the second reservoir (21) is also branched into two, which are connected to the first driving heat exchanger (E1) and the second driving heat exchanger (E2), respectively. Each of the branch pipes is provided with the check valve (CV-8) allowing only the refrigerant to flow from the reservoir (21) into the first driving heat exchanger (E1) and the check valve (CV-7) allowing only the refrigerant to flow from the second driving heat exchanger (E2) into the reservoir (21).

A first by-pass pipe (BPL-1) is connected between the gas pipe (6) and the second branch pipe (19*d*-B). The first by-pass pipe (BPL-1) includes a fourteenth solenoid valve (SV-14), thereby by-passing a part of the gaseous refrigerant to the gas pipe (6). A second by-pass pipe (BPL-2) is connected between the gas pipe (6) and the second pressurizing/pressure-reducing pipe (19*e*). The second by-pass pipe (BPL-2) includes a fifteenth solenoid valve (SV-15), thereby by-passing a part of the gaseous refrigerant to the gas pipe (6). A third bypass pipe (BPL-3) is connected between the liquid pipe (7) and the respective driving heat exchangers (E1, E2). The third by-pass pipe (BPL-3) includes a check valve (CV-9), thereby by-passing the liquid refrigerant to the respective driving heat exchangers (E1, E2).

Next, the cooling running operation will be described.

In the primary refrigerant circuit (A), the four-position selector valve (D2) is switched to the direction indicated by the solid lines, the first solenoid valve (SV-1) is opened and the second and the third solenoid valves (SV-2, SV-3) are closed. Then, as indicated by the solid-line arrows in FIG. 20, the refrigerant discharged from the compressor (11) is condensed in the outdoor heat exchanger (14). Thereafter, a part of the refrigerant is supplied to the heating heat exchanger (D3) and the other part is supplied to the cooling heat exchanger (D5) after the pressure thereof has been reduced in the pressure reducing valve (D4). The refrigerant supplied to the heating heat exchanger (D3) applies heat to the first driving heat exchanger (E1) and is excessively cooled. Then, in the heating heat exchanger (12), the refrigerant extracts heat from the refrigerant in the heat exchanger (1) on the secondary heat source side and is evaporated to return to the compressor (11). On the other hand, the refrigerant supplied to the cooling heat exchanger (D5) extracts heat from the second driving heat exchanger (E2) and is evaporated to return to the compressor (11).

As a result of the refrigerant circulation operation, the refrigerant is evaporated and a high pressure is built up in the first driving heat exchanger (E1). On the other hand, the refrigerant is condensed and a low pressure is built up in the second driving heat exchanger (E2). In such a state, the sixth, seventh, eighth, eleventh and twelfth solenoid valves (SV-6, SV-7, SV-8, SV-11, SV-12) are opened and the fourth, fifth, ninth, tenth and thirteenth solenoid valves (SV-4, SV-5, SV-9, SV-10, SV-13) are closed.

Figure 20:
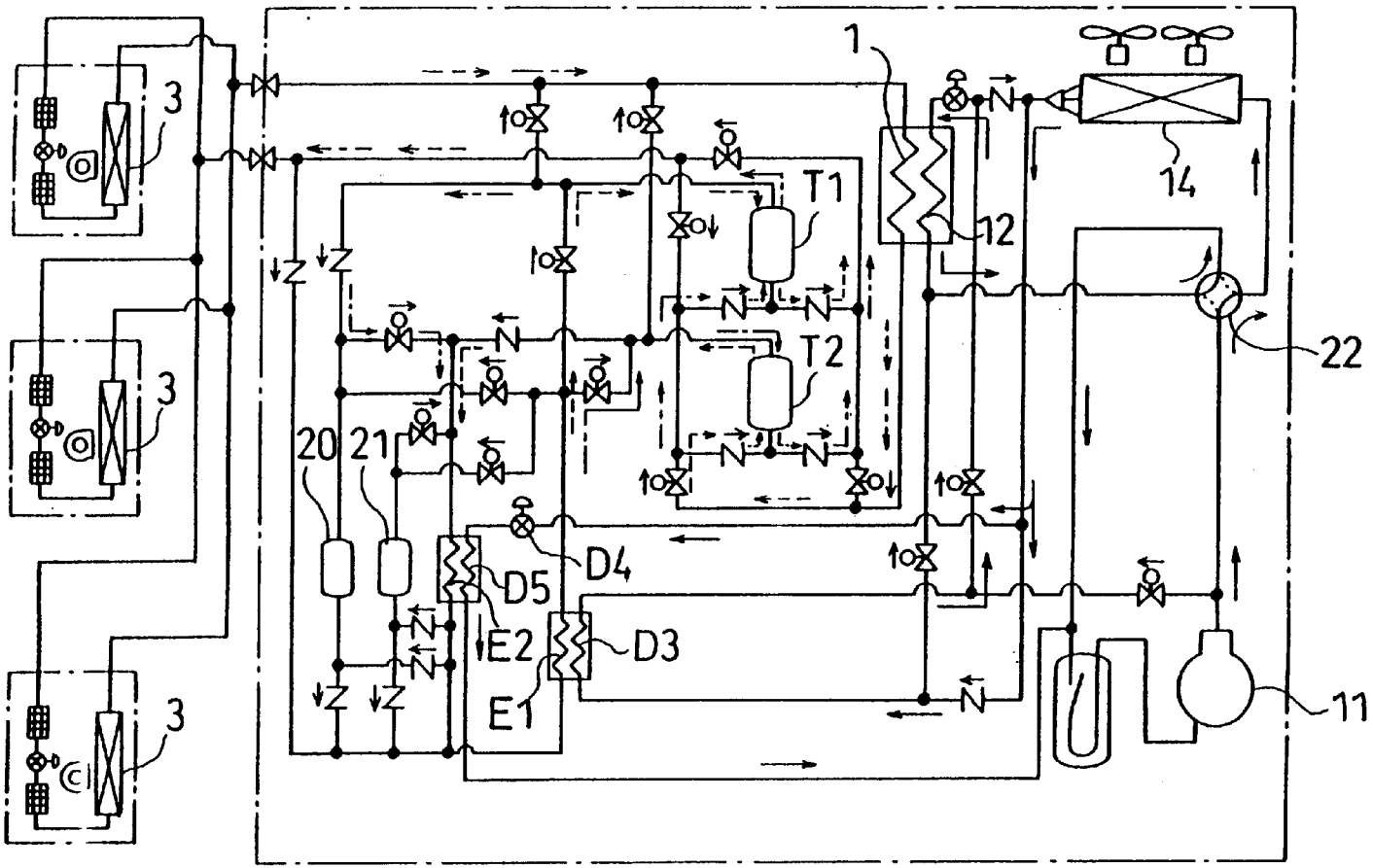
FIG. 20 is a diagram showing a cooling running operation in the tenth embodiment.
Figure 21:
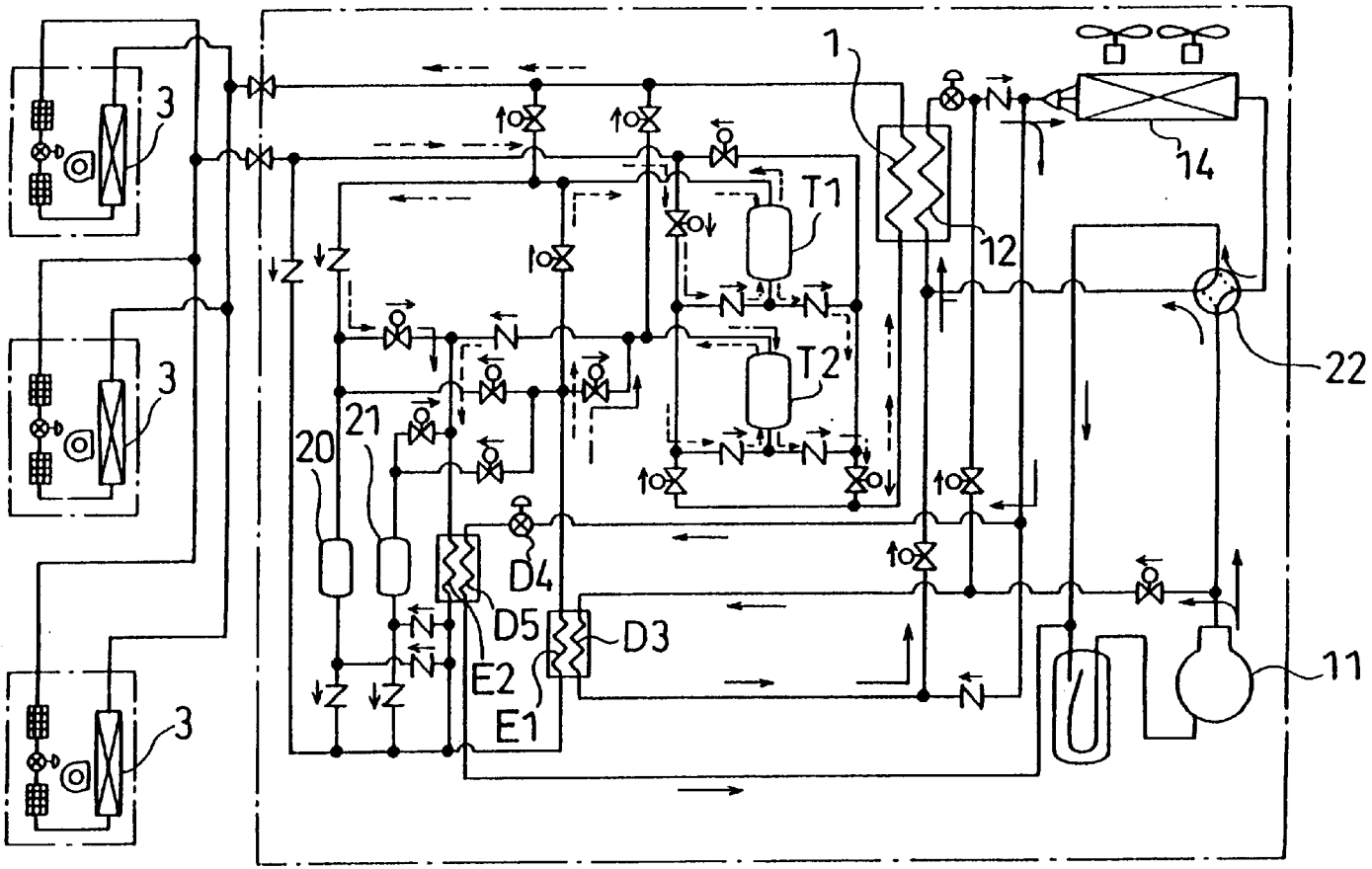
FIG. 21 is a diagram showing a heating running state in the tenth embodiment.

As a result, a high pressure is applied to the first tank (T1) and a low pressure is applied to the second tank (T2), and the operation of draining the liquid refrigerant from the first tank (T1) and the operation of recovering the liquid refrigerant into the second tank (T2) are simultaneously performed, thereby circulating the refrigerant in the secondary refrigerant circuit (B) as indicated by the broken-line arrows in FIG. 20. The gaseous refrigerant, which has been recovered from the second tank (T2) into the second driving heat exchanger (E2), is condensed and reserved in the second reservoir (21). The pressure of the first reservoir (20) is equalized with that of the first driving heat exchanger (E1), thereby supplying the liquid refrigerant to the first driving heat exchanger (E1).

After this refrigerant circulation operation has been performed for a predetermined time, the respective solenoid valves are switched, thereby opening the sixth, seventh, ninth, tenth and thirteenth solenoid valves (SV-6, SV-7, SV-9, SV-10, SV-13) and closing the fourth, fifth, eighth, eleventh and twelfth solenoid valves (SV-4, SV-5, SV-8, SV-11, SV-12).

As a result, a high pressure is applied to the second tank (T2) and a low pressure is applied to the first tank (T1), and the operation of draining the liquid refrigerant from the second tank (T2) and the operation of recovering the liquid refrigerant into the first tank (T1) are simultaneously performed, thereby circulating the refrigerant in the secondary refrigerant circuit (B) as indicated by the one-dot-chain arrows in FIG. 20. The gaseous refrigerant, which has been recovered from the first tank (T1) into the second driving heat exchanger (E2), is condensed and reserved in the first reservoir (20). The pressure of the second reservoir (21) is equalized with that of the first driving heat exchanger (E1) , thereby supplying the liquid refrigerant to the first driving heat exchanger (E1).

In such a manner, a tank draining the liquid refrigerant and a tank recovering the liquid refrigerant are alternately switched, thereby continuously performing the room cooling running.

Moreover, since the liquid refrigerant condensed in the second driving heat exchanger (E2) is recovered into the reservoirs (20, 21), a large heat exchange area can be secured for the second driving heat exchanger (E2) and the quantity of heat exchanged with the cooling heat exchanger (D5) is increased. As a result, the performance of the entire system can be improved.

On the other hand, during the room heating running, the four-position selector valve (D2) is switched to the direction indicated by the broken lines, the first solenoid valve (SV-1) is closed and the second and the third solenoid valves (SV-2, SV-3) are opened in the primary refrigerant circuit (A). Then, as indicated by the solid-line arrows in FIG. 21, a part of the refrigerant discharged from the compressor (11) is supplied to the heat exchanger (12) on the primary heat source side and the other refrigerant is supplied to the heating heat exchanger (D3).

The refrigerant supplied to the heat exchanger (12) on the primary heat source side exchanges heat with the heat exchanger (1) on the secondary heat source side and is condensed. Thereafter, a part of the refrigerant is supplied to the outdoor heat exchanger (14) and the other part is supplied to the cooling heat exchanger (D5). The refrigerant supplied to the outdoor heat exchanger (14) exchanges heat with the outdoor air, is evaporated and then is recovered into the compressor (11). The refrigerant supplied to the cooling heat exchanger (D5) extracts heat from the second driving heat exchanger (E2), is evaporated and then returns to the compressor (11).

On the other hand, the refrigerant supplied to the heating heat exchanger (D3) applies heat to the first driving heat exchanger (E1) and is condensed. Thereafter, in the heat exchanger (12) on the primary heat source side, the refrigerant applies heat to the refrigerant in the heat exchanger (1) on the secondary heat source side and is excessively cooled. Then, the refrigerant is evaporated in the outdoor heat exchanger (14) and the cooling heat exchanger (D5) so as to return to the compressor (11).

As a result of the refrigerant circulation operation, the refrigerant is evaporated and a high pressure is built up in the first driving heat exchanger (E1). On the other hand, the refrigerant is condensed and a low pressure is built up in the second driving heat exchanger (E2). In such a state, the fourth, fifth, eighth, eleventh and twelfth solenoid valves (SV-4, SV-5, SV-8, SV-11, SV-12) are opened and the sixth, seventh, ninth, tenth and thirteenth solenoid valves (SV-6, SV-7, SV-9, SV-10, SV-13) are closed. As a result, a high pressure is applied to the first tank (T1) and a low pressure is applied to the second tank (T2), and the operation of draining the liquid refrigerant from the first tank (T1) and the operation of recovering the liquid refrigerant into the second tank (T2) are simultaneously performed, thereby circulating the refrigerant in the secondary refrigerant circuit (B) as indicated by the broken-line arrows in FIG. 21.

After this refrigerant circulation operation has been performed for a predetermined time, the respective solenoid valves are switched, thereby opening the fourth, fifth, ninth, tenth and thirteenth solenoid valves (SV-4, SV-5, SV-9, SV-10, SV-13) and closing the sixth, seventh, eighth, eleventh and twelfth solenoid valves (SV-6, SV-7, SV-8, SV-9, SV-11, SV-12). As a result, a high pressure is applied to the second tank (T2) and a low pressure is applied to the first tank (T1), and the operation of draining the liquid refrigerant from the second tank (T2) and the operation of recovering the liquid refrigerant into the first tank (T1) are simultaneously performed, thereby circulating the refrigerant in the secondary refrigerant circuit (B) as indicated by the one-dot-chain arrows in FIG. 21.

A tank draining the liquid refrigerant and a tank recovering the liquid refrigerant are alternately switched, thereby continuously performing the room heating running. During this heating running, the quantity of heat exchanged between the second driving heat exchanger (E2) and the cooling heat exchanger (D5) can be increased and the performance of the entire system can be improved by recovering the liquid refrigerant into the reservoirs (20, 21).

Thus, in this embodiment, since the liquid refrigerant condensed in the outdoor heat exchanger (14) can be cooled in the heating heat exchanger (D3) to reach an excessively cooled state during the room cooling running, a large quantity of heat exchanged between the heat exchanger (12) on the primary heat source side and the heat exchanger (1) on the secondary heat source side can be secured, and the performance of the entire system can be improved.

(Eleventh Embodiment)

Figure 22:
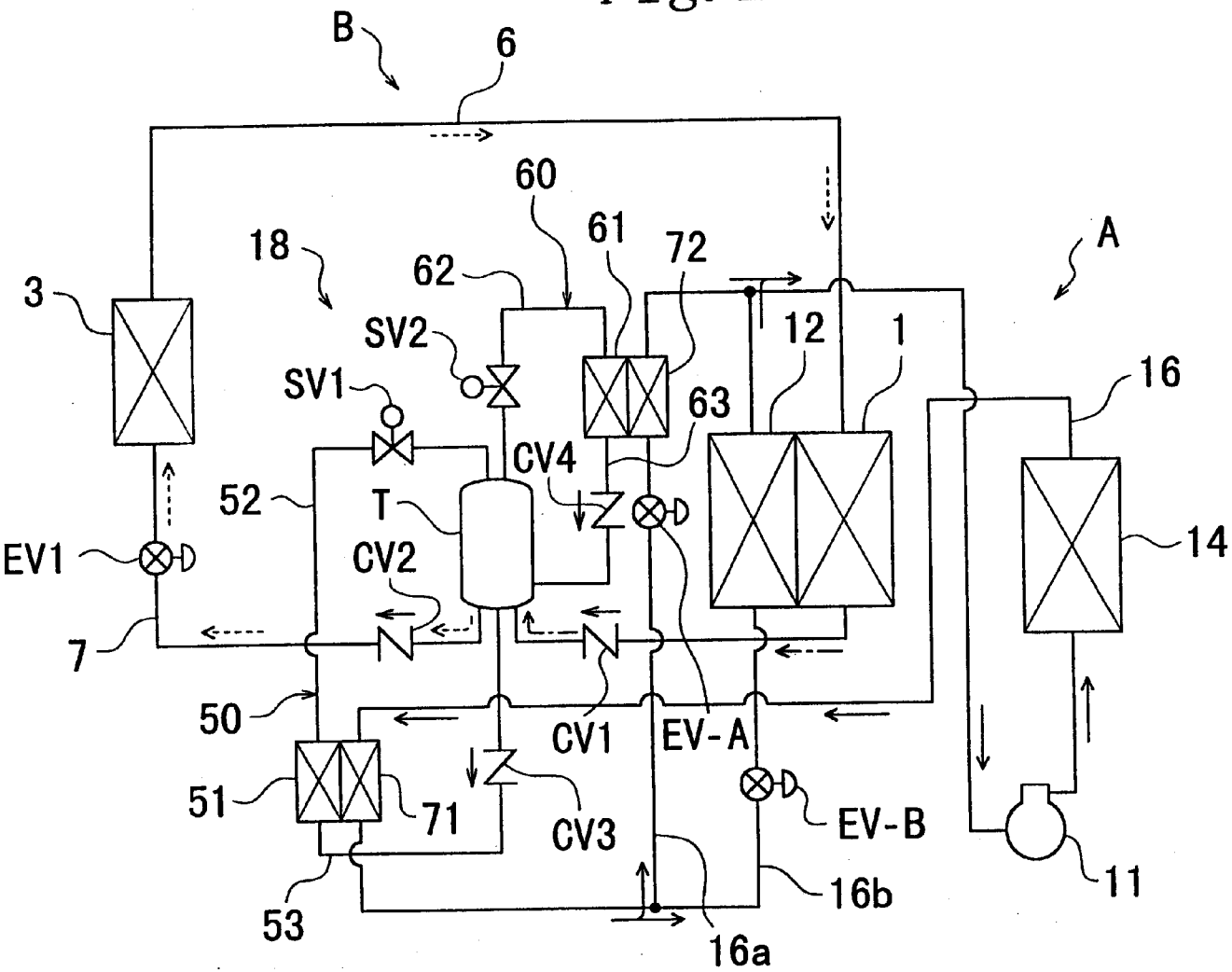
FIG. 22 is a diagram, corresponding to FIG. 1, in the eleventh embodiment.

Next, the eleventh embodiment of the present invention will be described with reference to FIG. 22.

This embodiment provides a pressurizing circuit (50) and a pressure reducing circuit (60) for a pressurizing/pressure-reducing mechanism (18) and is applied to an air conditioning system exclusively used for cooling.

First, the secondary refrigerant circuit (B) will be described.

In the secondary refrigerant circuit (B), an indoor heat exchanger (3) and a heat exchanger (1) on the secondary heat source side are connected to each other through a gas pipe (6) and a liquid pipe (7).

A tank (T) is connected to the liquid pipe (7). A first check valve (CV1) allowing only the liquid refrigerant to flow from the heat exchanger (1) on the secondary heat source side to the tank (T) is provided between the tank (T) and the heat exchanger (1) on the secondary heat source side in the liquid pipe (7). A second check valve (CV2) allowing only the liquid refrigerant to flow from the tank (T) to the indoor heat exchanger (3) is provided between the tank (T) and the indoor heat exchanger (3) in the liquid pipe (7). An indoor electrically motorized expansion valve (EV1) is further provided between the second check valve (CV2) and the indoor heat exchanger (3) in the liquid pipe (7).

The pressurizing circuit (50) and the pressure reducing circuit (60) are connected to the tank (T). First, the pressurizing circuit (50) will be described.

The pressurizing circuit (50) includes a circulating evaporator (51). The circulating evaporator (51) is disposed at a position lower than the installation position of the tank (T). The circulating evaporator (51) is connected to the upper part of the tank (T) through a gas supply pipe (52) and to the lower part of the tank (T) through a liquid recovery pipe (53).

A first solenoid valve (SV1), which is opened in applying a high pressure to the inside of the tank (T), is provided for the gas supply pipe (52). A third check valve (CV3) allowing only the refrigerant to flow from the tank (T) into the circulating evaporator (51) is provided for the liquid recovery pipe (53).

Next, the pressure reducing circuit (60) will be described.

The pressure reducing circuit (60) includes a circulating condenser (61). The circulating condenser (61) is disposed at a position higher than the installation position of the tank (T). The circulating condenser (61) is connected to the upper part of the tank (T) through a gas recovery pipe (62) and to the lower part of the tank (T) through a liquid supply pipe (63).

A second solenoid valve (SV2), which is opened in applying a low pressure to the inside of the tank (T), is provided for the gas recovery pipe (62). A fourth check valve (CV4) allowing only the refrigerant to flow from the circulating condenser (61) to the tank (T) is provided for the liquid supply pipe (63).

Next, the primary refrigerant circuit (A) for exchanging heat with the secondary refrigerant circuit (B) will be described.

The primary refrigerant circuit (A) is constituted by connecting: a compressor (11); an outdoor heat exchanger (14) for exchanging heat with the outdoor air; a heating heat exchanger (71) that can exchange heat with the circulating evaporator (51); a cooling heat exchanger (72) that can exchange heat with the circulating condenser (61); and a heat exchanger (12) on the primary heat source side that can exchange heat with the heat exchanger (1) on the secondary heat source side to each other through a refrigerant pipe (16).

Specifically, the outdoor heat exchanger (14) and the heating heat exchanger (71) are connected in this order to the outlet side of the compressor (11). The liquid side of the heating heat exchanger (71) is branched into a first branch pipe (16*a*) and a second branch pipe (16*b*). The first branch pipe (16*a*) is connected to the cooling heat exchanger (72) and the second branch pipe (16*b*) is connected to the heat exchanger (12) on the primary heat source side. A first outdoor electrically motorized expansion valve (EV-A) and a second outdoor electrically motorized expansion valve (EV-B) are provided for the first branch pipe (16*a*) and the second branch pipe (16*b*), respectively. The gas sides of the cooling heat exchanger (72) and the heat exchanger (12) on the primary heat source side are combined with each other and connected to the inlet side of the compressor (11).

In this embodiment, the condensing temperature in the circulating condenser (61) is set lower than the condensing temperature in the heat exchanger (1) on the secondary heat source side. Specifically, the first branch pipe (16*a*) and the second branch pipe (16*b*) have respectively different pipe diameters, and the flow rate of the first branch pipe (16*a*) is set smaller than the flow rate of the second branch pipe (16*b*) by a predetermined ratio. On the other hand, the heat exchange area between the cooling heat exchanger (72) and the circulating condenser (61) is set smaller than the heat exchange area between the heat exchanger (12) on the primary heat source side and the heat exchanger (1) on the secondary heat source side, and the ratio is set smaller than the above-described predetermined ratio.

Specifically, for example, if the ratio of the flow rate of the first branch pipe (16*a*) to the flow rate of the second branch pipe (16*b*) is 1:10, then the ratio of the heat exchange area between the cooling heat exchanger (72) and the circulating condenser (61) to the heat exchange area between the heat exchanger (12) on the primary heat source side and the heat exchanger (1) on the secondary heat source side is set at 2:10. Thus, in respect of the power as a heat exchanger with respect to the flow rate of a refrigerant, the circulating condenser (61) is made superior to the heat exchanger (1) on the secondary heat source side. As a result, the condensing temperature of the circulating condenser (61) becomes lower than the condensing temperature of the heat exchanger (1) on the secondary heat source side.

Next, the room cooling running operation in this embodiment will be described.

During the cooling running, the compressor (11) is driven in the primary refrigerant circuit (A). As indicated by the solid-line arrows in FIG. 22, a high-temperature, high-pressure gaseous refrigerant discharged from the compressor (11) sequentially flows through the outdoor heat exchanger (14) and the heating heat exchanger (71), exchanges heat with the outdoor air and the refrigerant in the circulating evaporator (51) and is condensed, thereby applying heat to the refrigerant in the circulating evaporator (51). Thereafter, the liquid refrigerant is distributed into the respective branch pipes (16*a*, 16*b*) and the pressure of the refrigerant is reduced in the respective outdoor electrically motorized expansion valves (EV-A, EV-B). Then, the refrigerant flows through the cooling heat exchanger (72) and the heat exchanger (12) on the primary heat source side. Here, the liquid refrigerant exchanges heat with the refrigerant in the circulating condenser (61) and with the refrigerant in the heat exchanger (1) on the secondary heat source side and is evaporated, thereby extracting heat from the refrigerant in the circulating condenser (61) and the refrigerant in the heat exchanger (1) on the secondary heat source side. Thereafter, the gaseous refrigerants, which have flowed through the cooling heat exchanger (72) and the heat exchanger (12) on the primary heat source side, are combined to return to the compressor (11). This circulation operation is repeated.

On the other hand, in the secondary refrigerant circuit (B), a refrigerant evaporation operation and a refrigerant condensation operation are caused in the circulating evaporator (51) and in the circulating condenser (61), respectively, as a result of the above-described heat exchange operation. And, a high pressure and a low pressure are respectively generated in the circulating evaporator (51) and in the circulating condenser (61).

In such a state, first, the first solenoid valve (SV1) is opened and the second solenoid valve (SV2) is closed. As a result, the high pressure in the circulating evaporator (51) is applied to the inside of the tank (T) through the gas supply pipe (52), the water level of the liquid refrigerant in the tank (T) is pushed down and the liquid refrigerant is pushed out into the liquid pipe (7) as indicated by the broken-line arrows in FIG. 22. The pushed-out liquid refrigerant flows through the liquid pipe (7) toward the indoor heat exchanger (3). The pressure of the liquid refrigerant is reduced in the indoor electrically motorized expansion valve (EV1). Then, in the indoor heat exchanger (3), the liquid refrigerant exchanges heat with the indoor air, and is evaporated, thereby cooling the indoor air. The evaporated gaseous refrigerant flows through the gas pipe (6) to the heat exchanger (1) on the secondary heat source side, exchanges heat with the heat exchanger (12) on the primary heat source side, and is condensed.

After this operation has been performed, the first solenoid valve (SV1) is closed and the second solenoid valve (SV2) is opened. As a result, the low pressure in the circulating condenser (61) is applied to the inside of the tank (T) through the gas recovery pipe (62). The condensing temperature of the circulating condenser (61) is lower than the condensing temperature of the heat exchanger (1) on the secondary heat source side and the internal pressure of the circulating condenser (61) is lower than the internal pressure of the heat exchanger (1) on the secondary heat source side. Thus, the internal pressure of the tank (T) becomes lower than the internal pressure of the heat exchanger (1) on the secondary heat source side. As indicated by the one-dot-chain arrows in FIG. 22, the liquid refrigerant in the heat exchanger (1) on the secondary heat source side is recovered into the tank (T) through the liquid pipe (7).

In this case, the gaseous refrigerant in the upper part in the tank (T) is sucked into the circulating condenser (61) and then condensed to be a liquid refrigerant, which is recovered into the tank (T) through the liquid supply pipe (63). When the pressurizing operation is started by the above-described pressurizing circuit (50) from such a state, the pressure in the entire pressurizing circuit (50) is equalized. As a result, a part of the liquid refrigerant in the tank (T) is recovered into the circulating evaporator (51) and is used as a refrigerant for generating a high pressure.

By alternately repeating the pressurizing operation by the pressurizing circuit (50) and the pressure reducing operation by the pressure reducing circuit (60), the liquid refrigerant is pushed out from the tank (T) during the pressurizing operation, recovered into the tank (T) during the pressure reducing operation and circulated in the secondary refrigerant circuit (B), thereby cooling the indoor air.

Thus, in this embodiment, since the liquid refrigerant in the heat exchanger (1) on the secondary heat source side is recovered by utilizing the suction force generated in the tank (T), it is no longer necessary to dispose the tank (T) at a position lower than that of the heat exchanger (1) on the secondary heat source side. As a result, the restriction on the installation positions of units can be alleviated and the universality can be improved.

(Twelfth Embodiment)

Next, the twelfth embodiment of the present invention will be described. It is noted that only the difference from the foregoing eleventh embodiment will be described hereinafter.

The refrigerant circuit of this embodiment is applied to an air conditioning system exclusively used for heating. The arrangement of the primary refrigerant circuit (A) and the arrangement of a check valve provided for the liquid pipe (7) are different from the counterparts of the eleventh embodiment described above.

Figure 23:
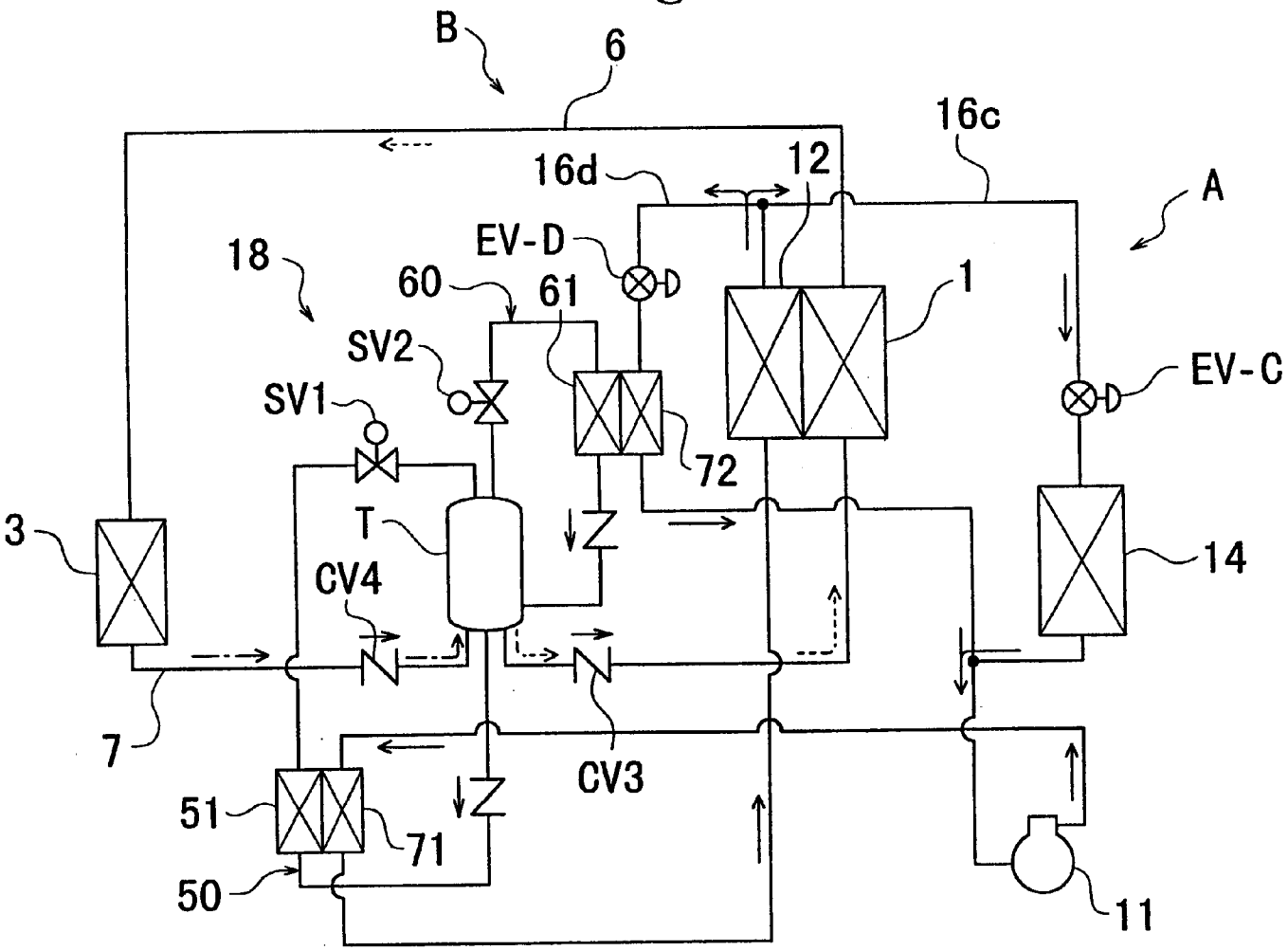
FIG. 23 is a diagram, corresponding to FIG. 1, in the twelfth embodiment.

Specifically, as shown in FIG. 23, the heating heat exchanger (71) and the heat exchanger (12) on the primary heat source side are connected in this order to the outlet side of the compressor (11) in the primary refrigerant circuit (A). The liquid side of the heat exchanger (12) on the primary heat source side is branched into a first branch pipe (16*c*) and a second branch pipe (16*d*). The first branch pipe (16*c*) is connected to the outdoor heat exchanger (14) and the second branch pipe (16*d*) is connected to the cooling heat exchanger (72). A first outdoor electrically motorized expansion valve (EV-C) and a second outdoor electrically motorized expansion valve (EV-D) are provided for the first branch pipe (16*c*) and the second branch pipe (16*d*), respectively. The gas sides of the outdoor heat exchanger (14) and the cooling heat exchanger (72) are combined with each other and connected to the inlet side of the compressor (11).

On the other hand, a first check valve (CV3) allowing only the liquid refrigerant to flow from the tank (T) into the heat exchanger (1) on the secondary heat source side is provided between the tank (T) and the heat exchanger (1) on the secondary heat source side in the liquid pipe (7) in the secondary refrigerant circuit (B). A second check valve (CV4) allowing only the liquid refrigerant to flow from the indoor heat exchanger (3) into the tank (T) is provided between the tank (T) and the indoor heat exchanger (3) in the liquid pipe (7).

It is noted that the pressurizing circuit (50) and the pressure reducing circuit (60) of this embodiment are the same as those of the eleventh embodiment described above.

By serially connecting the heating heat exchanger (71) for exchanging heat with the circulating evaporator (51) to the heat exchanger (12) on the primary heat source side for exchanging heat with the heat exchanger (1) on the secondary heat source side in this manner, the evaporating temperature in the circulating evaporator (51) becomes higher than the evaporating temperature in the heat exchanger (1) on the secondary heat source side. That is to say, owing to the difference in evaporating temperatures, the internal pressure of the circulating evaporator (51) becomes higher than the internal pressure of the heat exchanger (1) on the secondary heat source side.

Next, the room heating running operation in this embodiment will be described.

During the heating running, the compressor (11) is driven in the primary refrigerant circuit (A). As indicated by the solid-line arrows in FIG. 23, a high-temperature, high-pressure gaseous refrigerant discharged from the compressor (11) sequentially flows through the heating heat exchanger (71) and the heat exchanger (12) on the primary heat source side, exchanges heat with the refrigerant in the circulating evaporator (51) and the refrigerant in the heat exchanger (1) on the secondary heat source side, and is condensed, thereby applying heat to the refrigerant in the circulating evaporator (51) and the refrigerant in the heat exchanger (1) on the secondary heat source side. Thereafter, the liquid refrigerant is distributed into the respective branch pipes (16*c*, 16*d*) and the pressure of the refrigerant is reduced in the respective outdoor electrically motorized expansion valves (EV-C, EV-D). Then, the refrigerant flows through the cooling heat exchanger (72) and the outdoor heat exchanger (14). The liquid refrigerant exchanges heat with the circulating condenser (61) in the cooling heat exchanger (72) and with the outdoor air in the outdoor heat exchanger (14) and is evaporated, thereby extracting heat from the refrigerant in the circulating condenser (61). Thereafter, the gaseous refrigerants, which have flowed through the cooling heat exchanger (72) and the outdoor heat exchanger (14), are combined to return to the compressor (11). This circulation operation is repeated.

On the other hand, in the secondary refrigerant circuit (B), the switching operations of the respective solenoid valves (SV1, SV2) are performed in the pressurizing circuit (50) and the pressure reducing circuit (60) in the same way as in the eleventh embodiment described above, thereby alternately switching a state where a high pressure is applied to the inside of the tank (T) and a state where a low pressure is applied to the inside of the tank (T). In the state where a high pressure is applied to the tank (T), since the evaporating temperature of the circulating evaporator (51) is higher than the evaporating temperature of the heat exchanger (1) on the secondary heat source side as described above, the internal pressure of the circulating evaporator (51) becomes higher than the internal pressure of the heat exchanger (1) on the secondary heat source side. Thus, a high pressure is built up in the tank (T). As indicated by the broken-line arrows in FIG. 23, the liquid refrigerant pushed out from the tank (T) exchanges heat with the heat exchanger (12) on the primary heat source side and is evaporated in the heat exchanger (1) on the secondary heat source side. The evaporated gaseous refrigerant flows into the indoor heat exchanger (3) through the gas pipe (6), exchanges heat with the indoor air and is condensed, thereby heating the indoor air.

In the state where a low pressure is applied to the inside of the tank (T), the liquid refrigerant in the indoor heat exchanger (3) is recovered into the tank (T) through the liquid pipe (7) as indicated by the one-dot-chain arrows in FIG. 23. In this operation, during the pressure reducing operation of the pressure reducing circuit (60), the gaseous refrigerant sucked into the circulating condenser (61) is condensed to be a liquid refrigerant, which is recovered into the tank (T) through the liquid supply pipe (63). On the other hand, during the pressurizing operation of the pressurizing circuit (50), a part of the liquid refrigerant in the tank (T) is recovered into the circulating evaporator (51) and is used as a refrigerant for generating a high pressure. This operation is repeated, thereby heating the indoor air.

Thus, in this embodiment, since the liquid refrigerant in the indoor heat exchanger (3) is recovered by utilizing the suction force generated in the tank (T), it is no longer necessary to dispose the tank (T) at a position lower than that of the indoor heat exchanger (3). As a result, the restriction on the installation positions of units can be alleviated and the universality can be improved.

(Thirteenth Embodiment)

Next, the thirteenth embodiment of the present invention will be described. It is noted that only the difference from the foregoing eleventh embodiment will also be described hereinafter.

The refrigerant circuit of this embodiment is applied to an air conditioning system exclusively used for cooling. The primary refrigerant circuit (A) is the same as that of the eleventh embodiment described above. Thus, the description thereof will be omitted herein.

And, the secondary refrigerant circuit (B) of this embodiment is characterized in that two tanks (T1, T2) are provided in the same way as in the fifth embodiment described above and that the respective tanks (T1, T2) are connected in parallel to the pressurizing circuit (50) and the pressure reducing circuit (60).

Figure 24:
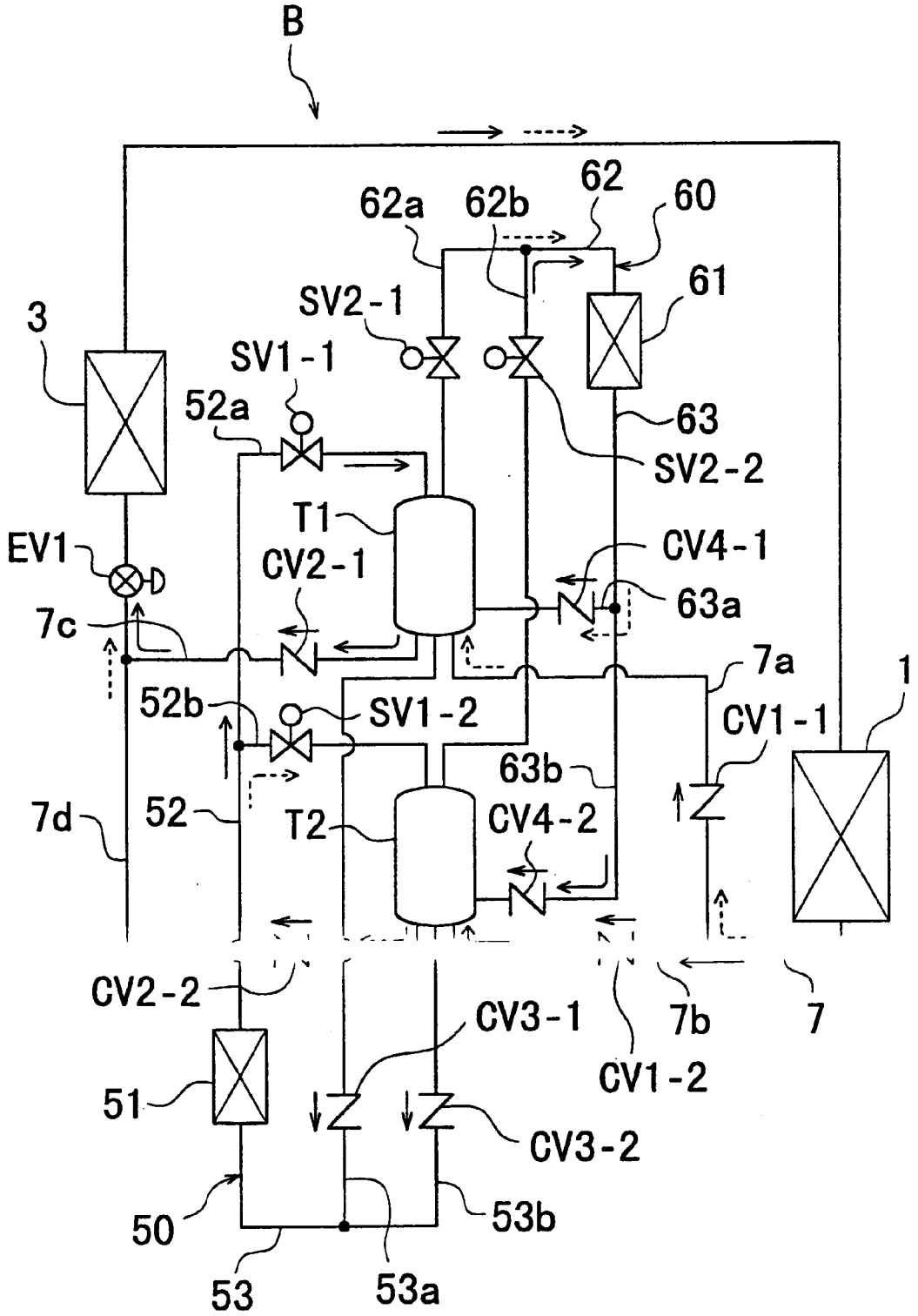
FIG. 24 is a diagram showing a secondary refrigerant circuit in the thirteenth embodiment.

Specifically, as shown in FIG. 24, the gas supply pipe (52) of the pressurizing circuit (50) is branched into branch pipes (52*a*, 52*b*), which are connected to the upper ends of the respective tanks (T1, T2) and are provided with solenoid valves (SV1-1, SV1-2), respectively. The liquid recovery pipe (53) of the pressurizing circuit (50) is branched into branch pipes (53*a*, 53*b*), which are connected to the lower ends of the respective tanks (T1, T2) and are provided with check valves (CV3-1, CV3-2), respectively.

On the other hand, the gas recovery pipe (62) of the pressure reducing circuit (60) is branched into branch pipes (62*a*, 62*b*), which are connected to the upper ends of the respective tanks (T1, T2) and are provided with solenoid valves (SV2-1, SV2-2), respectively. The liquid supply pipe (63) of the pressure reducing circuit (60) is branched into branch pipes (63*a*, 63*b*), which are connected to the lower ends of the respective tanks (T1, T2) and are provided with check valves (CV4-1, CV4-2), respectively.

The liquid pipe (7) coupled to the heat exchanger (1) on the secondary heat source side is branched into branched liquid pipes (7*a*, 7*b*), which are connected to the lower ends of the respective tanks (T1, T2) and are provided with check valves (CV1-1, CV1-2). The liquid pipe (7) coupled to the indoor heat exchanger (3) is branched into branched liquid pipes (7*c*, 7*d*), which are connected to the lower ends of the respective tanks (T1, T2) and are provided with check valves (CV2-1, CV2-2).

In this embodiment, while the secondary refrigerant circuit (B) is operated during the cooling running, the operations of opening one of the solenoid valves (SV1-1, SV1-2) provided for the respective branch pipes (52*a*, 52*b*) of the pressurizing circuit (50) and closing the other are alternately repeated. In addition, the operations of opening one of the solenoid valves (SV2-1, SV2-2) provided for the respective branch pipes (62*a*, 62*b*) of the pressure reducing circuit (60) and closing the other are also alternately repeated. In such a manner, the operations of making one tank push out the liquid refrigerant toward the indoor heat exchanger (3) and making the other tank recover the liquid refrigerant from the heat exchanger (1) on the secondary heat source side are repeated.

Specifically, in the case where the solenoid valve (SV1-1) of the branch pipe (52*a*) in the pressurizing circuit (50) is opened and the solenoid valve (SV2-2) of the branch pipe (62*a*) in the pressure reducing circuit (60) is also opened, the upper tank (T1) pushes out the liquid refrigerant toward the indoor heat exchanger (3) and the lower tank (T2) recovers the liquid refrigerant from the heat exchanger (1) on the secondary heat source side as indicated by the solid lines in FIG. 24. Conversely, in the case where the solenoid valve (SV1-2) of the branch pipe (52*b*) in the pressurizing circuit (50) is opened and the solenoid valve (SV2-1) of the branch pipe (62*a*) in the pressure reducing circuit (60) is also opened, the lower tank (T2) pushes out the liquid refrigerant toward the indoor heat exchanger (3) and the upper tank (T1) recovers the liquid refrigerant from the heat exchanger (1) on the secondary heat source side as indicated by the broken-line arrows in FIG. 24. By alternately repeating these operations, the room cooling is performed continuously.

(Fourteenth Embodiment)

Next, the fourteenth embodiment of the present invention will be described. It is noted that only the difference from the foregoing thirteenth embodiment will be described hereinafter.

The refrigerant circuit of this embodiment is applied to an air conditioning system exclusively used for heating. The primary refrigerant circuit (A) is the same as that of the thirteenth embodiment described above. Thus, the description thereof will be omitted herein. Also, the secondary refrigerant circuit (B) is different from that of the thirteenth embodiment in the arrangement of the check valve provided for the liquid pipe (7).

Figure 25:
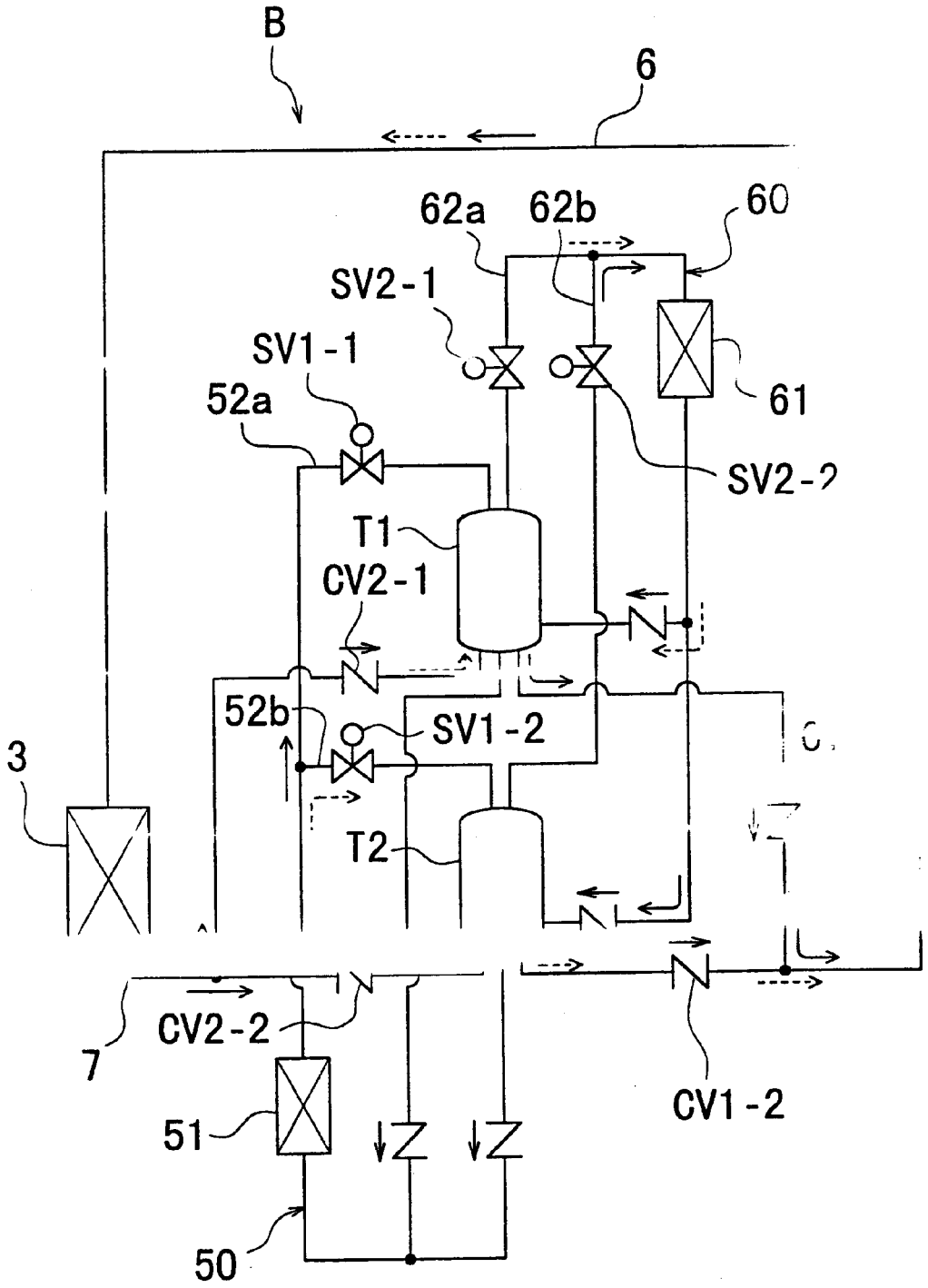
FIG. 25 is a diagram showing a secondary refrigerant circuit in the fourteenth embodiment.

Specifically, as shown in FIG. 25, check valves allowing the refrigerant to flow in different directions are employed as the check valves (CV1-1, CV1-2, CV2-1, CV2-2) provided for the liquid pipe (7).

Thus, during the heating running, the opening/closing operations of the solenoid valves (SV1-1, SV1-2) provided for the respective branch pipes (52*a*, 52*b*) of the pressurizing circuit (50) and the solenoid valves (SV2-1, SV2-2) provided for the respective branch pipes (62*a*, 62*b*) of the pressure reducing circuit (60) are alternately repeated in the same way as in the thirteenth embodiment described above. As a result, the operations of making one tank push out the liquid refrigerant toward the heat exchanger (1) on the secondary heat source side and making the other tank recover the liquid refrigerant from the indoor heat exchanger (3) are alternately repeated (i.e., the state indicated by the solid-line arrows in FIG. 25 and the state indicated by the broken-line arrows therein are alternately repeated) whereby the room heating is performed continuously.

(Fifteenth Embodiment)

Next, the fifteenth embodiment of the present invention will be described. It is noted that only the difference from the foregoing eleventh embodiment will be described hereinafter.

The refrigerant circuit of this embodiment is applied to an air conditioning system exclusively used for cooling. The primary refrigerant circuit (A) is the same as that of the eleventh embodiment described above. Thus, the description thereof will be omitted herein.

Figure 26:
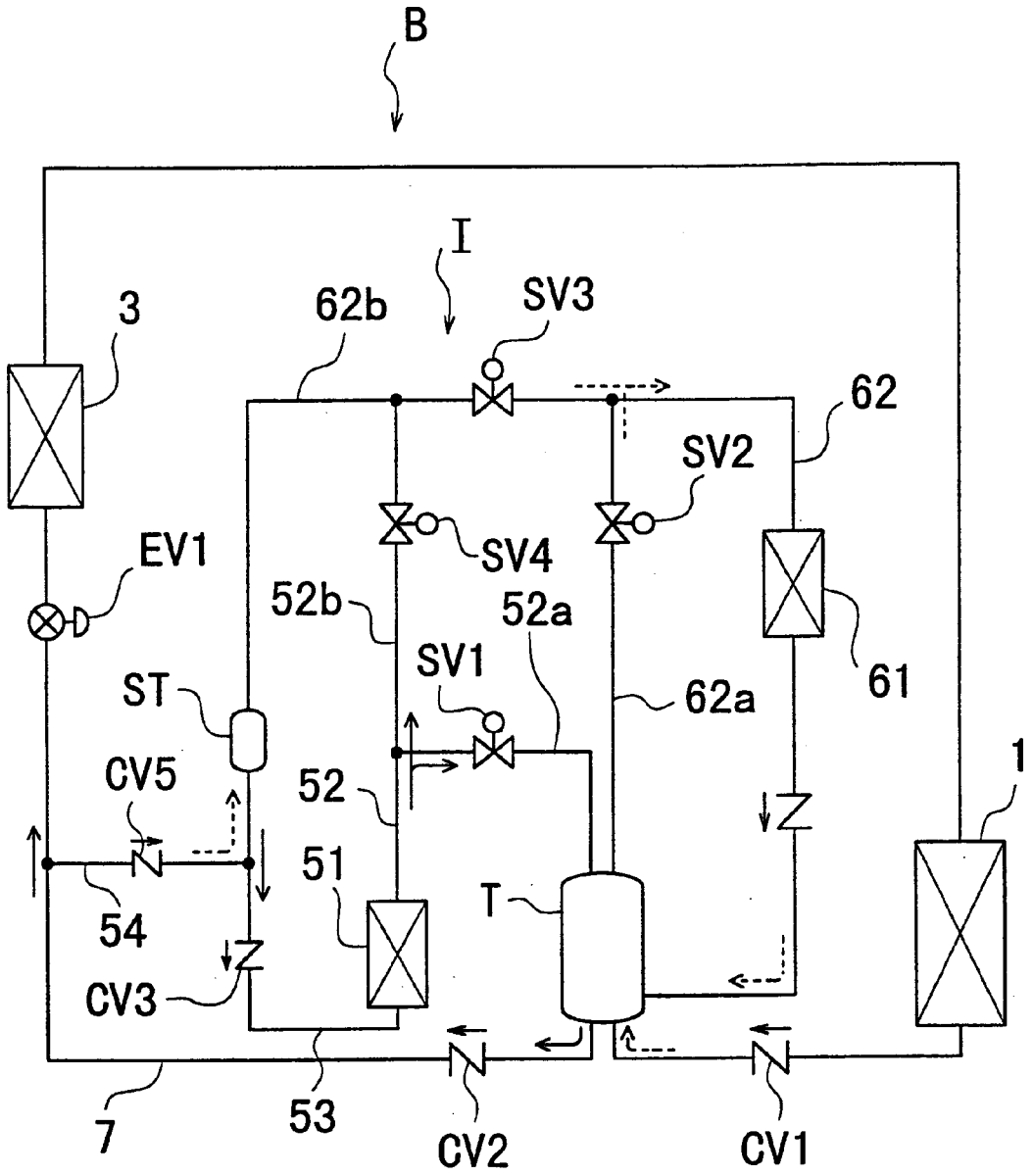
FIG. 26 is a diagram showing a secondary refrigerant circuit in the fifteenth embodiment.

The secondary refrigerant circuit (B) of this embodiment is characterized by including a sub-tank (ST) of a small size, separately from the above-described tank (T) (hereinafter, referred to as a main tank) as shown in FIG. 26, and by temporarily reserving a liquid refrigerant in the sub-tank (ST).

Hereinafter, the circuit configuration of the secondary refrigerant circuit (B) of this embodiment will be described.

A gas recovery pipe (62) coupled to the circulating condenser (61) is branched into branch pipes (62*a*, 62*b*), one of which is connected to the upper end of the main tank (T) via the second solenoid valve (SV2) and the other of which is connected to the upper end of the sub-tank (ST) via the third solenoid valve (SV3).

A gas supply pipe (52) coupled to the circulating evaporator (51) is branched into branch pipes (52*a*, 52*b*), one of which is connected to the upper end of the main tank (T) via the first solenoid valve (SV1) and the other of which is connected to the branch pipe (62*b*) via the fourth solenoid valve (SV4).

The sub-tank (ST) is disposed at a position higher than that of the circulating evaporator (51). The lower end of the circulating evaporator (51) and the lower part of the sub-tank (ST) are connected to each other through a liquid recovery pipe (53). A check valve (CV3) allowing only the refrigerant to flow from the sub-tank (ST) into the circulating evaporator (51) is provided for the liquid recovery pipe (53).

The liquid recovery pipe (53) and the liquid pipe (7) are connected to each other through a liquid suction pipe (54) provided with a check valve (CV5) allowing only the liquid refrigerant to flow from the liquid pipe (7) into liquid recovery pipe (53). One end of the liquid suction pipe (54) is connected between the sub-tank (ST) and the check valve (CV3) in the liquid recovery pipe (53) and the other end thereof is connected between the indoor electrically motorized expansion valve (EV1) and the check valve (CV2) in the liquid pipe (7). Selector means (I) for switching the pressure application states to the sub-tank (ST) is constituted in this manner. The other arrangements are the same as those the eleventh embodiment described above.

Next, the room cooling running of this embodiment will be described.

In the primary refrigerant circuit (A), the same operations as those of the eleventh embodiment described above are performed.

In the secondary refrigerant circuit (B), first, the first and the fourth solenoid valves (SV1, SV4) are opened and the second and the third solenoid valves (SV2, SV3) are closed. As a result, the high pressure in the circulating evaporator (51) is applied to the main tank (T) and the pressure in the circulating evaporator (51) is equalized with the pressure in the sub-tank (ST). Consequently, as indicated by the solid-line arrows in FIG. 26, the liquid refrigerant pushed out from the main tank (T) is evaporated in the indoor heat exchanger (3) and then condensed in the heat exchanger (1) on the secondary heat source side. In addition, the liquid refrigerant in the sub-tank (ST) is dripped and supplied to the circulating evaporator (51) through the liquid recovery pipe (53).

Thereafter, the opening/closing operations of the solenoid valves are switched and the first and the fourth solenoid valves (SV1, SV4) are closed while the second and the third solenoid valves (SV2, SV3) are opened. As a result, the low pressure in the circulating condenser (61) is applied to the main tank (T) and the sub-tank (ST) through the respective branch pipes (62*a*, 62*b*) of the gas recovery pipe (62). Consequently, as indicated by the broken-line arrows in FIG.

26, the liquid refrigerant in the heat exchanger (1) on the secondary heat source side is recovered into the main tank (T) through the liquid pipe (7). Also, since a low pressure state is established in the sub-tank (ST), a part of the liquid refrigerant in the liquid pipe (7) is recovered into the sub-tank (ST) through the liquid suction pipe (54). When the solenoid valves are switched again and the pressure in the sub-tank (ST) is equalized with the pressure in the circulating evaporator (51), the liquid refrigerant recovered into the sub-tank (ST) is supplied to the circulating evaporator (51) and functions as a refrigerant for driving. This operation is repeated, thereby cooling the indoor air.

Thus, since the liquid refrigerant is reserved in the sub-tank (ST) and is supplied to the circulating evaporator (51) in this embodiment, it is no longer necessary to dispose the main tank (T) above the circulating evaporator (51) unlike the foregoing embodiments. Thus, the flexibility in the installation positions of the main tank (T) and the circulating evaporator (51) can be increased.

It is noted that if a refrigerant circuit including such a sub-tank to an air conditioning system exclusively used for heating, check valves allowing the refrigerant to flow in different directions are employed as the check valves (CV1, CV2) provided for the liquid pipe (7).

(Sixteenth Embodiment)

Next, the sixteenth embodiment of the present invention will be described. The secondary refrigerant circuit (B) of this embodiment is characterized by including two sub-tanks (ST1, ST2) similar to that of the fifteenth embodiment described above.

Figure 27:
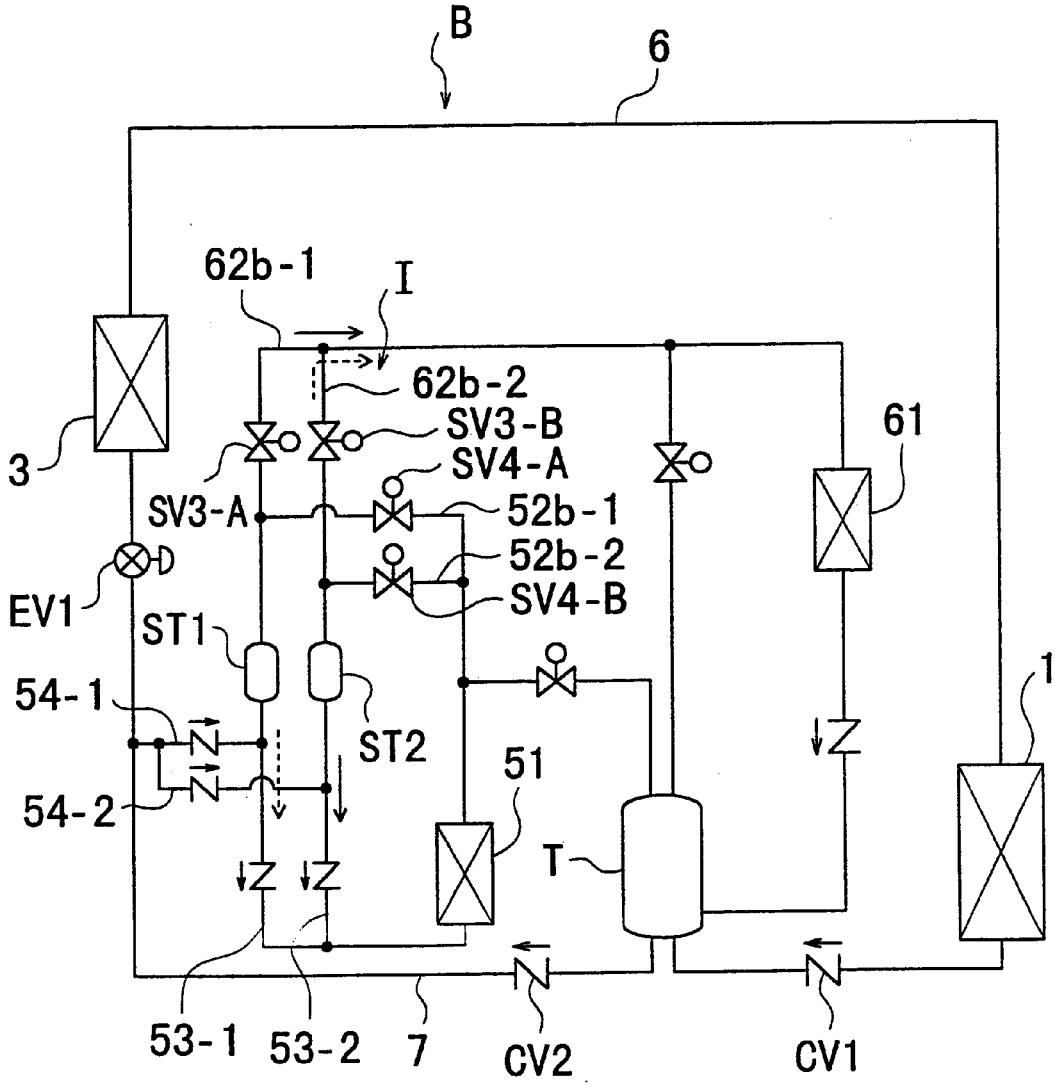
FIG. 27 is a diagram showing a secondary refrigerant circuit in the sixteenth embodiment.

The circuit configuration thereof will be described. As shown in FIG. 27, the respective sub-tanks (ST1, ST2) are connected in parallel to each other in the circulating condenser (61) and the circulating evaporator (51). Specifically, the respective sub-tanks (ST1, ST2) are connected to the circulating condenser (61) through the gas recovery pipes (62*b*-1, 62*b*-2), respectively, and are connected to the circulating evaporator (51) through the gas supply pipes (52*b*-1, 52*b*-2), respectively. Solenoid valves (SV3-A, SV3-B) are provided for the gas recovery pipes (62*b*-1, 62*b*-2), respectively and solenoid valves (SV4-A, SV4-B) are provided for the gas supply pipes (52*b*-1, 52*b*-2), respectively. Liquid suction pipes (54-1, 54-2) are provided for the lower ends of the respective sub-tanks (ST1, ST2) so as to correspond to the liquid recovery pipes (53-1, 53-2) connected to the circulating evaporator (51).

Selector means (I) for switching the pressure application states to the respective sub-tanks (ST1, ST2) is constituted in such a manner. The other arrangements are the same as those of the eleventh embodiment described above. The other arrangements are substantially the same as those of the fifteenth-embodiment described above.

Next, the room cooling running of this embodiment will be described.

In the primary refrigerant circuit (A), the same operations as those of the eleventh embodiment described above are performed.

In the secondary refrigerant circuit (B), states where one of the two sub-tanks (ST1, ST2) is connected to the circulating condenser (61) and the other is connected to the circulating evaporator (51) are alternately and repeatedly established. Specifically, one solenoid valve (SV3-A) of the gas recovery pipe (62*b*) is opened and the other solenoid valve (SV3-B) is closed while one solenoid valve (SV4-B) of the gas supply pipe (52*b*) is opened and the other solenoid valve (SV4-A) is closed. As a result, as indicated by the solid-line arrows in FIG. 27, a state, in which one sub-tank (ST1) communicates with the circulating condenser (61) to recover a part of the liquid refrigerant in the liquid pipe (7) and the other sub-tank (ST2) communicates with the circulating evaporator (51) to drip and supply the liquid refrigerant to the circulating evaporator (51), is established.

When these solenoid valves are switched, a state, in which the other sub-tank (ST2) recovers a part of the liquid refrigerant in the liquid pipe (7) and one sub-tank (ST1) drips and supplies the liquid refrigerant to the circulating evaporator (51), is established as indicated by the broken-line arrows in FIG. 27. These states are alternately and repeatedly established.

Thus, since the operation of recovering the liquid refrigerant into one sub-tank and the operation of supplying the liquid refrigerant from the other sub-tank to the circulating evaporator (51) are performed simultaneously, the number of times by which the solenoid valves are opened/closed for switching the operations of the sub-tanks (ST1, ST2) can be reduced as compared with the case of providing only one sub-tank (ST) as in the fifteenth embodiment described above. As a result, the durability thereof can be improved.

It is noted that if this embodiment is applied to an air conditioning system exclusively used for heating, check valves allowing the refrigerant to flow in different directions are employed as the check valves (CV1, CV2) provided for the liquid pipe (7).

(Seventeenth Embodiment)

Next, the seventeenth embodiment of the present invention will be described. It is noted that only the difference from the foregoing eleventh embodiment will be described hereinafter.

The refrigerant circuit of this embodiment is applied to an air conditioning system of a heat pump type.

First, the primary refrigerant circuit (A) will be described.

Figure 28:
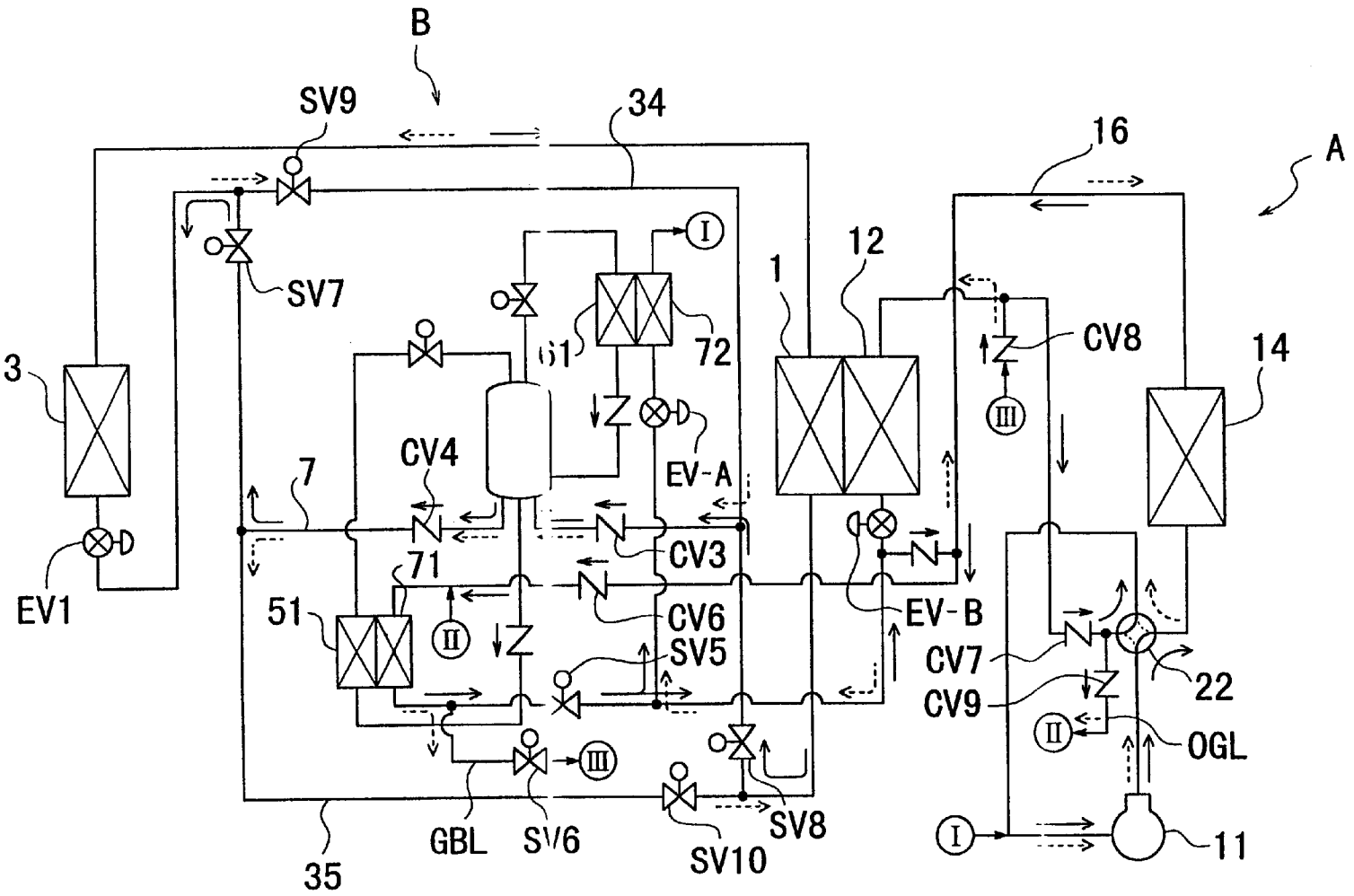
FIG. 28 is a diagram, corresponding to FIG. 1, in the seventeenth embodiment.

As shown in FIG. 28, the primary refrigerant circuit (A) makes the heat exchanger (12) on the primary heat source side heat/cool the heat exchanger (1) on the secondary heat source side. Specifically, the compressor (11), the four-position selector valve (22), the outdoor heat exchanger (14), the heating heat exchanger (71), the outdoor electrically motorized expansion valves (EV-A, EV-B), the cooling heat exchanger (72) and the heat exchanger (12) on the primary heat source side are connected to each other through the refrigerant pipe (16). More specifically, the pipe connected to the heating heat exchanger (71) is branched into two, one of which is connected to the cooling heat exchanger (72) via the first outdoor electrically motorized expansion valve (EV-A) and the other of which is connected to the heat exchanger (12) on the primary heat source side via the second electrically motorized expansion valve (EV-B).

The gas side of the cooling heat exchanger (72) is connected to the inlet side of the compressor (11). The gas side of the heat exchanger (12) on the primary heat source side is switched between the inlet side and the outlet side of the compressor (11) via the four-position selector valve (22). A check valve (CV6) allowing only the refrigerant to flow from the outdoor heat exchanger (14) into heating heat exchanger (71) is provided for the pipe connecting the outdoor heat exchanger (14) and the heating heat exchanger (71) to each other. A check valve (CV7) allowing only the refrigerant to flow from the heat exchanger (12) on the primary heat source side into the four-position selector valve (22) is provided for the pipe connecting the heat exchanger (12) on the primary heat source side and the four-position selector valve (22) to each other.

A fifth solenoid valve (SV5) is provided between the second outdoor electrically motorized expansion valve (EV- B) and the heating heat exchanger (71). The solenoid valve (SV5) and the heating heat exchanger (71), and the heat exchanger (12) on the primary heat source side and the check valve (CV7) are connected through a gaseous refrigerant by-pass pipe (GBL). A sixth solenoid valve (SV6) and a check valve (CV8) allowing only the refrigerant to flow from the heating heat exchanger (71) into the heat exchanger (12) on the primary heat source side are provided for the gaseous refrigerant by-pass pipe (GBL). The check valve (cV7) and the four-position selector valve (22), and the check valve (CV6) and the heating heat exchanger (71) are connected through an outlet gas by-pass pipe (OGL). A check valve (CV9) allowing only the outlet gas to flow toward the heating heat exchanger (71) is provided for the outlet gas by-pass pipe (OGL).

Next, the secondary refrigerant circuit (B) will be described. It is noted that only the difference from the secondary refrigerant circuit (B) of the foregoing eleventh embodiment will be described hereinafter.

As shown in FIG. 28, in the secondary refrigerant circuit (B), a seventh solenoid valve (SV7) opening during the room cooling running and closing during the heating running is provided between the fourth check valve (CV4) of the liquid pipe (7) and the indoor heat exchanger (3), and an eighth solenoid valve (SV8) opening during the room cooling running and closing during the heating running is provided between the third check valve (CV3) of the liquid pipe (7) and the heat exchanger (1) on the secondary heat source side.

One end of a heating liquid pipe (34) on the recovery side is connected between the seventh solenoid valve (SV7) of the liquid pipe (7) and the indoor heat exchanger (3). The other end of the heating liquid pipe (34) on the recovery side is connected between the third check valve (cV3) and the eighth solenoid valve (SV8) in the liquid pipe (7). A ninth solenoid valve (SV9) opening during the heating running and closing during the cooling running is provided for the heating liquid pipe (34) on the recovery side.

One end of a heating liquid pipe (35) on the supply side is connected between the fourth check valve (CV4) and the seventh solenoid valve (SV7) in the liquid pipe (7). The other end of the heating liquid pipe (35) on the supply side is connected between the eighth solenoid valve (SV8) of the liquid pipe (7) and the heat exchanger (1) on the secondary heat source side. A tenth solenoid valve (SV10) opening during the heating running and closing during the cooling running is provided for the heating liquid pipe (35) on the supply side. The other arrangements are the same as those of the eleventh embodiment described above.

Hereinafter, the room cooling and heating running operations will be described.

During the cooling running, firstly, in the primary refrigerant circuit (A), the four-position selector valve (22) is switched to the direction indicated by the solid lines, the fifth solenoid valve (SV5) is opened and the sixth solenoid valve (SV6) is closed. On the other hand, in the secondary refrigerant circuit (B), the seventh solenoid valve (SV7) and the eighth solenoid valve (SV8) are opened and the ninth solenoid valve (SV9) and the tenth solenoid valve (SV10) are closed.

In such a state, as indicated by the solid-line arrows in FIG. 28, a high-temperature, high-pressure gaseous refrigerant discharged from the compressor (11) is condensed in the outdoor heat exchanger (14) and the heating heat exchanger (71) in the primary refrigerant circuit (A). Thereafter, the refrigerant is distributed into the cooling heat exchanger (72) and the heat exchanger (12) on the primary heat source side. The pressure of the refrigerant is reduced in the respective outdoor electrically motorized expansion valves (EV-A, EV-B). Then, in the cooling heat exchanger (72), the refrigerant exchanges heat with the refrigerant in the circulating condenser (61). And in the heat exchanger (12) on the primary heat source side, the refrigerant exchanges heat with the refrigerant in the heat exchanger (1) on the secondary heat source side. Then, these refrigerants are evaporated. The evaporated refrigerants return to the compressor (11). This circulation operation is repeated.

On the other hand, in the secondary refrigerant circuit (B), a pressurizing operation and a pressure reducing operation are repeatedly performed on the tank (T) in the same way as described above. Thus, as a result of the pressurizing operation, the liquid refrigerant is pushed out from the tank (T) and the pressure thereof is reduced in the indoor electrically motorized expansion valve (EV1) as indicated by the solid line arrows in FIG. 28. Then, the refrigerant exchanges heat with the indoor air and is evaporated in the indoor heat exchanger (3), thereby cooling the indoor air. Thereafter, the refrigerant is condensed in the heat exchanger (1) on the secondary heat source side. And, as a result of the pressure reducing operation, the condensed liquid refrigerant is recovered into the tank (T). By repeating pressurization and pressure reduction in such a manner, the refrigerant is circulated in the secondary refrigerant circuit (B), thereby cooling the indoor air.

Next, the room heating running will be described.

During the heating running, firstly, in the primary refrigerant circuit (A), the four-position selector valve (22) is switched to the direction indicated by the broken lines, the sixth solenoid valve (SV6) is opened and the fifth solenoid valve (SV5) is closed. On the other hand, in the secondary refrigerant circuit (B), the seventh solenoid valve (SV7) and the eighth solenoid valve (SV8) are closed and the ninth solenoid valve (SV9) and the tenth solenoid valve (SV10) are opened.

In such a state, as indicated by the broken-line arrows in FIG. 28, a high-temperature, high-pressure gaseous refrigerant discharged from the compressor (11) exchanges heat with the refrigerant in the circulating evaporator (51) in the heating heat exchanger (71), thereby changing the sensible heat in the primary refrigerant circuit (A). Thereafter, the gaseous refrigerant flows through the gaseous refrigerant by-pass pipe (GBL) and the heat exchanger (12) on the primary heat source side, in which the refrigerant exchanges heat with the refrigerant in the heat exchanger (1) on the secondary heat source side and is condensed. A part of the condensed liquid refrigerant is evaporated in the outdoor heat exchanger (14) and returns to the compressor (11) via the four-position selector valve (22). The pressure of the other liquid refrigerant is reduced in the first outdoor electrically motorized expansion valve (EV-A). Then, in the cooling heat exchanger (72), the refrigerant exchanges heat with the refrigerant in the circulating condenser (61) and is evaporated to return to the compressor (11). This circulation operation is repeated.

On the other hand, in the secondary refrigerant circuit (B), a pressurizing operation and a pressure reducing operation are repeatedly performed on the tank (T) in the same way as described above. Thus, as a result of the pressurizing operation, the liquid refrigerant is pushed out from the tank (T), flows through the heating liquid pipe (35) on the supply side and the heat exchanger (1) on the secondary heat source side and is evaporated as indicated by the broken-line arrows in FIG. 28. Thereafter, in the indoor heat exchanger (3), the refrigerant exchanges heat with the indoor air and is condensed, thereby heating the indoor airs Then, as a result of the pressure reducing operation, the condensed liquid refrigerant is recovered into the tank (T) through the heating liquid pipe (34) on the recovery side. By repeating pressurization and pressure reduction in such a manner, the refrigerant is circulated in the secondary refrigerant circuit (B), thereby heating the indoor air.

(Eighteenth Embodiment)

Next, the eighteenth embodiment of the present invention will be described. It is noted that this embodiment is also applied to an air conditioning system of a heat pump type. Since the primary refrigerant circuit (A) is the same as that of the seventeenth embodiment described above, the description thereof will be omitted herein. As for the secondary refrigerant circuit (B), only the difference from that of the seventeenth embodiment will be described.

Figure 29:
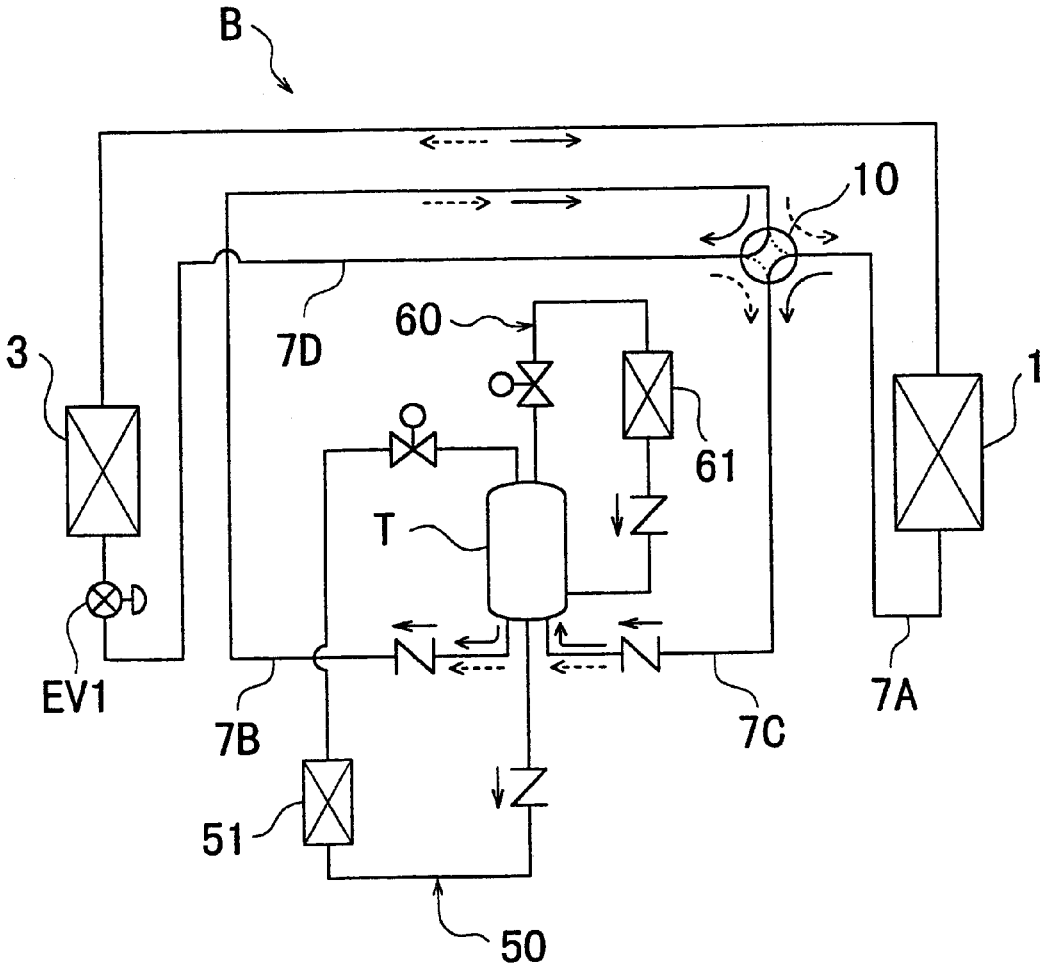
FIG. 29 is a diagram showing a secondary refrigerant circuit in the eighteenth embodiment.

As shown in FIG. 29, the secondary refrigerant circuit (B) includes a four-position selector valve (10) in the liquid pipe (7). Specifically, the four-position selector valve (10) is connected to a first liquid pipe (7A) extending from the liquid side of the heat exchanger (1) on the secondary heat source side, to a second and a third liquid pipe (7B, 7C) extending from the tank (T) and to a fourth liquid pipe (7D) extending from the liquid side of the indoor heat exchanger (3). This switches the states how the refrigerant pushed out from the tank (T) is supplied to the heat exchanger (1) on the secondary heat source side and the indoor heat exchanger (3).

Hereinafter, the room cooling and heating running will be described.

First, during the cooling running, the four-position selector valve (22) is switched to the direction indicated by the solid lines in the primary refrigerant circuit (A) in the same way as in the seventeenth embodiment described above. On the other hand, in the secondary refrigerant circuit (B), the four-position selector valve (22) is also switched to the direction indicated by the solid lines. In such a state, pressurization and pressure reduction are repeated by the pressurizing circuit (50) and the pressure reducing circuit (60). As a result, the refrigerant circulates in the secondary refrigerant circuit (B) as indicated by the solid-line arrows in FIG. 29, thereby cooling the indoor air.

On the other hand, during the room heating running, both the four-position selector valves (22, 10) are switched to the direction indicated by the broken lines. In such a state, pressurization and pressure reduction are repeated by the pressurizing circuit (50) and the pressure reducing circuit (60). As a result, in the secondary refrigerant circuit (B), the refrigerant circulates in the opposite direction to that of the cooling running as indicated by the broken-line arrows in FIG. 29, thereby heating the indoor air.

(Nineteenth Embodiment)

Figure 30:
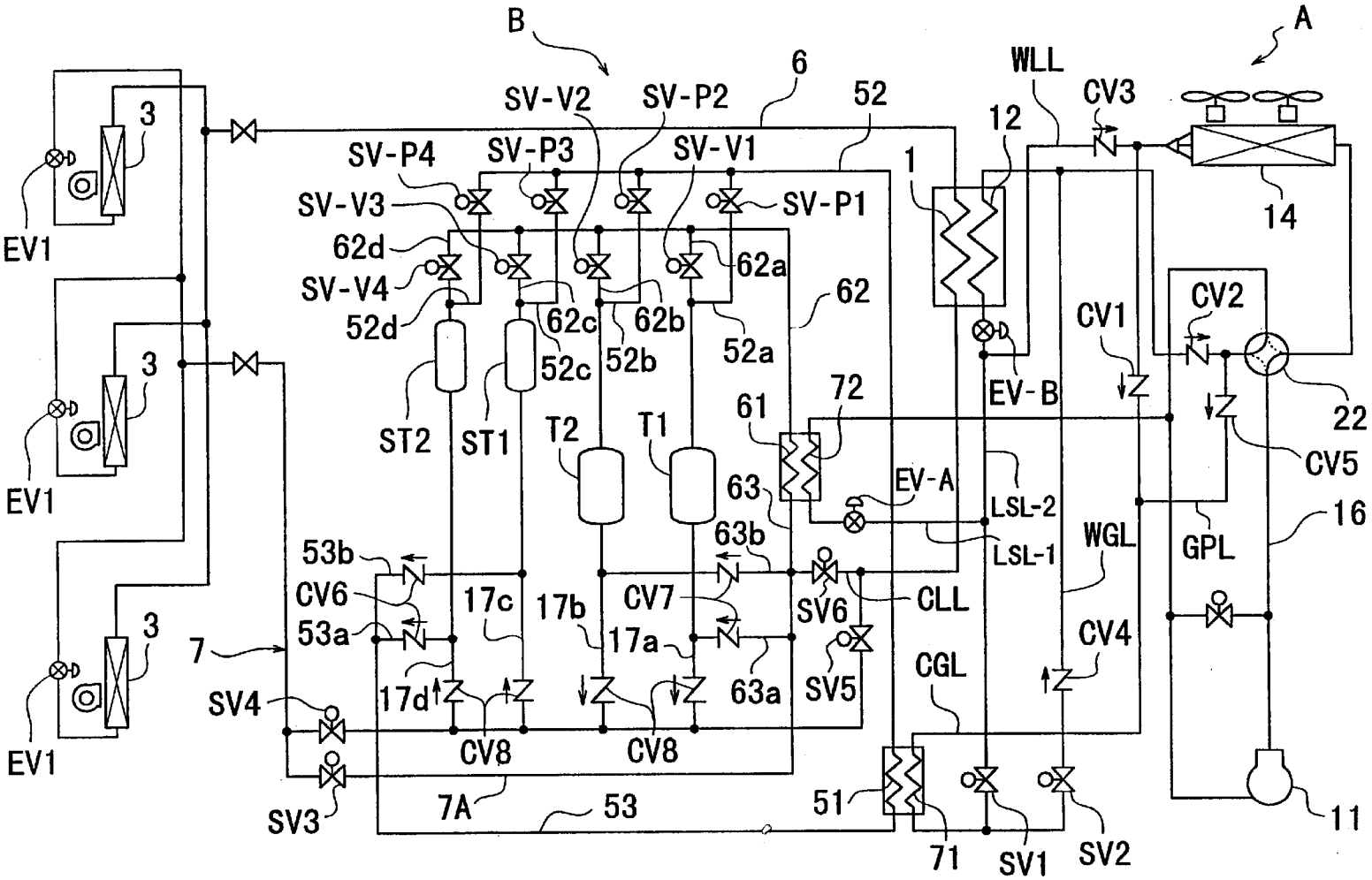
FIG. 30 is a diagram, corresponding to FIG. 1, in the nineteenth embodiment.

Next, the nineteenth embodiment of the present invention will be described with reference to FIGS. 30 to 32. It is noted that this embodiment is also applied to an air conditioning system of a heat pump type.

First, the primary refrigerant circuit (A) is constructed such that the compressor (11), the four-position selector valve (22), the outdoor heat exchanger (14), the heating heat exchanger (71), the first and the second outdoor electrically motorized expansion valves (EV-A, EV-B), the cooling heat exchanger (72) and the heat exchanger (12) on the primary heat source side are connected to each other through the refrigerant pipe (16) in the same way as in the seventeenth embodiment described above.

More specifically, the gas side of the outdoor heat exchanger (14) is switched between the inlet side and the outlet side of the compressor (11) via the four-position selector valve (22). The outdoor heat exchanger (14) is connected to the heating heat exchanger (71) through a cooling gas supply pipe (CGL). A check valve (CV1) allowing only the refrigerant to flow toward the heating heat exchanger (71) is provided for the cooling gas supply pipe (CGL). The liquid side of the heating heat exchanger (71) is branched into a first and a second liquid branch pipe (LSL-1, LSL-2) via a first solenoid valve (SV1). The first branch pipe (LSL-1) is connected to the cooling heat exchanger (72) via the first outdoor electrically motorized expansion valve (EV-A) and the second branch pipe (LSL-2) is connected to the heat exchanger (12) on the primary heat source side via the second outdoor electrically motorized expansion valve (EV-B).

The gas side of the cooling heat exchanger (72) is connected to the inlet side of the compressor (11). The gas side of the heat exchanger (12) on the primary heat source side is connected to the four-position selector valve (22) via a check valve (CV2) and is switched between the inlet side and the outlet side of the compressor (11) via the four-position selector valve (22).

The second branch pipe (LSL-2) and the outdoor heat exchanger (14) are connected to each other through a heating liquid pipe (WLL), which is provided with a check valve (CV3) allowing only the refrigerant to flow toward the outdoor heat exchanger (14).

The heating heat exchanger (71) and the first solenoid valve (SV1), and the heat exchanger (12) on the primary heat source side and the check valve (CV2) are connected through a heating gas supply pipe (WGL). A check valve (CV4) allowing only the liquid refrigerant to be supplied to the heat exchanger (12) on the primary heat source side and a second solenoid valve (SV2) are provided for the heating gas supply pipe (WGL). The check valve (CV2) and the four-position selector valve (22), and the check valve (CV1) and the heating heat exchanger (71) are connected through an outlet gas bypass pipe (GPL). A check valve (CV5) allowing only the refrigerant to flow toward the heating heat exchanger (71) is provided for the outlet gas by-pass pipe (GPL).

Next, the secondary refrigerant circuit (B) will be described.

The secondary refrigerant circuit (B) includes: a circulating evaporator (51) for exchanging heat with the heating heat exchanger (71); a circulating condenser (61) for exchanging heat with the cooling heat exchanger (72); a heat exchanger (1) on the secondary heat source side for exchanging heat with the heat exchanger (12) on the primary heat source side; a plurality of indoor heat exchangers (3, 3, 3) and indoor electrically motorized expansion valves (EV1, EV1, EV1) that are connected in parallel to the heat exchanger (1) on the secondary heat source side through a gas pipe (6) and a liquid pipe (7); two main tanks (T1, T2); and two sub-tanks (ST1, ST2).

Specifically, the gas supply pipe (52) connected to the upper end of the circulating evaporator (51) is branched into four branch pipes (52*a* to 52*d*), which are individually connected to the upper ends of the respective main tanks (T1, T2) and the respective sub-tanks (ST1, ST2). A first to a fourth tank pressurizing solenoid valve (SV-P1 to SV-P4) are provided for the branch pipes (52*a* to 52*d*), respectively.

The liquid recovery pipe (53) connected to the lower end of the circulating evaporator (51) is branched into two branch pipes (53*a*, 53*b*), which are individually connected to the lower ends of the respective sub-tanks (ST1, ST2). Check valves (CV6, CV6) allowing only the refrigerant to flow out from the sub-tanks (ST1, ST2) are provided for these branch pipes (53*a*, 53*b*), respectively.

On the other hand, the gas recovery pipe (62) connected to the upper end of the circulating condenser (61) is branched into four branch pipes (62*a* to 62*d*), which are individually connected to the upper ends of the respective main tanks (T1, T2) and the respective sub-tanks (ST1, ST2). A first to a fourth tank pressure reducing solenoid valve (SV-V1 to SV-V4) are provided for these branch pipes (62*a* to 62*d*), respectively.

The liquid supply pipe (63) connected to the lower end of the circulating condenser (61) is branched into two branch pipes (63*a*, 63*b*), which are individually connected to the lower ends of the respective main tanks (T1, T2). Check valves (CV7, CV7) allowing only the refrigerant to be recovered into the main tanks (T1, T2) are provided for these branch pipes (63*a*, 63*b*), respectively.

The liquid pipe (7) extending from the indoor heat exchanger (3) is branched into a first and a second liquid pipe (7A, 7B). The first branched liquid pipe (7A) is connected to the respective branch pipes (63*a*, 63*b*) via the third solenoid valve (SV3). The second branched liquid pipe (7B) is connected to the liquid side of the heat exchanger (1) on the secondary heat source side via the fourth solenoid valve (SV4) and the fifth solenoid valve (SV5). The lower ends of the respective main tanks (T1, T2) and the respective sub-tanks (ST1, ST2) are connected between the fourth solenoid valve (SV4) and the fifth solenoid valve (SV5) in the second branched liquid pipe (7B) through the connecting pipes (17*a* to 17*d*), respectively.

Check valves (CV8, CV8, . . . ) allowing only the refrigerant to flow from the respective main tanks (T1, T2) and the respective sub-tanks (ST1, ST2) toward the second branched liquid pipe (7B) are provided for the connecting pipes (17*a* to 17*d*), respectively. The branch pipes (63*a*, 63*b*) are connected between the fifth solenoid valve (SV5) and the heat exchanger (1) on the secondary heat source side in the second branched liquid pipe (7B) through the cooling liquid recovery pipe (CLL), which is provided with a sixth solenoid valve (sV6).

Hereinafter, the room cooling and heating running operations will be described.

During the cooling running, first, the four-position selector valve (22) is switched to the direction indicated by the solid lines, the first solenoid valve (SV1) is opened and the second solenoid valve (SV2) is closed in the primary refrigerant circuit (A). On the other hand, in the secondary refrigerant circuit (B), the first and the third tank pressurizing solenoid valves (SV-P1, SV-P3), the second and the fourth tank pressure reducing solenoid valves (SV-V2, SV-V3), the fourth solenoid valve (SV4) and the sixth solenoid valve (SV6) are opened, and the second and the fourth tank pressurizing solenoid valves (SV-P2, SV-P4), the first and the third tank pressure reducing solenoid valves (SV-V1, SV-V3), the third solenoid valve (SV3) and the fifth solenoid valve (SV5) are closed.

Figure 31:
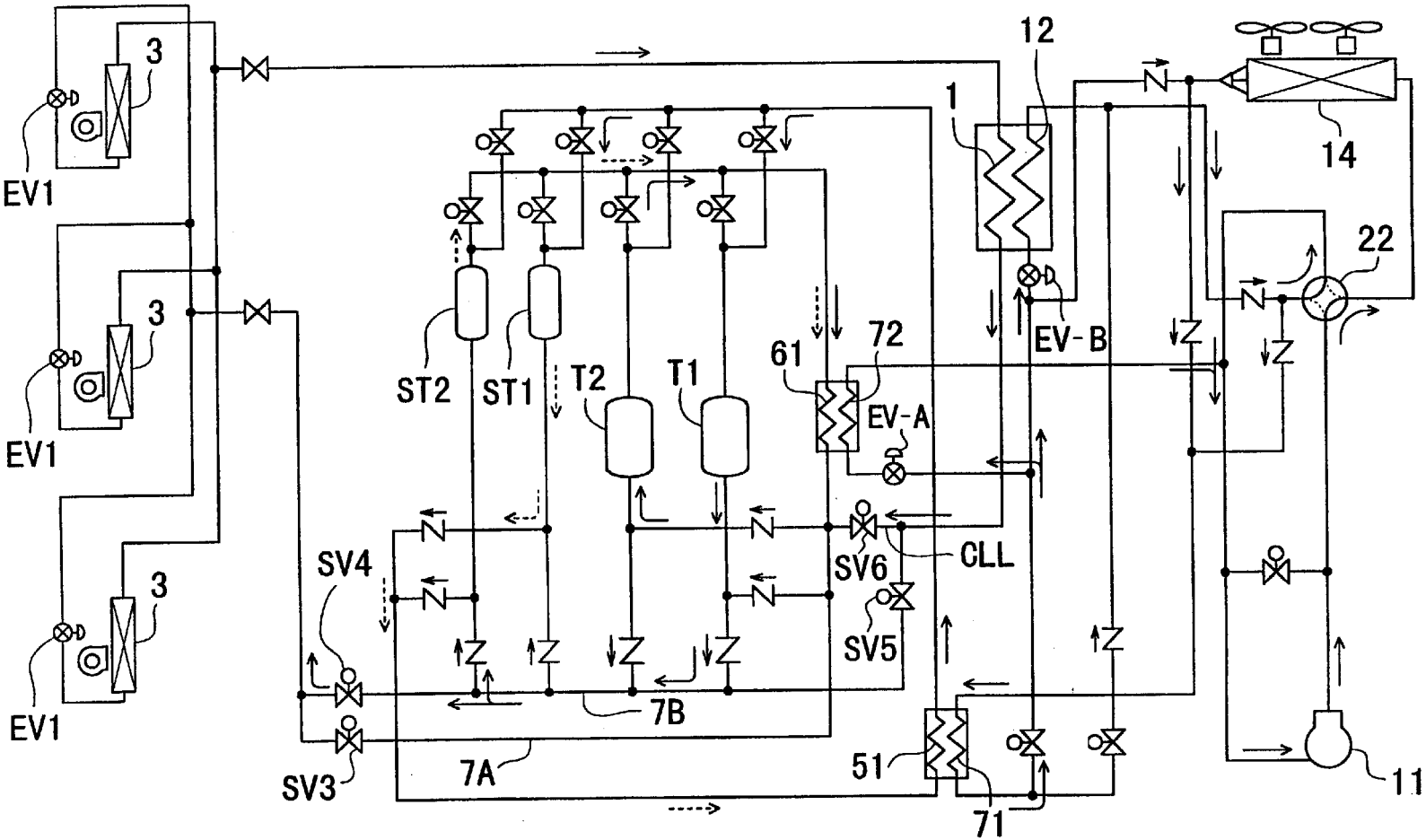
FIG. 31 is a diagram showing a cooling running operation in the nineteenth embodiment.

In such a state, in the primary refrigerant circuit (A), a high-temperature, high-pressure gaseous refrigerant discharged from the compressor (11) sequentially flows through the outdoor heat exchanger (14) and the heating heat exchanger (71) and is condensed, as indicated by the solid-line arrows in FIG. 31. Thereafter, the refrigerant is distributed into the cooling heat exchanger (72) and the heat exchanger (12) on the primary heat source side. The pressure of the refrigerant is reduced in the respective outdoor electrically motorized expansion valve (EV-A, EV-B). Then, in the cooling heat exchanger (72), the refrigerant exchanges heat with the refrigerant in the circulating condenser (61). And in the heat exchanger (12) on the primary heat source side, the refrigerant exchanges heat with the refrigerant in the heat exchanger (1) on the secondary heat source side. Then, these refrigerants are evaporated. The evaporated refrigerants return to the compressor (11). This circulation operation is repeated.

On the other hand, in the secondary refrigerant circuit (B), the internal pressures of the first main tank (T1) and the first sub-tank (ST1) become high, whereas the internal pressures of the second main tank (T2) and the second sub-tank (ST2) become low. Thus, as indicated by the solid-line arrows in FIG. 31, the liquid refrigerant pushed out from the first main tank (T1) is passed through the second branched liquid pipe (7B). The pressure of the refrigerant is reduced in the indoor electrically motorized expansion valve (EV1). Then, in the indoor heat exchanger (3), the refrigerant exchanges heat with the indoor air and is evaporated, thereby cooling the indoor air. Thereafter, the refrigerant is condensed in the heat exchanger (1) on the secondary heat source side, passed through the cooling liquid recovery pipe (CLL) and then recovered into the second main tank (T2). On the other hand, since the pressure of the first sub-tank (ST1) is equalized with that of the circulating evaporator (51), the liquid refrigerant in the first sub-tank (ST1) is supplied to the circulating evaporator (51) as indicated by the broken-line arrows in FIG. 31. Furthermore, in the meantime, a part of the refrigerant flowing through the second branched liquid pipe (7B) is recovered into the second sub-tank (ST2).

After such an operation has been performed for a predetermined period of time, the respective solenoid valves in the secondary refrigerant circuit (B) are switched. Specifically, the first and the third tank pressurizing solenoid valves (SV-P1, SV-P3) and the second and the fourth tank pressure reducing solenoid valves (SV-V2, SV-V3) are closed, and the second and the fourth tank pressurizing solenoid valves (SV-P2, SV-P4) and the first and the third tank pressure reducing solenoid valves (SV-V1, SV-V4) are opened. As a result, the internal pressures of the first main tank (T1) and the first sub-tank (ST1) become low, whereas the internal pressures of the second main tank (T2) and the second sub-tank (ST2) become high. Thus, a refrigerant circulation state is established in which the liquid refrigerant pushed out from the second main tank (T2) is circulated and then recovered into the first main tank (T1). Moreover, the liquid refrigerant in the second sub-tank (ST2) is supplied to the circulating evaporator (51) and a part of the refrigerant flowing through the second branch pipe (7B) is recovered into the first sub-tank (ST1).

By repeating the switching operations of the solenoid valves, the refrigerant circulates in the secondary refrigerant circuit (B), thereby cooling the indoor air.

Next, the room heating running will be described.

During the heating running, firstly, the four-position selector valve (22) is switched to the direction indicated by the broken lines, the second solenoid valve (SV2) is opened and the first solenoid valve (SV1) is closed in the primary refrigerant circuit (A). On the other hand, in the secondary refrigerant circuit (B), the third solenoid valve (SV3) and the fifth solenoid valve (SV5) are opened and the fourth solenoid valve (SV4) and the sixth solenoid valve (SV6) are closed. In such a state, the opening/closing operations of the other solenoid valves are repeated.

Specifically, in the same way as in the above-described cooling running, a state where the first and the third tank pressurizing solenoid valves (SV-P1, SV-P3) and the second and the fourth tank pressure reducing solenoid valves (SV- V2, SV-V3) are opened and the second and the fourth tank pressurizing solenoid valves (SV-P2, SV-P4) and the first and the third tank pressure reducing solenoid valves (SV-V1, SV-V4) are closed, and an opposite state where the first and the third tank pressurizing solenoid valves (SV-P1, SV-P3) and the second and the fourth tank pressure reducing solenoid valves (SV-V2, SV-V3) are closed and the second and the fourth tank pressurizing solenoid valves (SV-P2, SV-P4) and the first and the third tank pressure reducing solenoid valves (SV-V1, SV-V4) are opened, are alternately switched.

Figure 32:
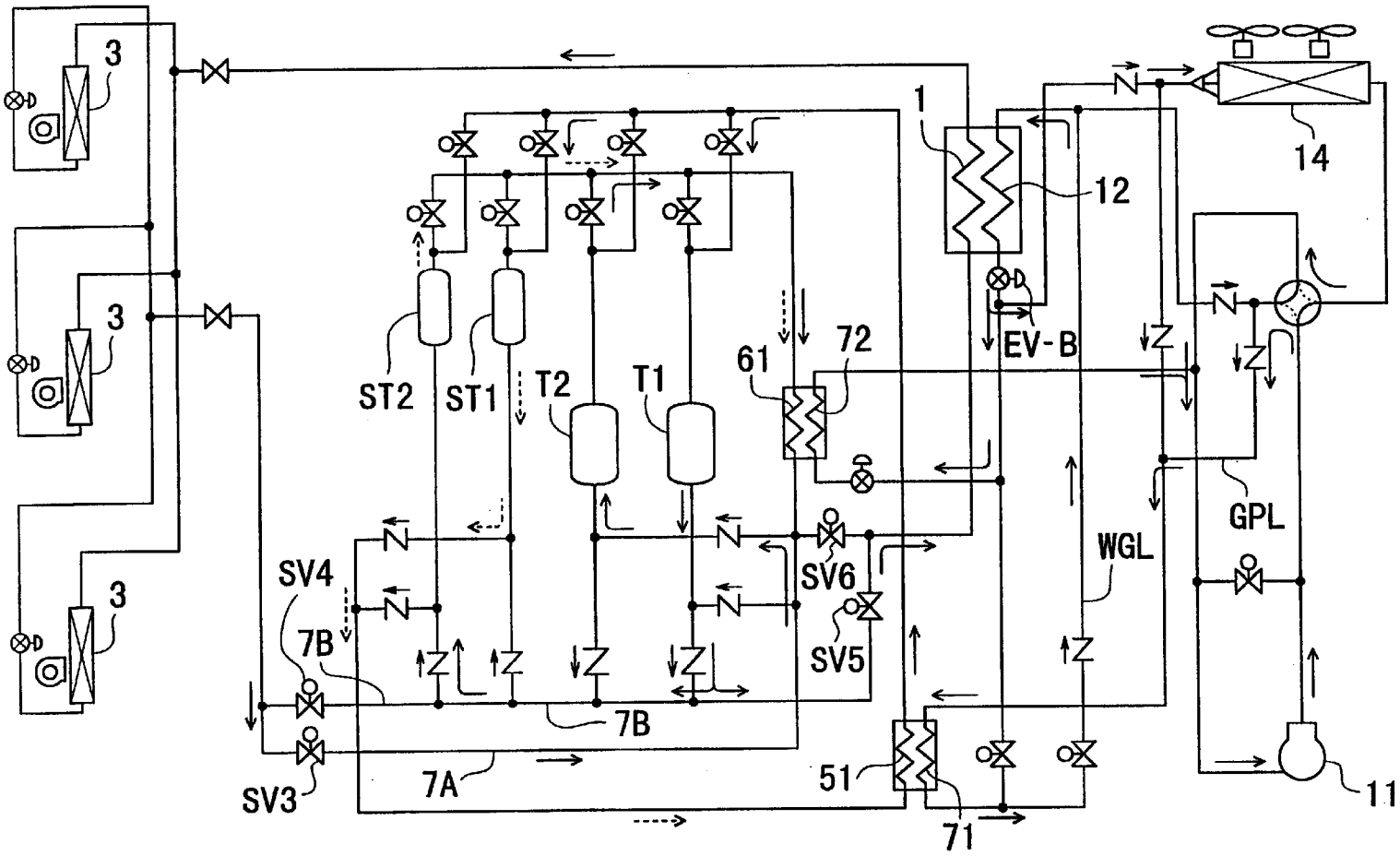
FIG. 32 is a diagram showing a heating running state in the nineteenth embodiment.

As a result, as indicated by the solid-line arrows in FIG. 32, a high-temperature, high-pressure gaseous refrigerant discharged from the compressor (11) is passed through the outlet gas by-pass pipe (GPL) and exchanges heat with the refrigerant in the circulating evaporator (51) in the heating heat exchanger (71), thereby changing the sensible heat in the primary refrigerant circuit (A). Thereafter, the gaseous refrigerant flows through the heating gas supply pipe (WGL) and the heat exchanger (12) on the primary heat source side, in which the refrigerant exchanges heat with the refrigerant in the heat exchanger (1) on the secondary heat source side and is condensed. The pressure of the condensed liquid refrigerant is reduced in the second outdoor electrically motorized expansion valve (EV-B). Then, the refrigerant is distributed to flow through the cooling heat exchanger (72) and the outdoor heat exchanger (14). In the cooling heat exchanger (72), the refrigerant exchanges heat with the refrigerant in the circulating condenser (61). In the outdoor heat exchanger (14), the refrigerant exchanges heat with the outdoor air. Then, these refrigerants are evaporated to return to the compressor (11). This circulation operation is repeated.

On the other hand, in the secondary refrigerant circuit (B), in the state where the internal pressures of the first main tank (T1) and the first sub-tank (ST1) are high and the internal pressures of the second main tank (T2) and the second sub-tank (ST2) are low, for example, the liquid refrigerant pushed out from the first main tank (T1) flows through the second branched liquid pipe (7B) toward the heat exchanger (1) on the secondary heat source side, is evaporated in the heat exchanger (1) on the secondary heat source side, condensed in the indoor heat exchanger (3) and then recovered into the second main tank (T2) through the first branched liquid pipe (7A), as indicated by the solid-line arrows in FIG. 32. In this case, as indicated by the broken-line arrows in FIG. 32, the liquid refrigerant in the first sub-tank (ST1) is also supplied to the circulating evaporator (51) and the refrigerant has been recovered into the second sub-tank (ST2) through the second branched liquid pipe (7A). Then, the switching operations of the solenoid valves are repeated in the above-described manner and the refrigerant circulates in the secondary refrigerant circuit (B), thereby heating the indoor air.

(Twentieth Embodiment)

Figure 33:
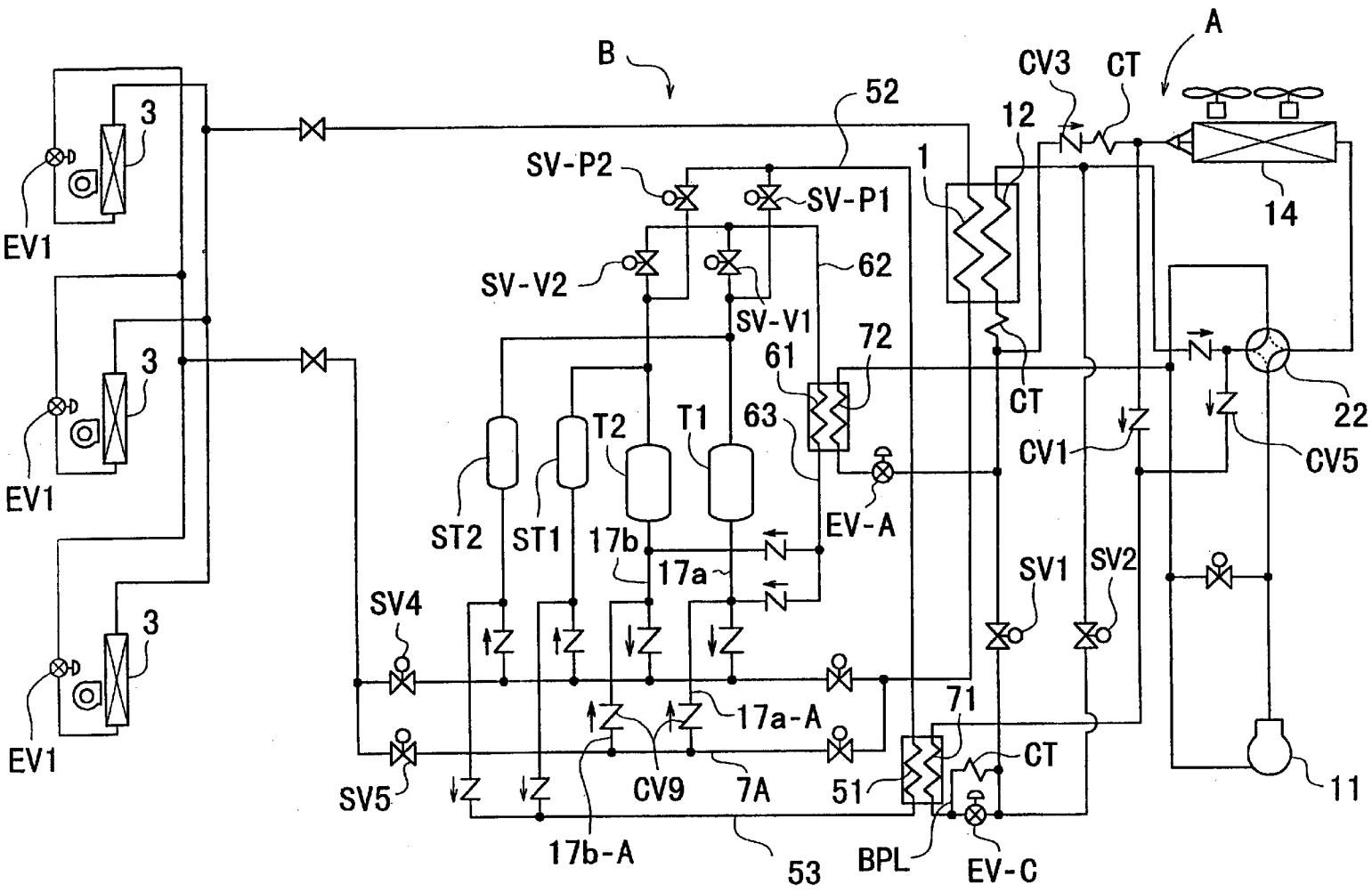
FIG. 33 is a diagram, corresponding to FIG. 1, in the twentieth embodiment.

Next, the twentieth embodiment of the present invention will be described with reference to FIGS. 33 to 35. It is noted that this embodiment is also applied to an air conditioning system of a heat pump type and that main arrangements are the same as those of the nineteenth embodiment. Thus, only the difference from the nineteenth embodiment will be described hereinafter.

The primary refrigerant circuit (A) includes not only an electrically motorized expansion valve (EV-C) but also a bypass pipe (BPL) for by-passing the electrically motorized expansion valve (EV-C) between the heating heat exchanger (71) and the first solenoid valve (SV1). A capillary tube (CT) is provided for the by-pass pipe (BPL). The capillary tube (CT) is provided for the liquid side of the heat exchanger (12) on the primary heat source side, instead of the electrically motorized expansion valve (EV-B). The other arrangements are substantially the same as those of the nineteenth embodiment described above.

On the other hand, in the secondary refrigerant circuit (B), the upper end of the first sub-tank (ST1) is connected to the upper end of the first main tank (T1) and the upper end of the first sub-tank (ST1) is connected to the upper end of the first main tank (T1). Only by performing the switching operations of the solenoid valves (SV-P1, SV-P2, SV-V1, SV-V2) for switching the connection states of the circulating evaporator (51) and the circulating condenser (61) to the respective main tanks (T1, T2), the connection states of the circulating evaporator (51) and the circulating condenser (61) to the respective sub-tanks (ST1, ST2) are switched. The connecting pipes (17*a*, 17*b*) coupled to the respective main tanks (T1, T2) are partially branched into the branch pipe (17*a*-A, 17*b*-A) and are connected to the first liquid pipe (7A) through the check valves (CV9, CV9). The other arrangements are substantially the same as those of the nineteenth embodiment described above.

Figure 34:
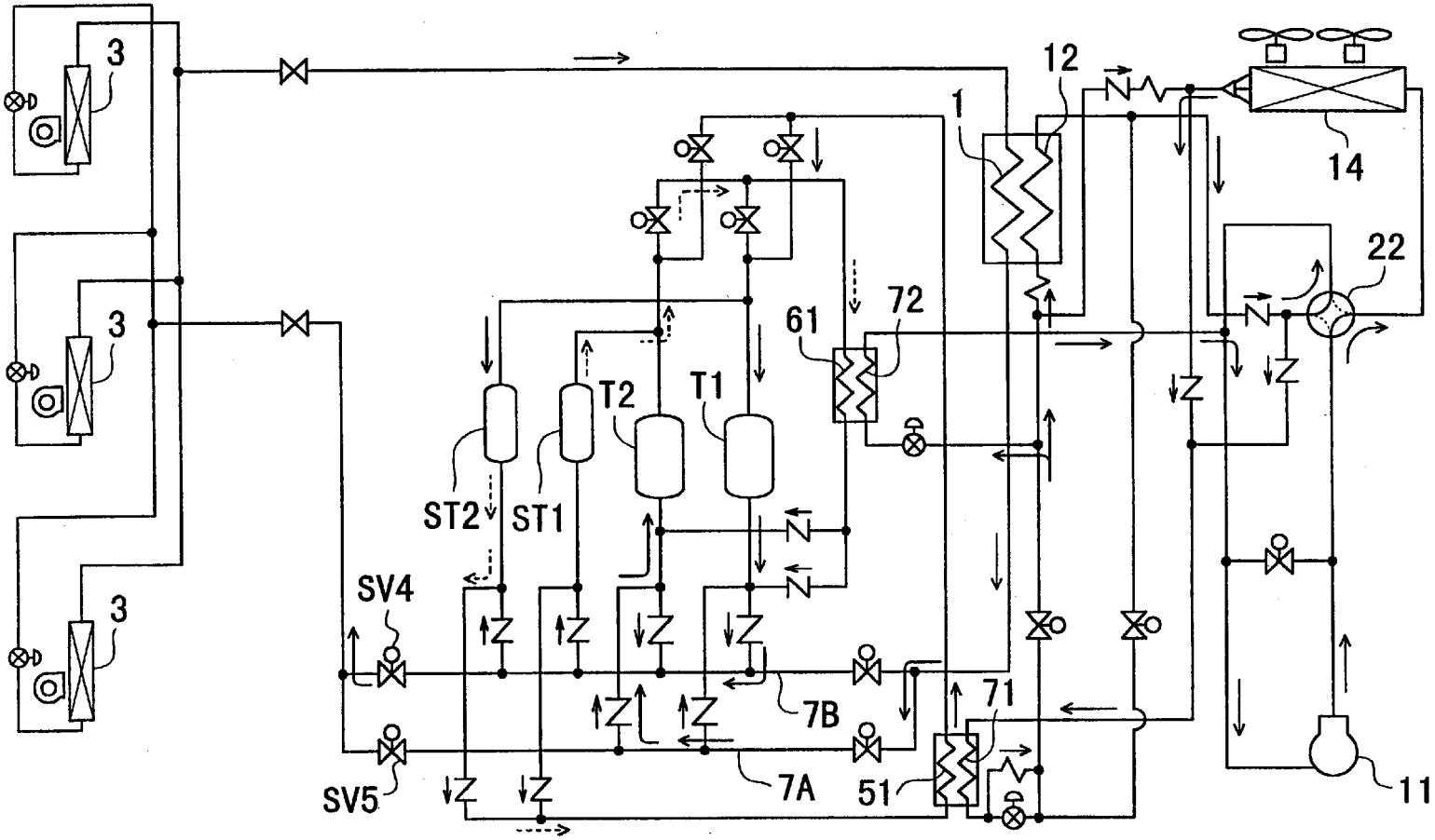
FIG. 34 is a diagram showing a cooling running operation in the twentieth embodiment.
Figure 35:
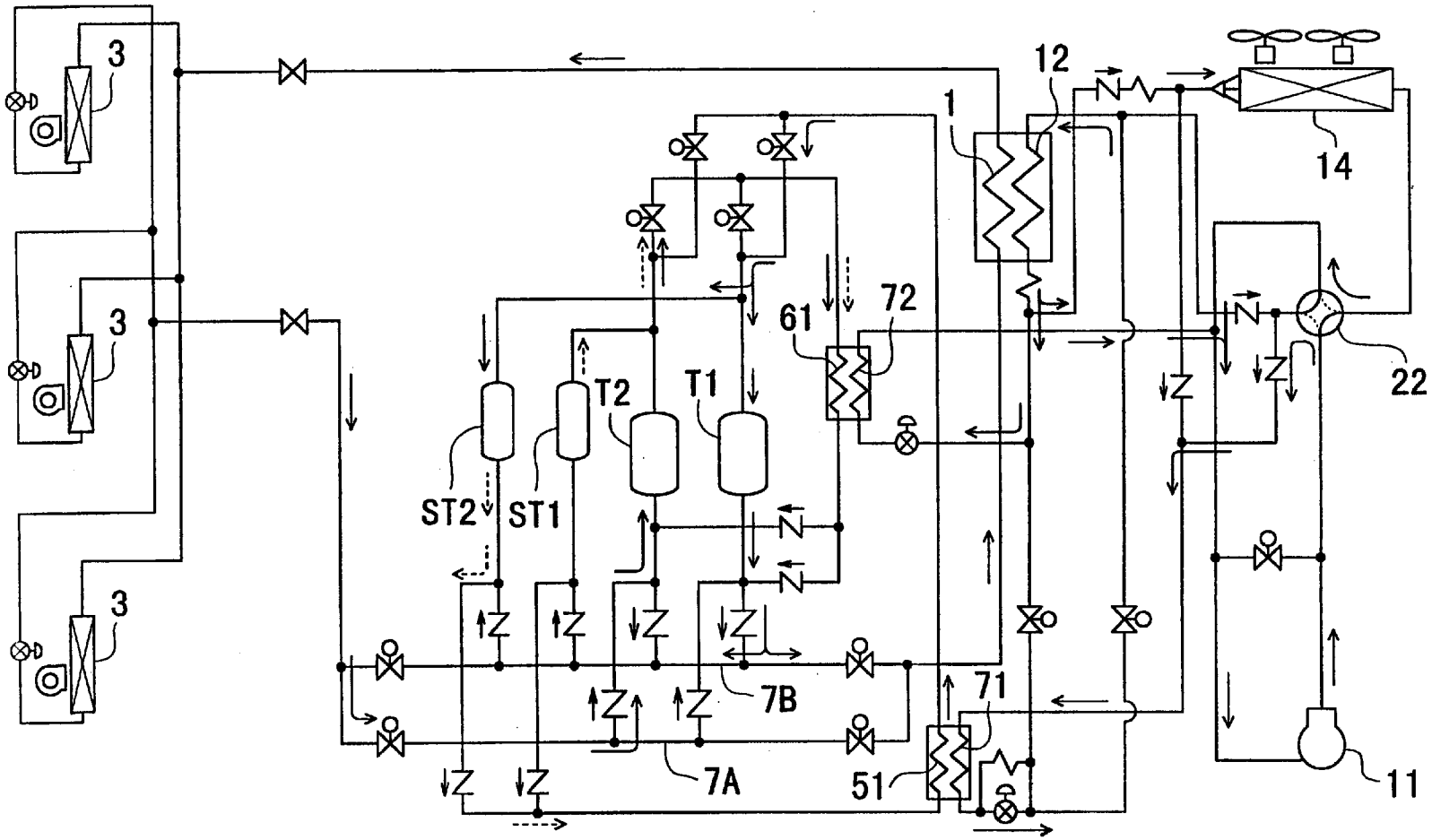
FIG. 35 is a diagram showing a heating running state in the twentieth embodiment.
Figure 36:
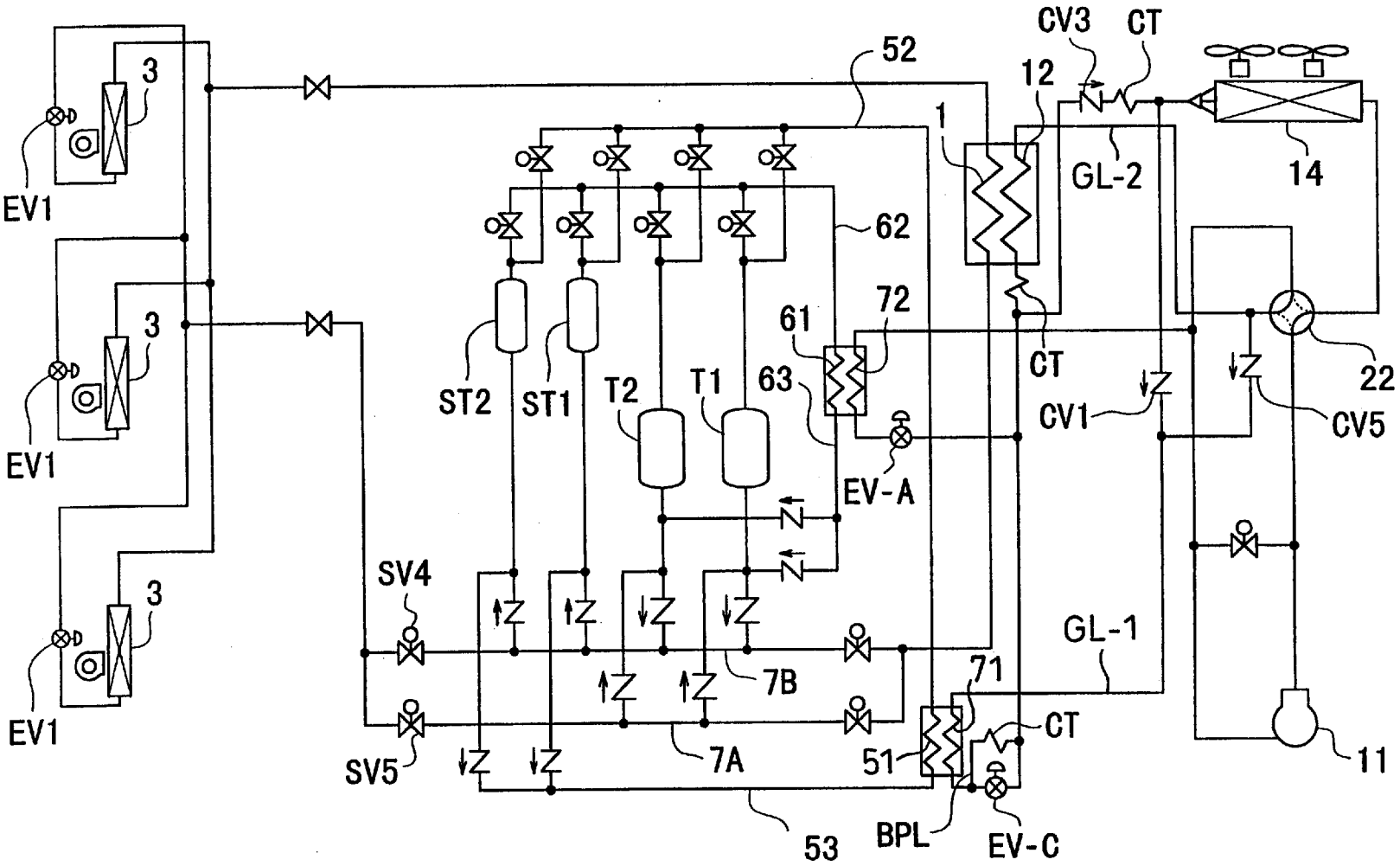
FIG. 36 is a diagram, corresponding to FIG. 1, in the twenty-first embodiment.

The refrigerant circulates as indicated by the arrows in FIG. 34 to perform the room cooling during the cooling running of the refrigerant circuit of this embodiment, and circulates as indicated by the arrows in FIG. 35 to perform the room heating during the heating running thereof. Since these refrigerant circulation operations are substantially the same as those of the nineteenth embodiment described above, the details thereof will be omitted herein. It is noted that during the cooling running, the electrically motorized expansion valve (EV-C) is closed and the pressure of the refrigerant is reduced by the capillary tube (CT) in the primary refrigerant circuit (A). On the other hand, during the heating running, the electrically motorized expansion valve (EV-C) is opened and the refrigerant flows through the heat exchanger (12) on the primary heat source side without reducing the pressure thereof.

In the secondary refrigerant circuit (B), the refrigerant condensed in the heat exchanger (1) on the secondary heat source side is recovered into the main tank (T2) through the first liquid pipe (7A) and the branch pipe (17*b*-A) during the cooling running. On the other hand, during the heating running, the refrigerant condensed in the indoor heat exchanger (3) is recovered into the main tank (T2) through the first liquid pipe (7A) and the branch pipe (17*b*-A).

(Twenty-first Embodiment)

Next, the twenty-first embodiment of the present invention will be described. It is noted that this embodiment is also applied to an air conditioning system of a heat pump type and that the main arrangements are the same as those of the twentieth embodiment described above. Thus, only the difference from the twentieth embodiment will be described hereinafter.

The primary refrigerant circuit (A) is not provided with the heating gas supply pipe (WGL) unlike that of the twentieth embodiment described above. Moreover, no check valve is provided for the pipe connecting the heat exchanger (12) on the primary heat source side and the four-position selector valve (22).

In the secondary refrigerant circuit (B), as for the connection states of the circulating evaporator (51) and the circulating condenser (61) to the upper ends of the respective main tanks (T1, T2) and the respective sub-tanks (ST1, ST2), those of the nineteenth embodiment described above are also employed herein.

Furthermore, in this embodiment, the evaporating temperature of the circulating evaporator (51) is set higher than the evaporating temperature of the heat exchanger (1) on the secondary heat source side during the heating running. That is to say, in the same way as setting the condensing temperature of the circulating condenser (61) lower than the condensing temperature of the heat exchanger (1) on the secondary heat source side in the first embodiment, the powers of the heat exchangers are differentiated.

Specifically, the first gas supply pipe (GL-1) coupled to the heating heat exchanger (71) and the second gas supply pipe (GL-2) coupled to the heat exchanger (12) on the primary heat source side have respectively different pipe diameters, and the flow rate of the first gas supply pipe (GL-1) is set smaller than the flow rate of the second gas supply pipe (GL-2) by a predetermined ratio. On the other hand, the heat exchange area between the heating heat exchanger (71) and the circulating evaporator (51) is set smaller than the heat exchange area between the heat exchanger (12) on the primary heat source side and the heat exchanger (1) on the secondary heat source side, and the ratio is set smaller than the above-described predetermined ratio.

Specifically, for example, if the ratio of the flow rate of the first gas supply pipe (GL-1) to the flow rate of the second gas supply pipe (GL-2) is 1:10, then the ratio of the heat exchange area between the heating heat exchanger (71) and the circulating evaporator (51) to the heat exchange area between the heat exchanger (12) on the primary heat source side and the heat exchanger (1) on the secondary heat source side is set at 2:10. Thus, in respect of the power as a heat exchanger with respect to the flow rate of a refrigerant, the circulating evaporator (51) is superior to the heat exchanger (1) on the secondary heat source side. Thus, the evaporating temperature of the circulating evaporator (51) becomes higher than the evaporating temperature of the heat exchanger (1) on the secondary heat source side. Consequently, the internal pressure of the circulating evaporator (51) becomes higher than the internal pressure of the heat exchanger (1) on the secondary heat source side. During the heating running, the liquid refrigerant is pushed out from the main tanks (T1, T2) toward the heat exchanger (1) on the secondary heat source side. The other arrangements are the same as those of the twentieth embodiment described above.

Figure 37:
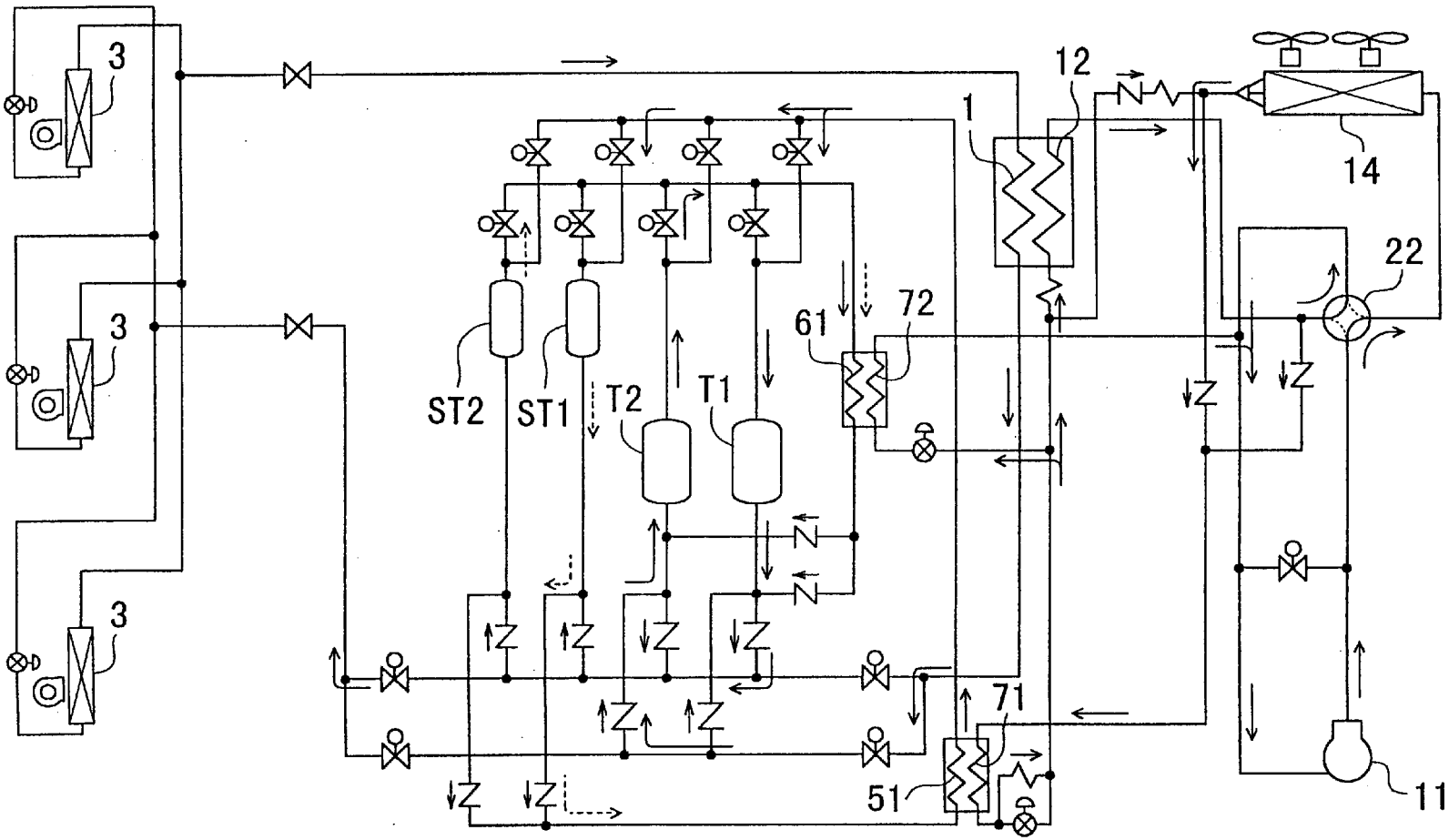
FIG. 37 is a diagram showing a cooling running operation in the twenty-first embodiment.

And, during the cooling running of the refrigerant circuit of this embodiment, the refrigerant circulates in the respective refrigerant circuits (A, B) as indicated by the arrows in FIG. 37, thereby cooling the indoor air. Since the refrigerant circulation operation is substantially the same as that of the nineteenth embodiment or the twentieth embodiment described above, the details thereof are omitted herein.

Figure 38:
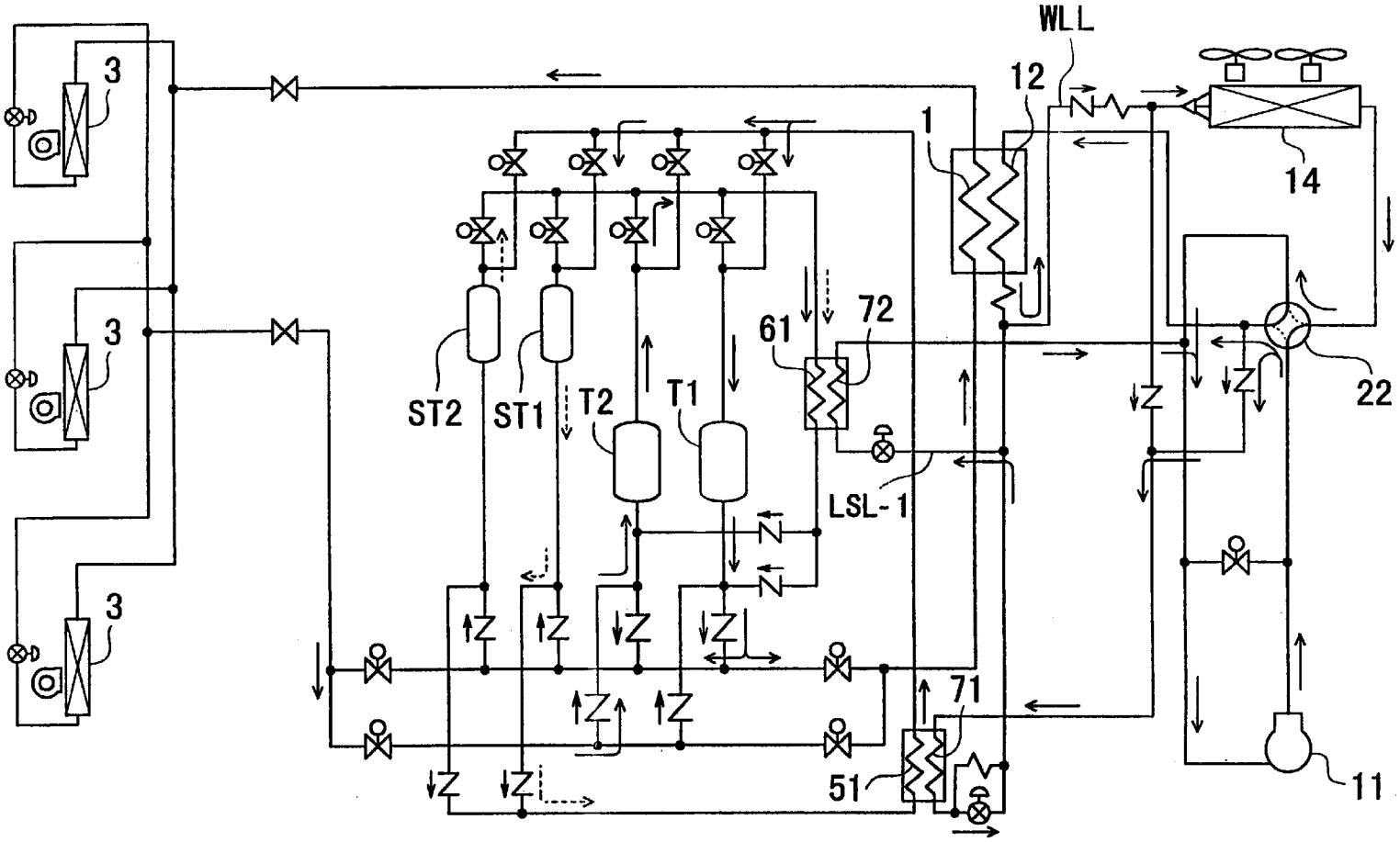
FIG. 38 is a diagram showing a heating running state in the twenty-first embodiment.

On the other hand, in the primary refrigerant circuit during the heating running, the refrigerant discharged from the compressor (11) is distributed into and condensed in the heating heat exchanger (71) and the heat exchanger (12) on the primary heat source side as indicated by the arrows in FIG. 38. And, the refrigerant condensed in the heating heat exchanger (71) flows through the branch pipe (LSL-1) and the cooling heat exchanger (72), exchanges heat with the circulating condenser (61) and is evaporated to return to the compressor (11). On the other hand, the refrigerant condensed in the heat exchanger (12) on the primary heat source side flows through the heating liquid pipe (WLL) and the outdoor heat exchanger (14), exchanges heat with the outdoor air and is evaporated to return to the compressor (11).

In the secondary refrigerant circuit (B), the refrigerant circulates as indicated by the arrows in FIG. 38, thereby heating the indoor air. Since the refrigerant circulation operation in the secondary refrigerant circuit (B) is substantially the same as that of the nineteenth embodiment or the twentieth embodiment described above, the details thereof are omitted herein.

(Other Embodiments)

In the foregoing embodiments, the heat transport system of the present invention has been described as being applied to refrigerant circuitry for an air conditioning system. However, the present invention is not limited thereto, but is applicable to various other types of refrigerating machines.

In the first to the tenth embodiments, the tank (T) is connected to the liquid pipe (7) through the connecting pipe (17). Alternatively, the tank (T) may be directly connected to the liquid pipe (7).

Moreover, in some of the above-described embodiments in which a plurality of tanks (T1, T2) and/or a plurality of sub-tanks (ST1, ST2) are provided, three or more tanks and/or sub-tanks may be provided. That is to say, two or more first tanks (T1) and first sub-tanks (ST1) and two or more second tanks (T2) and second sub-tanks (ST2) may be provided such that each first tank (T1) and each first sub-tank (ST1) perform the same function and each second tank (T2) and each second sub-tank (ST2) perform the same function.

INDUSTRIAL APPLICABILITY

As described above, the present invention is effectively applicable to a heat transport system used as refrigerant circuitry for an air conditioning system or the like, and more particularly applicable to a heat transport system for transporting heat by circulating a heat transport medium without requiring any driving source such as a pump.

What is claimed is:

1. A heat transport system, characterized by comprising:

a refrigerant circuit (B) constituted such that heat exchange means (1) on a heat source side is connected to heat exchange means (3) on an application side through a gas pipe (6) and a liquid pipe (7) so as to circuit a refrigerant therein, the heat exchange means (1) on the heat source side exchanging heat with heat source means (A);

tank means (T) for communicating with the liquid pipe (7) and reserving a liquid refrigerant therein;

pressure regulating means (18) for alternately performing an pressurizing operation for raising an internal pressure of the tank means (T) and a pressure reducing operation for lower the internal pressure, said pressure regulating means including a pressure generating means(18*a*, 18*c*, 19*c*) coupled to the tank means (T) through a pressure pipe (19), applies a high pressure from the pressure generating means (18*a*, 18*c*, 19*c*) to the inside of the tank means (T) during a pressurizing operation, and applies a low pressure from the pressure generating means (18*a*, 18*c*, 19*c*) to the inside of the tank means (T) during a pressure reducing operation; and refrigerating control means (H) for allowing only a supply of the liquid refrigerant from the tank means (T) to any of the heat exchange means to be an evaporator during the pressurizing operation of the pressure regulating means (18) and allowing only a recovery of the liquid refrigerant from any of the heat exchange means to be a condenser to the tank means (T) during the pressure reducing operation thereof, thereby circulating the refrigerant of the refrigerant circuit (B) and making the heat exchange means (3) on the application side absorb or radiate heat.

2. The heat transport system of claim 1, characterized in that the heat exchange means (3) on the application side is an evaporator for absorbing heat, and that the refrigerant control means (H)

allows the liquid refrigerant to be supplied from the tank means (T) to the heat exchange means (3) on the application side and prevents the liquid refrigerant from being supplied from the tank means (T) to the heat exchange means (1) on the heat source side during the pressurizing operation of the pressure regulating means (18), and allows the liquid refrigerant to be recovered from the heat exchange means (1) on the heat source side to the tank means (T) and prevents the liquid refrigerant from being recovered from the heat exchange means (3) on the application side to the tank means (T) during the pressure reducing operation of the pressure regulating means (18).

3. The heat transport system of claim 2, characterized in that the refrigerant control means (H) is constituted by:

a first solenoid valve (SV-A), which is provided between a connecting point of the tank means (T) to the liquid pipe (7) and the heat exchange means (1) on the heat source side, closes during the pressurizing operation of the pressure regulating means (18) and opens during the pressure reducing operation thereof; and a second solenoid valve (SV-B), which is provided between the connecting point of the tank means (T) to the liquid pipe (7) and the heat exchange means (3) on the application side, opens during the pressurizing operation of the pressure regulating means (18) and closes during the pressure reducing operation thereof.

4. The heat transport system of claim 2, characterized in that the refrigerant control means (H) is constituted by:

a first check valve (CV1), which is provided between a connecting point of the tank means (T) to the liquid pipe (7) and the heat exchange means (1) on the heat source side and allows only the liquid refrigerant to flow from the heat exchange means (1) on the heat source side to the tank means (T); and a second check valve (CV2), which is provided between the connecting point of the tank means (T) to the liquid pipe (7) and the heat exchange means (3) on the application side and allows only the liquid refrigerant to flow from the tank means (T) to the heat exchange means (3) on the application side.

5. The heat transport system of claim 1, characterized in that the heat exchange means (3) on the application side is a condenser for radiating heat, and that the refrigerant control means (H)

allows the liquid refrigerant to be supplied from the tank means (T) to the heat exchange means (1) on the heat source side and prevents the liquid refrigerant from being supplied from the tank means (T) to the heat exchange means (3) on the application side during the pressurizing operation of the pressure regulating means (18), and allows the liquid refrigerant to be recovered from the heat exchange means (3) on the application side to the tank means (T) and prevents the liquid refrigerant from being recovered from the heat exchange means (1) on the heat source side to the tank means (T) during the pressure reducing operation of the pressure regulating means (18).

6. The heat transport system of claim 5, characterized in that the refrigerant control means (H) is constituted by:

a first solenoid valve (SV-A), which is provided between a connecting point of the tank means (T) to the liquid pipe (7) and the heat exchange means (1) on the heat source side, opens during the pressurizing operation of the pressure regulating means (18) and closes during the pressure reducing operation thereof; and a second solenoid valve (SV-B), which is provided between the connecting point of the tank means (T) to the liquid pipe (7) and the heat exchange means (3) on the application side, closes during the pressurizing operation of the pressure regulating means (18) and opens during the pressure reducing operation thereof.

7. The heat transport system of claim 5, characterized in that the refrigerant control means (H) is constituted by:

a first check valve (CV3), which is provided between a connecting point of the tank means (T) to the liquid pipe (7) and the heat exchange means (1) on the heat source side and allows only the liquid refrigerant to flow from the tank means (T) to the heat exchange means (1) on the heat source side; and a second check valve (CV4), which is provided between the connecting point of the tank means (T) to the liquid pipe (7) and the heat exchange means (3) on the application side and allows only the liquid refrigerant to flow from the heat exchange means (3) on the application side to the tank means (T).

8. The heat transport system of claim 1, characterized in that the pressure generating means is a reservoir container (18*a*) in which a liquid refrigerant is reservable, and that the pressure regulating means (18) applies heat to the liquid refrigerant in the reservoir container (18*a*) so as to evaporate the liquid refrigerant and to raise an internal pressure of the reservoir container (18*a*) during a pressurizing operation, and extracts heat from a gaseous refrigerant in the reservoir container (18*a*) so as to condense the gaseous refrigerant and to lower the internal pressure of the reservoir container (18*a*) during a pressure reducing operation.

9. The heat transport system of claim 1, characterized in that the pressure generating means is a compressor (18*c*), and that a connection state of the pressure pipe (19) to the compressor (18*c*) is switched to an outlet side and an inlet side of the compressor (18*c*) by selector means (I), and that the pressure regulating means (18) connects the pressure pipe (19) to the outlet side of the compressor (18*c*) during a pressurizing operation and connects the pressure pipe (19) to the inlet side of the compressor (18*c*) during a pressure reducing operation in accordance with a switching operation of the selector means (I).

10. The heat transport system of claim 1, characterized in that the pressure generating means is a heat exchanger (19*c*) in which a refrigerant is reservable, and that the pressure regulating means (18) applies heat to the refrigerant in the heat exchanger (19*c*) so as to raise an internal pressure of the heat exchanger (19*c*) during a pressurizing operation and extracts heat from the refrigerant in the heat exchanger (19*c*) so as to lower the internal pressure of the heat exchanger (19*c*) during a pressure reducing operation.

11. The heat transport system of claim 10, characterized in that the pressure regulating means (18) includes a refrigerant circuit (D) including: a compressor (D1); a first heat exchanger (D3); a pressure reducing mechanism (D4); a second heat exchanger (D5); and selector means (D2) for alternately switching connection states of the first heat exchanger (D3) and the second heat exchanger (D5) to an outlet side of the compressor (D1), and that the first heat exchanger (D3) exchanges heat with the heat exchanger (19*c*) and heats and cools the refrigerant in the heat exchanger (19*c*) in accordance with a switching operation of the selector means (D2).

12. The heat transport system of claim 1, characterized in that the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T), and that the pressure reducing means (60) includes a circulating condenser (61), which is connected to the tank means (T) and which lowers the internal pressure of the tank means (T) by condensing the refrigerant, and that a condensing pressure of the circulating condenser (61) is set lower than a condensing pressure of the heat exchange means to be the condenser.

13. The heat transport system of one of claims 12 or 26, characterized in that the pressure reducing means (60) includes: a gas recovering pipe (62) for connecting an upper end of the tank means (T) to a gas side of the circulating condenser (61); and a liquid supplying pipe (63) for connecting a lower end of the tank means (T) to a liquid side of the circulating condenser (1), and that the liquid supplying pipe (63) is connected to the lower end of the tank means (T) independent of the liquid pipe (7).

14. The heat transport system of claim 1, characterized in that the pressure regulating means (18) includes: pressurizing means (50) for performing a pressurizing operation of pushing the liquid refrigerant in the tank means (T) to the liquid pipe (7) by raising the internal pressure of the tank means (T); and pressure reducing means (60) for performing a pressure reducing operation of recovering the liquid refrigerant from the liquid pipe (7) to the tank means (T) by lowering the internal pressure of the tank means (T), and that the pressurizing means (50) includes a circulating evaporator (51), which is connected to the tank means (T) and which raises the internal pressure of the tank means (T) by evaporating the refrigerant, and that an evaporating pressure of the circulating evaporator (51) is set higher than an evaporating pressure of the heat exchange means to be the evaporator.

15. The heat transport system of claim 14, characterized in that auxiliary tank means (ST) is provided above the circulating evaporator (51), and that selector means (I) is also provided for recovering the liquid refrigerant in the liquid pipe (7) to the auxiliary tank means (ST) by making the auxiliary tank means (ST) communicate with the pressure reducing means (60) and the liquid pipe (7) during the pressure reducing operation of the pressure reducing means (60) and for dripping and supplying the liquid refrigerant in the auxiliary tank means (ST) to the circulating evaporator (51) by making the auxiliary tank means (ST) communicate with the pressurizing means (50) during the pressurizing operation of the pressurizing means (50).

16. The heat transport system of claim 14, characterized in that at least one first auxiliary tank means (ST1) and at least one second auxiliary tank means (ST2) are provided above the circulating evaporator (51), and that a selector means (I) is also provided for selecting a first selection state in which the liquid refrigerant in the liquid pipe (7) is recovered to the first auxiliary tank means (ST1) by making the first auxiliary tank means (ST1) communicate with the pressure reducing means (60) and the liquid pipe (7) and in which the liquid refrigerant in the second auxiliary tank means (ST2) is dripped and supplied to the circulating evaporator (51) by making the second auxiliary tank means (ST2) communicate with the pressurizing means (50) or a second selection state in which the liquid refrigerant in the liquid pipe (7) is recovered to the second auxiliary tank means (ST2) by making the second auxiliary tank means (ST2) communicate with the pressure reducing means (60) and the liquid pipe (7) and in which the liquid refrigerant in the first auxiliary tank means (ST1) is dripped and supplied to the circulating evaporator (51) by making the first auxiliary tank means (ST1) communicate with the pressurizing means (50).

17. A heat transport system, characterized by comprising:

a refrigerant circuit (B) constituted such that heat exchange means (1) on a heat source side is connected to heat exchange means (3) on an application side through a gas pipe (6) and a liquid pipe (7) so as to circuit a refrigerant therein, the heat exchange means (1) on the heat source side exchanging heat with heat source means (A);

at least one first tank means (T1) and at least one second tank means (T2), which are connected to parallel to the liquid pipe (7) and which reserve a liquid refrigerant therein;

pressure regulating means (18) for alternately switching a first pressure state, in which an internal pressure of the first tank means (T1) is raised and an internal pressure of the second tank means (T2) is lowered, and a second pressure state, in which the internal pressure of the first tank means (T1) is lowered and the internal pressure of the second tank means (T2) is raised, said pressure regulating means including pressure generating means (18A, 18B, D1, E1, E2) coupled to the respective tank means (T1, T2) through pressure pipes (19*d*, 19*e*), makes the pressure generating means (18A, 18B, D1, E1, E2) apply a high pressure to the inside of the first tank means (T1) and a low pressure to the inside of the second tank means (T2) during the first pressure state, and makes the pressure generating means (18A, 18B, D1, E1, E2) apply high pressure to the inside of the second tank means (T2) and an low pressure to the inside of the first tank means (T1) during the second pressure state; and refrigerant control means (H) for supplying the liquid refrigerant from the first tank means (T1) to any of the heat exchange means to be an evaporator and recovering the liquid refrigerant from any of the heat exchange means to be a condenser to the second tank means (T2) during the first pressure state of the pressure regulating means (18), and for supplying the liquid refrigerant from the second tank means (T2) to any of the heat exchange means to be an evaporator and recovering the liquid refrigerant from any of the heat exchange means to be a condenser to the first tank means (T1) during the second pressure state, thereby circulating the refrigerant of the refrigerant circuit (B) and making the heat exchange means (3) on the application side continuously absorb or radiate heat.

18. The heat transport system of claim 17, characterized in that the pressure regulating means (18) includes: pressurizing means (50) for performing a pressurizing operation of pushing the liquid refrigerant in one of the first tank means (T1) and the second tank means (T2) to the liquid pipe (7) by raising the internal pressure of the one tank means (T1 or T2); and pressure reducing means (60) for performing a pressure reducing operation of recovering the liquid refrigerant from the liquid pipe (7) to the other tank means (T2 or T1) by lowering the internal pressure of the other tank means (T2 or T1), and that the pressurizing means (50) includes a circulating evaporator (51), which is connected to the respective tank means (T1, T2) and which raises the internal pressure of each said tank means (T1, T2) by evaporating the refrigerant, and that an evaporating pressure of the circulating evaporator (51) is set higher than an evaporating pressure of the heat exchange means to be the evaporator, and that the pressure regulating means (18) makes the pressurizing means (50) pressurize the first tank means (T1) and makes the pressure reducing means (60) reduce a pressure of the second tank means (T2) during a first pressure state, and the pressure regulating means (18) makes the pressurizing means (50) pressurize the second tank means (T2) and makes the pressure reducing means (60) reduce a pressure of the first tank means (T1) during a second pressure state.

19. The heat transport system of claim 18, characterized in that at least one first auxiliary tank means (ST1) and at least one second auxiliary tank means (ST2) are provided above the circulating evaporator (51), and that selector means (I) is also provided for selecting a first selection state in which the liquid refrigerant in the liquid pipe (7) is recovered to the first auxiliary tank means (ST1) by making the first auxiliary tank means (ST1) communicate with the pressure reducing means (60) and the liquid pipe (7) and in which the liquid refrigerant in the second auxiliary tank means (ST2) is dripped and supplied to the circulating evaporator (51) by making the second auxiliary tank means (ST2) communicate with the pressurizing means (50) or a second selection state in which the liquid refrigerant in the liquid pipe (7) is recovered to the second auxiliary tank means (ST2) by making the second auxiliary tank means (ST2) communicate with the pressure reducing means (60) and the liquid pipe (7) and in which the liquid refrigerant in the first auxiliary tank means (ST1) is dripped and supplied to the circulating evaporator (51) by making the first auxiliary tank means (ST1) communicate with the pressurizing means (50).

20. The heat transport system of claim 16, characterized in that the pressure generating means are a first reservoir container (18A), which is connected to the first tank means (T1) and in which a liquid refrigerant is reservable, and a second reservoir container (18B), which is connected to the second tank means (T2) and in which a liquid refrigerant is reservable, and that the pressure regulating means (18) applies heat to the liquid refrigerant in the first reservoir container (18A) so as to evaporate the liquid refrigerant and to raise an internal pressure of the reservoir container (18A) and extracts heat from a gaseous refrigerant in the second reservoir container (18B) so as to condense the gaseous refrigerant and to lower the internal pressure of the reservoir container (18B) during the first pressure state, and the pressure regulating means (18) applies heat to the liquid refrigerant in the second reservoir container (18B) so as to evaporate the liquid refrigerant and to raise an internal pressure of the reservoir container (18B) and extracts heat from a gaseous refrigerant in the first reservoir container (18A) so as to condense the gaseous refrigerant and to lower the internal pressure of the reservoir container (18A) during the second pressure state.

21. The heat transport system of claim 16, characterized in that the pressure generating means is a compressor (D1), and that switching of connection states of the first tank means (T1) and the second tank means (T2) to the compressor (D1) is performed by making selector means (I) switch the pressure pipes (19*d*, 19*e*) to an outlet side and an inlet side of the compressor (D1), and that the pressure regulating means (18) connects the outlet side of the compressor (D1) to the first tank means (T1) and the inlet side of the compressor (D1) to the second tank means (T2) during the first pressure state, and connects the outlet side of the compressor (D1) to the second tank means (T2) and the inlet side of the compressor (D1) to the first tank means (T1) during the second pressure state.

22. The heat transport system of claim 16, characterized in that the pressure generating means are a first heat exchanger (E1), which is connected to the first tank means (T1) and in which a refrigerant is reservable, and a second heat exchanger (E2), which is connected to the second tank means (T2) and in which a refrigerant is reservable, and that the pressure regulating means (18) applies heat to the refrigerant in the first heat exchanger (E1) so as to raise an internal pressure of the heat exchanger (E1) and extracts heat from the refrigerant in the second heat exchanger (E2) so as to lower the internal pressure of the heat exchanger (E2) during the first pressure state, and the pressure regulating means (18) applies heat to the refrigerant in the second heat exchanger (E2) so as to raise an internal pressure of the heat exchanger (E2) and extracts heat from the refrigerant in the first heat exchanger (E1) so as to lower the internal pressure of the heat exchanger (E1) during the second pressure state.

23. The heat transport system of claim 16, characterized in that the pressure regulating means (18) includes a refrigerant circuit (D) including: a compressor (D1); a first heat exchanger (D3); a pressure reducing mechanism (D4); a second heat exchanger (D5); and selector means (I) for alternately switching connection states of the first heat exchanger (D3) and the second heat exchanger (D5) to an outlet side of the compressor (D1), and that the first heat exchanger (D3) exchanges heat with the first heat exchanger (E1) connected to the first tank means (T1), the second heat exchanger (D5) exchanges heat with the second heat exchanger (E2) connected to the second tank means (T2), and the heat exchangers (E1, E2) are switched between the first pressure state and the second pressure state in accordance with a switching operation of the selector means (I).

24. The heat transport system of claim 16, characterized in that the pressure generating means is constituted by a pressurizing heat exchanger (E2) to be heated by a heating heat exchanger (D3) and a pressure reducing heat exchanger (E1) to be cooled by a cooling heat exchanger (D5), and that the pressure regulating means (18) connects the pressurizing heat exchanger (E2) to the first tank means (T1) and the pressure reducing heat exchanger (E1) to the second tank means (T2) during the first pressure state, and connects the pressurizing heat exchanger (E2) to the second tank means (T2) and the pressure reducing heat exchanger (E1) to the first tank means (T1) during the second pressure state.

25. The heat transport system of claim 24, characterized in that the pressure regulating means (18) includes a refrigerant circuit (D) formed by connecting a compressor (D1), a heating heat exchanger (D3), a pressure reducing mechanism (D4) and a cooling heat exchanger (D5) in this order through a refrigerant pipe.

26. The heat transport system of claim 17, characterized in that the pressure regulating means (18) includes: pressurizing means (50) for performing a pressurizing operation of pushing the liquid refrigerant in one of the first tank means (T1) and the second tank means (T2) to the liquid pipe (7) by raising the internal pressure of the one tank means (T1 or T2); and pressure reducing means (60) for performing a pressure reducing operation of recovering the liquid refrigerant from the liquid pipe (7) to the other tank means (T2 or T1) by lowering the internal pressure of the other tank means (T2 or T1), and that the pressure reducing means (60) includes a circulating condenser (61), which is connected to the respective tank means (T1, T2) and which lowers the internal pressure of each said tank means (T1, T2) by condensing the refrigerant, and that a condensing pressure of the circulating condenser (61) is set lower than a condensing pressure of the heat exchange means to be the condenser, and that the pressure regulating means (18) makes the pressurizing means (50) pressurize the first tank means (T1) and makes the pressure reducing means (60) reduce a pressure of the second tank means (T2) during a first pressure state, and the pressure regulating means (18) makes the pressurizing means (50) pressurize the second tank means (T2) and makes the pressure reducing means (60) reduce a pressure of the first tank means (T1) during a second pressure state.

27. The heat transport system of claim 16, characterized in that the heat exchange means (3) on the application side is an evaporator for absorbing heat, and that the refrigerant control means (H) switches refrigerant flow states in the liquid pipe (7)

so as to supply the liquid refrigerant from the first tank means (T1) to the heat exchange means (3) on the application side and recover the liquid refrigerant from the heat exchange means (1) on the heat source side to the second tank means (T2) during the first pressure state of the pressure regulating means (18), and so as to supply the liquid refrigerant from the second tank means (T2) to the heat exchange means (3) on the application side and recover the liquid refrigerant from the heat exchange means (1) on the heat source side to the first tank means (T1) during the second pressure state of the pressure regulating means (18).

28. The heat transport system of claim 16, characterized in that the heat exchange means (3) on the application side is a condenser for radiating heat, and that the refrigerant control means (H) switches refrigerant flow states in the liquid pipe (7)

so as to supply the liquid refrigerant from the first tank means (T1) to the heat exchange means (1) on the heat source side and recover the liquid refrigerant from the heat exchange means (3) on the application side to the second tank means (T2) during the first pressure state of the pressure regulating means (18), and so as to supply the liquid refrigerant from the second tank means (T2) to the heat exchange means (1) on the heat source side and recover the liquid refrigerant from the heat exchange means (3) on the application side to the first tank means (T1) during the second pressure state of the pressure regulating means (18).

* * * * *